US006465941B1

(12) United States Patent
Kubota et al.

(10) Patent No.: US 6,465,941 B1
(45) Date of Patent: Oct. 15, 2002

(54) COLD CATHODE FIELD EMISSION DEVICE AND DISPLAY

(75) Inventors: Shinji Kubota; Kazuo Kikuchi; Hiroshi Sata, all of Kanagawa (JP)

(73) Assignee: Sony Corporation (JP)

( * ) Notice: Subject to any disclaimer, the term of this patent is extended or adjusted under 35 U.S.C. 154(b) by 0 days.

(21) Appl. No.: 09/453,403

(22) Filed: Dec. 3, 1999

(30) Foreign Application Priority Data

Dec. 7, 1998 (JP) ..... 10-347399
Apr. 13, 1999 (JP) ..... 11-105629

(51) Int. Cl.[7] ..... H01J 1/02
(52) U.S. Cl. ..... 313/309; 313/495
(58) Field of Search ..... 313/309, 336, 313/351, 495

(56) References Cited

U.S. PATENT DOCUMENTS 5,374,868 A 12/1994 Tjaden ..... 313/310
5,527,200 A 6/1996 Lee ..... 445/50
5,584,739 A 12/1996 Itoh et al. ..... 445/24
5,650,689 A 7/1997 Itoh ..... 313/310
5,834,885 A * 11/1998 Itoh et al. ..... 313/336
5,844,250 A * 12/1998 Itoh et al. ..... 313/309
5,850,120 A * 12/1998 Okamoto ..... 313/336
5,955,833 A * 9/1999 Janning ..... 313/495
2001/0024082 A1 * 9/2001 Tommi ..... 313/446

FOREIGN PATENT DOCUMENTS

| | | |
|---|---|---|
| EP | 0 7573 41 | 2/1997 |
| EP | 0 802 555 | 10/1997 |
| EP | 0 865 065 | 9/1998 |
| FR | 2 701 601 | 8/1994 |

* cited by examiner

*Primary Examiner*—Vip Patel
(74) *Attorney, Agent, or Firm*—Ronald P. Kamanen, Esq.; Rader, Fishman, & Grauer, PLLC

(57) ABSTRACT

A cold cathode field emission device comprising; (A) a cathode electrode formed on a support, (B) an insulating layer formed on the support and the cathode electrode, (C) a gate electrode formed on the insulating layer, (D) an opening portion which penetrates through the gate electrode and the insulating layer, and (E) an electron emitting portion which is positioned at a bottom portion of the opening portion and has a tip portion having a conical form and being composed of a crystalline conductive material, the tip portion of the electron emitting portion having a crystal boundary nearly perpendicular to the cathode electrode.

30 Claims, 53 Drawing Sheets

[STEP-100]

[STEP-110]

[STEP-120]

[STEP-130]

[STEP-130] CONTINUED

[STEP-140]

Fig. 7A RESIST SELECTIVITY RATIO : SMALL
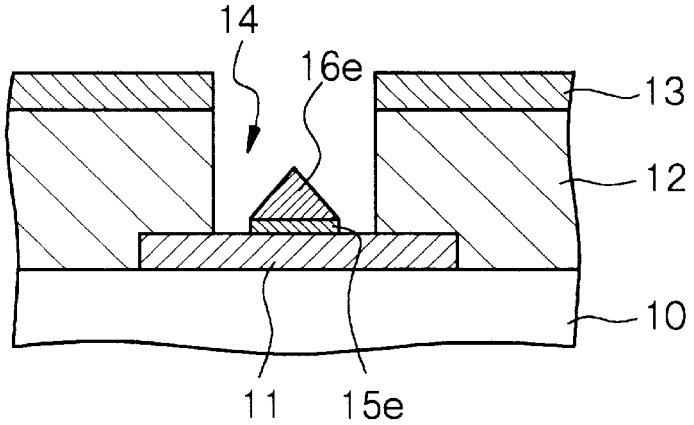
Fig. 7B RESIST SELECTIVITY RATIO : INTERMEDIATE
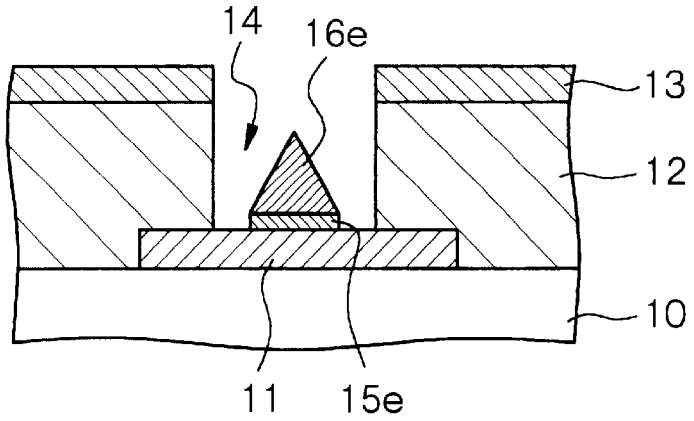
Fig. 7C RESIST SELECTIVITY RATIO : LARGE
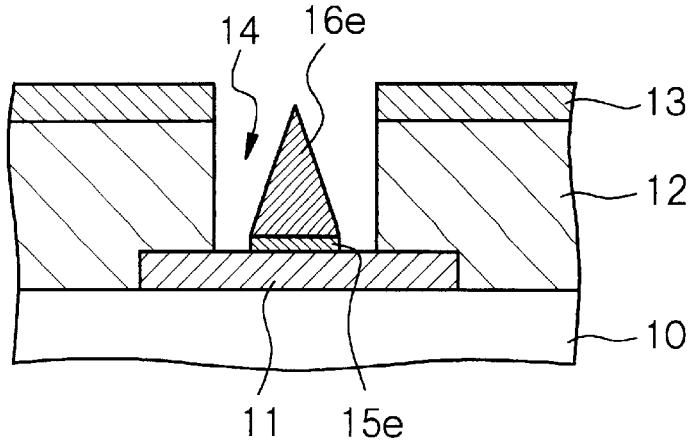

[STEP-200]

[STEP-210]

[STEP-220]

[STEP-230]

[STEP-240]

[STEP-250]

[STEP-300]

[STEP-310]

[STEP-320]

[STEP-400]

[STEP-410]

[STEP-420]

$(\theta_w < \theta_e < 90°)$ $(\theta_w < \theta_e < 90°)$

[STEP-500]

[STEP-510]

[STEP-520]

[STEP-530]

[STEP-540]

[STEP-550]

$(\theta_w < \theta_e < 90°)$

RATIO OF ETCHING RATE

CONDUCTIVE MATERIAL LAYER
: MASK MATERIAL LAYER = 2 : 1

CONDUCTIVE MATERIAL LAYER
: ADHESIVE LAYER = 1 0 : 1

[STEP-600]

[STEP-610]

[STEP-620]

RATIO OF ETCHING RATE

CONDUCTIVE MATERIAL LAYER
: MASK MATERIAL LAYER = 2 : 1

CONDUCTIVE MATERIAL LAYER
: ADHESIVE LAYER = 1 : 1

[STEP-700]

[STEP-700] CONTINUED

[STEP-710]

[STEP-720]

[STEP-720] CONTINUED

[STEP-730]

[STEP-800]

[STEP-810]

[STEP-820]

[STEP-900]

[STEP-910]

[STEP-920]

[STEP-930]

[STEP-1000]

[STEP-1010]

[STEP-1020]

[STEP-1100]

[STEP-1110]

[STEP-1120]

[STEP-1130]

($\theta_w < \theta_p < 90°$)

[STEP-1200]

[STEP-1210]

$(\theta_W < \theta_P < 90°)$

[STEP-1300]

[STEP-1310]

[STEP-1320]

[STEP-1330]

[STEP-1400]

[STEP-1500]

[STEP-1510]

[STEP-10]

[STEP-20]

[STEP-30]

[STEP-40]

COLD CATHODE FIELD EMISSION DEVICE AND DISPLAY

BACKGROUND OF THE INVENTION AND RELATED ART STATEMENT

The present invention relates to a cold cathode field emission device, a process for the production thereof and a cold cathode field emission display. More specifically, it relates to a cold cathode field emission device of which the tip portion has a conical form, a process for the production thereof and a flat panel type cold cathode field emission display having the above cold cathode field emission devices arranged in a two-dimensional matrix form.

Various flat panel type displays are studied for substitutes for currently main-stream cathode ray tubes (CRT). The flat type displays include a liquid crystal display (LCD), an electroluminescence display (ELD) and a plasma display (PDP). Further, a cold cathode field emission type display which can emit electrons from a solid into vacuum without relying on thermal excitation, that is, a so-called field emission display (FED) is proposed as well, and it attracts attention from the viewpoints of brightness on a screen and low power consumption.

A cold cathode field emission type display (to be sometimes simply referred to as "display" hereinafter) generally has a structure in which a cathode panel having electron emitting portions so as to correspond to pixels arranged in a two-dimensional matrix form and an anode panel having a fluorescent layer which emits light when excited by colliding with electrons emitted from the electron emitting portions face each other through a vacuum layer. In each pixel on the cathode panel, generally, a plurality of electron emitting portions are formed, and further, gate electrodes are also formed for extracting electrons from the electron emitting portions. A portion having the above electron emitting portion and the above gate electrode will be referred to as an field emission device hereinafter.

For attaining a large emitted electron current at a low driving voltage in the above structure, it is required to form a top end of the electron emitting portion so as to have an acutely sharpened form, it is required to increase the density of electron emitting portions that can exist in a section corresponding to one pixel by finely forming the electron emitting portions, and it is also required to decrease the distance between the top end of the electron emitting portion and the gate electrode. For materializing these, therefore, there have been already proposed field emission devices having a variety of structures.

As one of typical examples of field emission devices used in the above conventional displays, there is known a so-called Spindt type field emission device of which the electron emitting portion is composed of a conical conductive material. FIG. 51 schematically shows the above Spindt type display. The Spindt type field emission device formed in a cathode panel CP comprises a cathode electrode 201 formed on a support 200, an insulating layer 202, a gate electrode 203 formed on the insulating layer 202, and a conical electron emitting portion 205 formed in an opening portion 204 which is provided so as to penetrate the gate electrode 203 and the insulating layer 202. A predetermined number of the electron emitting portions 205 are arranged in a two-dimensional matrix form to form one pixel. An anode panel AP has a structure in which a fluorescence layer 211 having a predetermined pattern is formed on a transparent substrate 210 and the fluorescence layer 211 is covered with an anode electrode 212.

When a voltage is applied between the electron emitting portion 205 and the gate electrode 203, electrons "e" are extracted from the top end of the electron emitting portion 205 due to a consequently generated electric field. These electrons "e" are attracted to the anode electrode 212 of the anode panel AP to collide with the fluorescence layer 211 which is a light-emitting layer formed between the anode electrode 212 and the transparent substrate 210. As a result, the fluorescence layer 211 is excited to emit light, and a desired image can be obtained. The performance of the above field emission device is basically controlled by a voltage to be applied to the gate electrode 203.

The method of producing a field emission device of the above display will be outlined with reference to FIGS. 52A, 52B, 53A and 53B hereinafter. This production method is basically a method in which the conical electron emitting portion 205 is formed by vertical vapor deposition of a metal material. That is, vaporized particles comes in perpendicularly to the opening portion 204. A shielding effect of an overhanged deposit formed in the vicinities of an opening end portion of the gate electrode 203 is utilized to gradually decrease the amount of the vaporized particles which reach a bottom portion of the opening portion 204, and the electron emitting portion 205 which is a conical deposit is formed in a self-aligned manner. For facilitating the removal of an unnecessary overhanged deposit, a peeling-off layer 206 is formed on the gate electrode 203 beforehand, and the method including the formation of the peeling-off layer will be explained below.

[Step-10]

First, the cathode electrode 201 of niobium (Nb) is formed on the support 200 which is formed of, for example, glass substrate. Then, the insulating layer 202 of $SiO_2$ and the gate electrode 203 of an electrically conductive material are consecutively formed thereon. Then, the gate electrode 203 and the insulating layer 202 are patterned to form the opening portion 204 (see FIG. 52A).

[Step-20]

Then, as shown in FIG. 52B, aluminum is deposited on the gate electrode 203 and the insulating layer 202 by oblique vapor deposition to form the peeling-off layer 206. In this case, a sufficiently large incidence angle of vaporized particles with regard to the normal of the support 200 is selected, whereby the peeling-off layer 206 can be formed on the gate electrode 203 and the insulating layer 202 with depositing almost no aluminum on the bottom of the opening portion 204. The peeling-off layer 206 is overhanged in the form of eaves from an upper end portion of the opening portion 204, and the diameter of the opening portion 204 is substantially decreased.

[Step-30]

Then, an electrically conductive material such as molybdenum (Mo) is deposited on the entire surface by vertical vapor deposition. In this case, as shown in FIG. 53A, as a conductive material layer 205A having an overhanged form grows on the peeling-off layer 206, the substantial diameter of the opening portion 204 is decreased, so that vaporized particles which serve to form a deposit on the bottom of the opening portion 204 gradually comes to be limited to vaporized particles which pass a central area of the opening portion 204. As a result, a conical deposit is formed on the bottom portion of the opening portion 204, and the conical deposit works as the electron emitting portion 205.

[Step-40]

Then, as shown in FIG. 53B, the peeling-off layer 206 is removed from the surface of the gate electrode 203 by an electrochemical process and a wet process, whereby the conductive material layer 205A above the gate electrode 203 is selectively removed.

Meanwhile, the electron emitting characteristic of the field emission device having the structure shown in FIG. 53B is greatly dependent upon a distance from an edge portion 203A of the gate electrode 203 constituting the upper end portion of the opening portion 204 to a tip portion of the electron emitting portion 205. And, the above distance is greatly dependent upon the formation accuracy of the opening portion 204, the dimensional accuracy of diameter of the opening portion 204, the thickness accuracy and coverage (step coverage) of the conductive material layer 205A formed in [Step-30] and, further, the formation accuracy of the peeling-off layer 206 which is a kind of an undercoat thereof.

For producing the display constituted of a plurality of the field emission devices having uniform properties, therefore, it is required to uniformly form the conductive material layer 205A on the entire surface of a substratum. In a general deposition apparatus, however, since conductive material particles are released from a deposition source located in one point so as to have an angle spread to some extent, the thickness and the symmetry of the coverage differ from vicinities of a central portion to circumferential areas in the substratum. Therefore, heights of the electron emitting portions are liable to vary and positions of the tip portions of the electron emitting portions are liable to deviate from the centers of the opening portions 204, so that it is difficult to control the variability of distances from the tip portions of the conical electron emitting portions 205 to the gate electrodes 203. Moreover, the above variability of the distances occurs not only among lots of products but also in one lot of the products, and it causes a non-uniformity in image display characteristic of the display, for example, brightness of an image. Further, the conductive material layer 205A is generally formed as a layer having a thickness of approximately 1 $\mu$m or more, and the formation thereof by a vapor deposition method takes a time period of units of several tens of hours, which involves problems that it is difficult to improve a throughput and that a large deposition apparatus is required.

Further, it is also very difficult to form the peeling-off layer 206 uniformly on the entire surface of a substratum having a large area by an oblique vapor deposition method. It is very difficult as well to deposit the peeling-off layer 206 highly accurately such that it extends from the upper end portion of the opening portion 204 formed in the gate electrode 203 so as to form eaves. Further, the formation of the peeling-off layer 206 is liable to vary not only in a plane of the support but also among lots. Moreover, not only it is very difficult to peel off the peeling-off layer 206 over the support 200 having a large area for producing a display having a large area, but also the peeling of the peeling-off layer 206 causes contamination and causes the production yield of displays to decrease.

Further to the above, the height of the conical electron emitting portion 205 is defined mainly by the thickness of the conductive material layer 205A, and the freedom in designing the electron emitting portion 205 is low. Moreover, since it is difficult to determine an height of the electron emitting portion 205 arbitrarily as required, it is inevitably required to decrease the thickness of the insulating layer 202 when the distance from the electron emitting portion 205 to the gate electrode 203 decreases. When the thickness of the insulating layer 202 is decreased, however, it is difficult to decrease the capacitance between wiring lines (between the gate electrode 203 and the cathode electrode 201), so that there are caused problems that not only a load on an electric circuit of the display increases but also the display is downgraded in in-plane uniformity and image quality.

In the electron emitting portion 205 having the above conical form, further, the electron emitting characteristic can differ depending upon the orientation of a crystal boundary of the conductive material forming the electron emitting portion 205. In the method of producing a conventional field emission device, there is known no technique for utilizing a region having an optimum orientation in a region of a conductive material layer as the electron emitting portion 205.

OBJECT AND SUMMARY OF THE INVENTION

It is therefore an object of the present invention to provide a cold cathode field emission device (to be sometimes referred to as "field emission device" hereinafter) and a process for the production thereof, which can overcome the above production problems in a conventional Spindt type cold cathode field emission device and enables the production of a plurality of cold cathode field emission devices having uniform and excellent electron emitting characteristics by a simple method, and a cold cathode field emission display (to be sometimes referred to as "display" hereinafter) constituted by utilizing the above field emission devices.

The cold cathode field emission device according to a first aspect of the present invention for achieving the above object is a cold cathode field emission device comprising;

(A) a cathode electrode formed on a support, (B) an insulating layer formed on the support and the cathode electrode, (C) a gate electrode formed on the insulating layer, (D) an opening portion which penetrates through the gate electrode and the insulating layer, and (E) an electron emitting portion which is positioned at a bottom portion of the opening portion and has a tip portion having a conical form and being composed of a crystalline conductive material, the tip portion of the electron emitting portion having a crystal boundary nearly perpendicular to the cathode electrode.

The process for the production of a cold cathode field emission device according to the first aspect of the present invention (to be referred to as "production process according to the first aspect of the present invention" hereinafter), is a process for the production of the cold cathode field emission device according to the first aspect of the present invention and a cold cathode field emission device according to a second aspect of the present invention to be described later. That is, the process according to the first aspect of the present invention comprises the steps of;

(a) forming a cathode electrode on a support, (b) forming an insulating layer on the support and the cathode electrode, (c) forming a gate electrode on the insulating layer, (d) forming an opening portion which penetrates through at least the insulating layer and has a bottom portion where the cathode electrode is exposed, (e) forming a conductive material layer for forming an electron emitting portion on the entire surface including the inside of the opening portion, (f) forming a mask material layer on the conductive material layer so as to mask a region of the conductive material layer positioned in the central portion of the opening portion, and (g) etching the conductive material layer and the mask material layer under an anisotropic etching condition where an etch rate of the conductive material layer in the direction perpendicular to the support is larger than an etch rate of the mask material layer in the direction perpendicular to the support, to form, in the opening portion, the electron emitting portion which is composed of the conductive material layer and has a tip portion having a conical form.

The above step (g) is a kind of an etchback process which deliberately utilizes an etch rate difference between the mask material layer and the conductive material layer. In the present specification, "etch rate in the direction perpendicular to the support" will be simply referred to as "etch rate" hereinafter.

The cold cathode field emission display according to a first aspect of the present invention is a display for which the cold cathode field emission devices according to the first aspect of the present invention are applied. That is, the display according to the first aspect of the present invention comprises a plurality of pixels, each pixel being constituted of a plurality of cold cathode field emission devices and of an anode electrode and a fluorescence layer formed on a substrate so as to face a plurality of the cold cathode field emission devices, each cold cathode field emission device comprising;

(A) a cathode electrode formed on a support, (B) an insulating layer formed on the support and the cathode electrode, (C) a gate electrode formed on the insulating layer, (D) an opening portion which penetrates through the gate electrode and the insulating layer, and (E) an electron emitting portion which is positioned at a bottom portion of the opening portion and has a tip portion having a conical form and being composed of a crystalline conductive material, the tip portion of the electron emitting portion having a crystal boundary nearly perpendicular to the cathode electrode.

In the cold cathode field emission device, the process for the production thereof and the cold cathode field emission display according to the first aspect of the present invention, the tip portion of the electron emitting portion has a conical form and is composed of a crystalline conductive material. The electron emitting portion may be conical as a whole, or the tip portion alone may be conical like a top-sharpened pencil. The conical form includes a conical form (bottom having a circular form) and a pyramidal form (bottom having a polygonal form). The tip portion of the electron emitting portion is a portion where a high electric field is centered, and the electron emitting portion has a dimension of the micron order, so that the tip portion is liable to suffer damage while it repeatedly emits electrons. In the first aspect of the present invention, the tip portion of the electron emitting portion is composed of a crystalline conductive material, and the direction of the crystal boundary thereof is nearly perpendicular to the cathode electrode, which means that the flow of electrons in the tip portion of the electron emitting portion does not cross the crystal boundary. Therefore, the tip portion is free from a disorder caused in crystal structure, and the electron emitting portion which emits electrons by being exposed to a high electric field is improved in durability. As a result, the field emission device and the display to which the field emission devices are incorporated can be improved so as to have a longer life.

The tip portion of the electron emitting portion can be formed from any material such as a refractory metal (for example, tungsten (W), titanium (Ti), niobium (Nb), molybdenum (Mo), tantalum (Ta) and chromium (Cr)) or any one of compounds of these (for example, nitride such as TiN and silicide such as $WSi_2$, $MoSi_2$, $TiSi_2$ or $TaSi_2$) by any method so long as the orientation of the crystal boundary is aligned nearly perpendicularly to the cathode electrode, while the tip portion is preferably formed of a tungsten layer formed by a CVD method. The CVD method has the following advantages over a vapor deposition method. The throughput can be improved to a large extent since the layer formation rate by the CVD method is remarkably high, and a layer having a uniform thickness and coverage can be relatively easily formed on the whole of a substratum having a large area since the formation of the layer by the CVD method can proceed in any points so long as the points are those which can be brought into contact with a source gas present in a layer-forming atmosphere, which differs from the vapor deposition method in which vaporized particles flies from a deposition source located in one site and are deposited. The process for forming a tungsten layer by a CVD method is well established, and tungsten is a refractory metal, so that tungsten is suitable as a material for constituting the tip portion of the electron emitting portion.

There may be formed an electrically conductive adhesive layer between the electron emitting portion and the cathode electrode. The adhesive layer can be selected from layers used as a so-called barrier metal layer in a general semiconductor process, and it may be a single layer or it may be a composite layer formed of a combination of a plurality of kinds of material. However, if it is taken into account that the electron emitting portion or a sharpened portion is formed by etching the conductive material layer or a second conductive material layer (the electron emitting portion, the sharpened portion, the conductive material layer and the second conductive material layer will be sometimes referred to as "conductive material layer, etc." hereinafter) in the production process according to the first aspect and the process for the production of the field emission device according to a second aspect of the present invention to be described later, the adhesive layer is preferably selected so as to satisfy that the conductive material layer, etc., and the adhesive layer can be removed at nearly the same etch rates under the same etching condition, or that even if an etch rate $R_1$ of the conductive material layer, etc., is higher, the etch rate $R_1$ does not exceed five times an etch rate $R_2$ of the adhesive layer ($R_2 \leqq R_1 \leqq 5R_2$). The reason therefore is as follows. The etching of the conductive material layer, etc., proceeds to expose the adhesive surface in most part of an etched surface, a reaction product by etching of the adhesive layer may be generated in a large amount, and part of the reaction product adheres to the surface of the conductive material layer, etc., and in this case, if the above reaction product by etching has too low a vapor pressure, the reaction product itself works as an etching mask, and there is a large risk that the etching of the conductive material layer, etc., may be hampered. The simplest solution is that the same electrically conductive material is used for constituting the conductive material layer, etc., and the adhesive layer so that the etch rates of these layers can be nearly equalized. When the conductive material layer, etc., and the adhesive layer are formed from the same electrically conductive material, particularly preferably, the adhesive layer is formed by a sputtering method, and the conductive material layer, etc., are formed by a CVD method.

In the field emission device or the display according to the first aspect of the present invention, a second insulating layer may be further formed on the gate electrode and the insulating layer, and a focus electrode may be formed on the second insulating layer. The focus electrode is a member provided for preventing divergence of paths of electrons emitted from the electron emitting portion in a so-called high-voltage type display in which the potential difference between the anode electrode and the cathode electrode is the order of several thousands volts and the distance between these electrodes are relatively large. When the convergence of paths of emitted electrons is improved, an optical crosstalk among pixels is decreased, color mixing particularly in color display is prevented, and further, the pixels can be finely divided to attain a higher fineness of a display screen.

In the production process according to the first aspect of the present invention, in the step (d), an opening portion may be formed in the insulating layer, said opening portion having a wall surface having an inclination angle $\theta_w$ measured from the surface of the cathode electrode as a reference, and in the step (g), a tip portion having a conical form may be formed, said tip portion having a slant of which an inclination angle $\theta_e$ measured from the surface of the cathode electrode as a reference satisfies a relationship of $\theta_w<\theta_e<90°$.

The above production process enables the production of a field emission device according to a second aspect of the present invention to be described later. The step (g) is a kind of an etchback process as already described. When the wall surface of the opening portion is perpendicular to the surface of the cathode electrode, however, an etching residue of the conductive material layer may remain in a corner portion of the opening portion, and under some etching conditions, the electron emitting portion having a conical tip portion and the gate electrode may short-circuit with the etching residue. If the etchback is continued for a long period of time until the etching residue is fully removed for avoiding the above short circuit, the height of the electron emitting portion is decreased to excess at the same time, and the distance from the end portion of the gate electrode to the tip portion of the electron emitting portion increases, resulting in a decrease in the electron emission efficiency.

When the inclination angle $\theta_w$ of the wall surface of the opening portion is defined as described above, easy incidence of etching species to the conductive material layer on the wall surface is achieved as compared with a case where the wall surface is perpendicular to the surface of the cathode electrode. Since a general etchback process uses an anisotropic etching condition under which ions as etching species come almost perpendicularly to a layer to be etched, easier incidence of the etching species is attained, which leads to a decrease in the etching time period and means that the wall surface of the opening portion comes to be exposed in a short period of time. It is therefore made possible to prevent the short circuit between the gate electrode and the electron emitting portion without decreasing the height of the electron emitting portion in the opening portion (i.e., without decreasing the electron emission efficiency).

In the most general practice, the opening portion is formed in the insulating layer by an anisotropic etching method, and in this etching method, the wall surface of the opening portion can be slanted by utilizing the effect of a depositional reaction by-product on decreasing the etch rate. When it is assumed that a silicon compound such as a silicon-oxide-containing material or a silicon-nitride-containing material is used as a material for constituting the insulating layer, fluorocarbon etching gases are used as an etching gas, and a carbon-base polymer is generated as a depositional reaction by-product. For increasing a deposition amount of the carbon-base polymer in the above etching reaction system, there can be employed measures to increase the flow rate of fluorocarbon etching gases, to decrease the flow rate of an etching gas which can serve as a source for oxygen-base chemical species which promotes the combustion of the carbon-base polymer, to decrease a mean free path of ion by increasing a gas pressure, to decrease an RF power used for exciting plasma, to increase the frequency of an RF power source used for exciting plasma to inhibit the ion-sputtering-effect-based removal of the carbon-base polymer, or to decrease the temperature of a layer being etched for decreasing the vapor pressure of the carbon-base polymer. When the deposition amount of the carbon-base polymer is too large, however, the etching no longer proceeds at a practical rate, so that the above measures should be taken to such an extent that the practical etch rate is attainable.

In the cold cathode field emission device according to the first aspect of the present invention, the opening portion penetrates through the gate electrode and the insulating layer, while the step (d) of the production process, according to the first aspect of the present invention for producing the above cold cathode field emission device, describes "forming an opening portion which penetrates through 'at least' the insulating layer and has a bottom portion where the cathode electrode is exposed". That is because in some cases, the formation of the opening portion in the gate electrode and the formation of the opening portion in the insulating layer are not necessarily required to be carried out at the same time. The above case where the formation of the opening portion in the gate electrode and the formation of the opening portion in the insulating layer are not necessarily required to be carried out at the same time refers, for example, to a case where a gate electrode having an opening portion from the beginning is formed on the insulating layer and in the opening portion, part of the insulating layer is removed to form the opening portion. The above "at least" is also similarly used in this sense in the step (d) of a production process according to a second aspect of the present invention to be described later.

The production process according to the first aspect of the present invention can be largely classified to first-A to first-D aspects on the basis of variations of the step (e). That is, in the process for the production of a cold cathode field emission device according to the first-A aspect of the present invention (to be referred to as "production process according to the first-A aspect of the present invention" hereinafter), preferably, in the step (e), a recess is formed in the surface of the conductive material layer on the basis of a step between the upper end portion and the bottom portion of the opening portion, when the conductive material layer for forming an electron emitting portion is formed on the entire surface including the inside of the opening portion, and in the consequent step (f), the mask material layer is formed on the entire surface of the conductive material layer and then the mask material layer is removed until a flat plane of the conductive material layer is exposed, to leave the mask material layer in the recess.

Preferably, the mask material layer remaining in the recess has a nearly flat surface. When the mask material layer which has been just formed on the entire surface of the conductive material layer has a nearly flat surface, therefore, the mask material layer can be removed by an etchback method under an anisotropic etching condition, a polishing method or a combination of these methods. When the mask material layer which has been just formed on the entire surface of the conductive material layer has no nearly flat surface, the mask material layer can be removed by a polishing method.

The mask material layer in the production process according to the first-A aspect of the present invention is composed of a material which can have an etch rate lower than the etch rate of the conductive material layer in the consequent step (g) and which can have such a fluidity at a proper stage of formation so that its surface can be flattened. The material for forming the mask material layer includes, for example, a resist material, SOG (spin on glass) and polyimide-base resins. These materials can be easily applied by a spin coating method. Otherwise, there may be used a material capable of giving a layer having a surface which can be flattened by thermal reflow, such as BPGS (boro-phosphosilicate glass).

The process for the production of a cold cathode field emission device according to each of the first-B and first-C aspects according to the present invention is a process in which the conductive material layer can have a narrower region masked by the mask material layer than in the production process according to the first-A aspect of the present invention.

That is, in the process for the production of a cold cathode field emission device according to the first-B aspect of the present invention (to be referred to as "production process according to the first-B aspect of the present invention" hereinafter), preferably, in the step (e), a nearly funnel-like recess having a columnar portion and a widened portion communicating with the upper end of the columnar portion is formed in the surface of the conductive material layer on the basis of a step between the upper end portion and the bottom portion of the opening portion, and in the step (f), the mask material layer is formed on the entire surface of the conductive material layer and then the mask material layer and the conductive material layer are removed in a plane which is in parallel with the surface of the support, to leave the mask material layer in the columnar portion.

Further, in the process for the production of a cold cathode field emission device according to the first-C aspect of the present invention (to be referred to as "production process according to the first-C aspect of the present invention" hereinafter), preferably, in the step (e), a nearly funnel-like recess having a columnar portion and a widened portion communicating with the upper end of the columnar portion is formed in the surface of the conductive material layer on the basis of a step between the upper end portion and the bottom portion of the opening portion, and in the step (f), the mask material layer is formed on the entire surface of the conductive material layer and then the mask material layer on the conductive material layer and in the widened portion is removed to leave the mask material layer in the columnar portion.

For forming the nearly funnel-like recess in the surface of the conductive material layer in the production process according to each of the first-B and first-C aspects of the present invention, it is sufficient to terminate the formation of the conductive material layer just before the surface (front) of conductive material layer growing nearly perpendicularly to the wall surface of the opening portion comes in contact with itself nearly in the center of the opening portion. For example, when the opening portion has the form of a circular cylinder, it is required to design that the thickness of the conductive material layer be smaller than a radius of the opening portion, whereby a columnar portion having the form of a circular cylinder is formed. The diameter of the above columnar portion is generally set in the range of approximately 5 to 30%, preferably 5 to 10%, of the diameter of the opening portion. In the production process according to each of the first-B and first-C aspects of the present invention, finally, the very small mask material layer remaining in a very narrow region (i.e., columnar portion) nearly in the central portion of the opening portion works as a mask for the etchback process, so that the tip portion of the electron emitting portion being formed comes to be more sharpened. However, the above very small mask material layer is required to have sufficient etching durability. Generally preferably, a relationship of $10R_3 \leqq R_1$ is satisfied where $R_3$ is the etch rate of the mask material layer and $R_1$ is the etch rate of the conductive material layer. That is, the etch rate $R_3$ of the mask material layer is approximately 1/10 or less of the etch rate of the conductive material layer. For example, when the conductive material layer is composed of a refractory metal such as tungsten (W), titanium (Ti), niobium (Nb), molybdenum (Mo), tantalum (Ta) and chromium (Cr) or any one of compounds of these (for example, nitrides such as TiN and silicides such as $WSi_2$, $MoSi_2$, $TiSi_2$ and $TaSi_2$), the material for the mask material layer can be selected from copper (Cu), gold (Au) or platinum (Pt), and these may be used alone or in combination.

When the mask material layer is formed on the entire surface of the conductive material layer in the production process according to each of the first-B and first-C aspects of the present invention, it is required to employ a method in which the mask material layer can enter the narrow columnar portion. An electrolytic plating method or an electroless plating method is preferred therefor. When a sputtering method or a CVD method is employed, it is particularly preferred to devise for improving a step coverage. For example, when a sputtering method is employed, desirably, so-called reflow sputtering is carried out at a layer formation temperature of approximately 300° C or higher, or high-pressure sputtering is carried out. When a CVD method is employed, it is preferred to use a bias ECR (electron cyclotron resonance) plasma CVD apparatus.

In the process for the production of a cold cathode field emission device according to a first-D aspect of the present invention (to be referred to as "production process according to the first-D aspect of the present invention" hereinafter), preferably, in the step (e), an electrically conductive adhesive layer is formed on the entire surface including the inside of the opening portion prior to formation of the conductive material layer for forming an electron emitting portion, and in the step (g), the conductive material layer, the mask material layer and the adhesive layer are etched under an anisotropic etching condition where the etch rate of the conductive material layer and an etch rate of the adhesive layer are higher than the etch rate of the mask material layer.

It has been already described that the etch rate of the conductive material layer and the etch rate of the adhesive layer are not necessarily required to be the same and may differ to some extent in practical production, while it is preferred that the etch rate $R_1$ of the conductive material layer for forming the electron emitting portion and the etch rate $R_2$ of the adhesive layer satisfy a relationship of $R_2 \leqq R_1 \leqq 5R_2$ in the step (g). Particularly, when the conductive material layer for forming the electron emitting portion and the adhesive layer are composed of the same electrically conductive material, the above relationship may be $R_2 \fallingdotseq R_1$.

In the production process according to each of the first-A to first-D aspects of the present invention, it is particularly preferred to form the conductive material layer by a CVD method excellent in step coverage (step covering capability) for forming the recess in the surface of the conductive material layer on the basis of a step between the upper end portion and the bottom portion of the opening portion.

The cold cathode field emission device according to a second aspect of the present invention is a cold cathode field emission device comprising;

(A) a cathode electrode formed on a support, (B) an insulating layer formed on the support and the cathode electrode, (C) a gate electrode formed on the insulating layer, (D) an opening portion which penetrates through the gate electrode and the insulating layer, and (E) an electron emitting portion which is positioned at a bottom portion of the opening portion and has a tip portion having a conical form, wherein a relationship of $\theta_w<\theta_e<90°$ is satisfied where $\theta_w$ is an inclination angle of a wall surface of the opening portion measured from the surface of the cathode electrode as a reference and $\theta_e$ is an inclination angle of slant of the tip portion measured from the surface of the cathode electrode as a reference.

The cold cathode field emission display according to a second aspect of the present invention is a display to which the field emission devices according to the second aspect of the present invention are applied. That is, the cold cathode field emission display according to the second aspect of the present invention comprises a plurality of pixels, each pixel being constituted of a plurality of cold cathode field emission devices and of an anode electrode and a fluorescence layer formed on a substrate so as to face a plurality of the cold cathode field emission devices, each cold cathode field emission device comprising;

(A) a cathode electrode formed on a support, (B) an insulating layer formed on the support and the cathode electrode, (C) a gate electrode formed on the insulating layer, (D) an opening portion which penetrates through the gate electrode and the insulating layer, and (E) an electron emitting portion which is positioned at a bottom portion of the opening portion and has a tip portion having a conical form, wherein a relationship of $\theta_w<\theta_e<90°$ is satisfied where $\theta_w$ is an inclination angle of a wall surface of the opening portion measured from the surface of the cathode electrode as a reference and $\theta_e$ is an inclination angle of slant of the tip portion measured from the surface of the cathode electrode as a reference.

The inclination angle $\theta_w$ of the wall surface of the opening portion measured from the surface of the cathode electrode as a reference is selected so as to be smaller than the inclination angle $\theta_e$ of slant of the tip portion measured from the surface of the cathode electrode as a reference ($\theta_w<\theta_e$) as described above, whereby the field emission device and the display according to the second aspect of the present invention has a structure in which a short circuit between the gate electrode and the electron emitting portion is reliably prevented while these device and display have an electron emitting portion having a sufficient height. The process for the production of the cold cathode field emission device according to the second aspect of the present invention is as already described.

The cold cathode field emission device according to a third aspect of the present invention is a cold cathode field emission device comprising;

(A) a cathode electrode formed on a support, (B) an insulating layer formed on the support and the cathode electrode, (C) a gate electrode formed on the insulating layer, (D) an opening portion which penetrates through the gate electrode and the insulating layer, and (E) an electron emitting portion which is positioned at a bottom portion of the opening portion, the electron emitting portion comprising a base portion and a conical sharpened portion formed on the base portion.

The process for the production of a cold cathode field emission device according to a second aspect of the present invention (to be referred to as "production process according to the second aspect of the present invention" hereinafter) is a process for the production of the field emission device according to the third aspect of the present invention. That is, the production process according to the second aspect of the present invention is a process for the production of a field emission device having an electron emitting portion which comprises a base portion and a conical sharpened portion formed on the base portion, and the process comprises the steps of;

(a) forming a cathode electrode on a support, (b) forming an insulating layer on the support and the cathode electrode, (c) forming a gate electrode on the insulating layer, (d) forming an opening portion which penetrates through at least the insulating layer and has a bottom portion where the cathode electrode is exposed, (e) filling the bottom portion of the opening portion with a base portion composed of a first conductive material layer, (f) forming a second conductive material layer on the entire surface including a residual portion of the opening portion, (g) forming a mask material layer on the second conductive material layer so as to mask a region of the second conductive material layer positioned in the central portion of the opening portion, and (h) etching the second conductive material layer and the mask material layer under an anisotropic etching condition where an etch rate of the second conductive material layer in the direction perpendicular to the support is higher than an etch rate of the mask material layer in the direction perpendicular to the support, to form the sharpened portion composed of the second conductive material layer on the base portion.

The cold cathode field emission display according to a third aspect of the present invention is a display to which the cold cathode field emission devices according to the third aspect of the present invention are applied. That is, the cold cathode field emission display according to the third aspect of the present invention comprises a plurality of pixels, each pixel being constituted of a plurality of cold cathode field emission devices and of an anode electrode and a fluorescence layer formed on a substrate so as to face a plurality of the cold cathode field emission devices, each cold cathode field emission device comprising;

(A) a cathode electrode formed on a support, (B) an insulating layer formed on the support and the cathode electrode, (C) a gate electrode formed on the insulating layer, (D) an opening portion which penetrates through the gate electrode and the insulating layer, and (E) an electron emitting portion which is positioned at a bottom portion of the opening portion, the electron emitting portion comprising a base portion and a conical sharpened portion formed on the base portion.

In the production process according to the second aspect of the present invention, preferably, in the step (e), the first conductive material layer is formed on the entire surface including the inside of the opening portion and then the first conductive material layer is etched to fill the bottom portion of the opening portion with the base portion. Otherwise, when it is intended to flatten an upper surface of the base portion, in the step (e), the first conductive material layer is formed on the entire surface including the inside of the opening portion, further, a planarization layer is formed on the entire surface of the first conductive material layer so as to nearly flatten the surface of the planarization layer, and the planarization layer and the first conductive material layer are etched under a condition where an etch rate of the planarization layer and an etch rate of the first conductive material layer are nearly equal, whereby the bottom portion of the opening portion can be filled with the base portion having a flat upper surface.

In the cold cathode field emission device or the cold cathode field emission display according to the third aspect of the present invention, the base portion and the sharpened portion of the electron emitting portion may be composed of different electrically conductive materials. The above constitution will be sometimes referred to as a field emission device or display according to the third-A aspect of the present invention. For forming the above field emission device, in the production process according to the second aspect of the present invention, conductive material layers of different kinds are selected for the first conductive material layer for forming the base portion and the second conductive material layer for forming the sharpened portion. In this case, preferably, the sharpened portion which is to exposed to a high electric field is composed of a refractory metal material, and the refractory metal material includes metals such as tungsten (W), titanium (Ti), molybdenum (Mo), niobium (Nb), tantalum (Ta) and chromium (Cr), alloys containing these metal elements, and compounds containing these metal elements (for example, nitrides such as TiN and silicides such as $WSi_2$, $MoSi_2$, $TiSi_2$ and $TaSi_2$). Particularly preferably, the sharpened portion is formed by etching a tungsten (W) layer formed by a CVD method. The base portion may be composed of a refractory metal material which is selected from the above refractory metal material and differs from the refractory metal material selected for the sharpened portion, or composed of a semiconductor material such as a polysilicon containing an impurity. Preferably, the sharpened portion of the electron emitting portion is composed of a crystalline conductive material and has a crystal boundary nearly perpendicular to the cathode electrode. For forming the above sharpened portion, the first conductive material layer for forming the base portion and the second conductive material layer for forming the sharpened portion are formed by CVD methods, and the second conductive material layer is etched to leave a portion having a crystal boundary nearly perpendicular to the cathode electrode as the sharpened portion.

In the cold cathode field emission device or the cold cathode field emission display according to the third aspect of the present invention, the base portion and the sharpened portion of the electron emitting portion may be composed of the same electrically conductive material. The above constitution will be sometimes referred to as a field emission device or display according to the third-B aspect of the present invention. For forming the above field emission device, in the production process according to the second aspect of the present invention, conductive material of the same kind is selected for the first conductive material layer for forming the base portion and the second conductive material layer for forming the sharpened portion. Preferably, the sharpened portion of the electron emitting portion is composed of a crystalline conductive material and has a crystal boundary nearly perpendicular to the cathode electrode. For forming the above sharpened portion, the first conductive material layer for forming the base portion and the second conductive material layer for forming the sharpened portion are formed by CVD methods, and the second conductive material layer is etched to leave a portion having a crystal boundary nearly perpendicular to the cathode electrode as the sharpened portion.

In the cold cathode field emission device according to the third-B aspect of the present invention, the process for the production thereof and the cold cathode field emission display according to the third aspect of the present invention, the first conductive material layer and the second conductive material layer can be formed of a metal layer of a refractory metal such as tungsten (W), titanium (Ti), molybdenum (Mo), niobium (Nb), tantalum (Ta) and chromium (Cr), an alloy layer containing any one of these metal elements, or a layer of a compound containing any one of these metal elements (for example, nitrides such as TiN and silicides such as $WSi_2$, $MoSi_2$, $TiSi_2$ and $TaSi_2$), and is formed, most preferably, of a tungsten (W) layer.

In the field emission device or the display according to the third aspect of the present invention, a relationship of $\theta_w<\theta_p<90°$ may be satisfied where Ow is an inclination angle of a wall surface of the opening portion measured from the surface of the cathode electrode as a reference and $\theta_p$ is an inclination angle of slant of the sharpened portion measured from the surface of the cathode electrode as a reference. The above constitution will be sometimes referred to as a field emission device or display according to the third-C aspect of the present invention. The above field emission device can be produced by the production process according to the second aspect of the present invention in which in the step (d), formed is the opening portion having a wall surface of an inclination angle $\theta_w$ measured from the surface of the cathode electrode as a reference in the insulating layer, and, in the step (h), formed is the sharpened portion having a slant whose inclination angle $\theta_p$ measured from the surface of the cathode electrode as a reference satisfies a relationship of $\theta_w<\theta_p<90°$. The reason for the above is as already explained with regard to the production process according to the second aspect of the present invention.

The production process according to the second aspect of the present invention can be largely classified into the second-A to second-D aspects on the basis of variations of the step (f).

That is, in the process for the production of a cold cathode field emission device according to the second-A aspect of the present invention (to be referred to as "production process acceding to the second-A aspect of the present invention" hereinafter), preferably, in the step (f), a recess is formed in the surface of the second conductive material layer for forming the sharpened portion on the basis of a step between the upper end portion and the bottom portion of the opening portion when the second conductive material layer for forming the sharpened portion is formed on the entire surface including the residual portion of the opening portion, and in the step (g), the mask material layer is formed on the entire surface of the second conductive material layer and then the mask material layer is removed until a flat plane of the second conductive material layer is exposed, to leave the mask material layer in the recess. Preferably, the mask material layer remaining in the recess has a nearly flat surface. When the mask material layer which has been just formed on the entire surface of the second conductive material layer has a nearly flat surface, therefore, the mask material layer can be removed by an etchback method under an anisotropic etching condition, a polishing method or a combination of these methods. When the mask material layer which has been just formed on the entire surface of the second conductive material layer has no nearly flat surface, the mask material layer can be removed by a polishing method. The material for constituting the mask material layer includes those described with regard to the production process according to the first-A aspect of the present invention.

The process for the production of a cold cathode field emission device according to each of the second-B and second-C aspects according to the present invention is a process in which the second conductive material layer can have a narrower region masked by the mask material layer than in the production process according to the second-A aspect.

That is, in the process for the production of a cold cathode field emission device according to the second-B aspect of the present invention (to be referred to as "production process according to the second-B aspect of the present invention" hereinafter), preferably, in the step (f), a nearly funnel-like recess having a columnar portion and a widened portion communicating with the upper end of the columnar portion is formed in the surface of the second conductive material layer for forming the sharpened portion on the basis of a step between the upper end portion and the bottom portion of the opening portion, and in the step (g), the mask material layer is formed on the entire surface of the second conductive material layer and then the mask material layer and the second conductive material layer are removed in a plane parallel with the surface of the support, to leave the mask material layer in the columnar portion.

Further, in the process for the production of a cold cathode field emission device according to the second-C aspect of the present invention (to be referred to as "production process according to the second-C aspect of the present invention" hereinafter), preferably, in the step (f), a nearly funnel-like recess having a columnar portion and a widened portion communicating with the upper end of the columnar portion is formed in the surface of the second conductive material layer for forming the sharpened portion on the basis of a step between the upper end portion and the bottom portion of the opening portion, and in the step (g), the mask material layer is formed on the entire surface of the second conductive material layer and then the mask material layer on the second conductive material layer and in the widened portion is removed to leave the mask material layer in the columnar portion.

In the production process according to each of the second-B and second-C aspects of the present invention, conditions necessary for forming the nearly funnel-like recess in the surface of the second conductive material layer and materials that can be used for the mask material layer are as already explained with regard to the first-B and first-C aspects of the present invention.

In the cold cathode field emission device or the cold cathode field emission display according to the third aspect of the present invention, an electrically conductive adhesive layer may be formed between the base portion and the sharpened portion. In this case, the adhesive layer may be composed of an electrically conductive material which satisfies a relationship of $R_2 \leqq R_1 \leqq 5R_2$ where $R_1$ is an etch rate of the second conductive material layer for forming the sharpened portion in the direction perpendicular to the support and $R_2$ is an etch rate of the adhesive layer in the direction perpendicular to the support. The same electrically conductive material is preferably used for constituting the sharpened portion and the adhesive layer.

In the process for the production of a cold cathode field emission device according to the second aspect, in the step (f), an electrically conductive adhesive layer may be formed on the entire surface including the residual portion of the opening portion prior to formation of the second conductive material layer for forming the sharpened portion. As the above adhesive layer, there can be used the already described adhesive layer that can be used between the cathode electrode and the electron emitting portion. Generally preferably, a relationship of $10R_3 \leqq R_1$ is satisfied where $R_3$ is an etch rate of the mask material layer in the direction perpendicular to the support and $R_1$ is the etch rate of the second conductive material layer in the direction perpendicular to the support. The material for the mask material layer can be selected from copper (Cu), gold (Au) or platinum (Pt), and these may be used alone or in combination.

In the process for the production of a cold cathode field emission device according to the second-D aspect of the present invention (to be referred to as "production process according to the second-D aspect of the present invention" hereinafter), in case where the adhesive layer is formed on the entire surface including the residual portion of the opening portion, preferably, in the step (h), the second conductive material layer, the mask material layer and the adhesive layer are etched under an anisotropic etching condition where an etch rate of the second conductive material layer and an etch rate of the adhesive layer are higher than an etch rate of the mask material layer.

It has been already described that the etch rate of the second conductive material layer and the etch rate of the adhesive layer are not necessarily required to be the same and may differ to some extent in practical production, while it is preferred that, in the step (h), the etch rate $R_1$ of the second conductive material layer for forming the electron emitting portion and the etch rate $R_2$ of the adhesive layer satisfy a relationship of $R_2 \leqq R_1 \leqq 5R_2$. Particularly, when the second conductive material layer for forming the sharpened portion and the adhesive layer are composed of the same electrically conductive material, the above relationship may be $R_2 \approx R_1$.

In the production process according to each of the second-A to second-D aspects of the present invention, it is particularly preferred to form the second conductive material layer by a CVD method excellent in step coverage (step covering capability) for forming the recess in the surface of the second conductive material layer on the basis of the step between the upper end portion and the bottom portion of the opening portion.

In the cold cathode field emission device or the cold cathode field emission display according to the third aspect of the present invention, a second insulating layer may be further formed on the insulating layer and the gate electrode, and a focus electrode may be formed on the second insulating layer.

The support for constituting the cold cathode field emission device according to any one of the aspects of the present invention may be any support so long as its surface has an insulating characteristic. It can be selected from a glass substrate, a glass substrate having a surface formed of an insulating film, a quartz substrate, a quartz substrate having a surface formed of an insulating film or a semiconductor substrate having a surface formed of an insulating film. In the display of the present invention, the substrate may be any substrate so long as its surface has an insulating characteristic. It can be selected from a glass substrate, a glass substrate having a surface formed of an insulating film, a quartz substrate, a quartz substrate having a surface formed of an insulating film or a semiconductor substrate having a surface formed of an insulating film.

The material for constituting the insulating layer can be selected from $SiO_2$, SiN, SiON or a cured product of a glass paste, and these materials may be used alone or as a laminate of a combination thereof as required. The insulating layer can be formed by a known process such as a CVD method, a coating method, a sputtering method or a printing method.

The gate electrode, the cathode electrode and the focus electrode can be formed of a layer of a metal such as tungsten (W), niobium (Nb), tantalum (Ta), titanium (Ti), molybdenum (Mo), chromium (Cr), aluminum (Al), copper (Cu) or silver (Ag), an alloy layer containing any one of these metal elements, a compound containing any one of these metal elements (for example, nitrides such as TiN and silicides such as $WSi_2$, $MoSi_2$, $TiSi_2$ or $TaSi_2$), or a semiconductor layer of diamond. In the present invention, however, the above electrodes may be disposed when the electron emitting portion is formed by etching, and it is required to select a material which can secure etching selectivity to the conductive material layer constituting the electron emitting portion.

BRIEF DESCRIPTION OF THE DRAWINGS

FIG. 3B is a schematic end view showing the step of forming a conductive material layer for forming an electron emitting portion.

FIG. 4B is a schematic end view showing the step of leaving the mask material layer in a recess.

FIGS. 7A, 7B and 7C are schematic end views showing a change in the form of an electron emitting portion depending upon etching selectivity ratios of the conductive material layers to the mask material layers.

FIG. 8B is a schematic end view showing the step of forming a mask material layer.

FIG. 9B is a schematic end view showing the step of forming an electron emitting portion.

FIG. 12B shows the step of etching a wall surface of an opening portion backward, in the process for the production of the field emission device in Example 3.

FIG. 18B is a schematic end view showing the step of forming an opening portion.

FIG. 19B is a schematic end view showing the step of leaving the mask material layer in a recess.

FIG. 22B is a schematic end view showing the step of forming an electron emitting portion.

FIG. 25B is a schematic end view showing the step of forming a second conductive material layer for forming a sharpened portion.

FIG. 26B is a schematic end view showing the step of leaving the mask material layer in a recess.

FIG. 29B is a schematic end view showing the step of forming an electron emitting portion in the process for the production of the field emission device in Example 8.

FIG. 32A is a schematic end view showing the step of forming the base portion.

FIG. 33A is a schematic end view showing the step of leaving a mask material layer in a recess formed in a second conductive material layer for forming a sharpened portion.

FIG. 34A is a schematic end view showing the step of forming a sharpened portion by etching.

FIG. 37A is a schematic end view showing the step of leaving a mask material layer in a recess formed in a second conductive material layer for forming a sharpened portion.

FIG. 38A is a schematic end view showing the step of forming the sharpened portion.

FIG. 41A is a schematic end view showing the step of forming a base portion having a flat upper surface, and FIG. 41B is a schematic view for explaining the direction of crystal boundaries of the base portion, in the process for the production of the field emission device in Example 11.

FIG. 42A is a schematic end view showing the step of leaving a mask material layer in a recess formed in a second conductive material layer for forming a sharpened portion.

FIG. 43A is a schematic end view showing the step of forming a sharpened portion.

FIG. 47B is a schematic end view showing the step of forming an electron emitting portion.

FIG. 52B is a schematic end view showing a state where a conical electron emitting portion is formed along with the growth of a conductive material layer.

DESCRIPTION OF THE PREFERRED EMBODIMENTS

The present invention will be explained on the basis of the examples with reference to drawings.

EXAMPLE 1

Figure 1A:
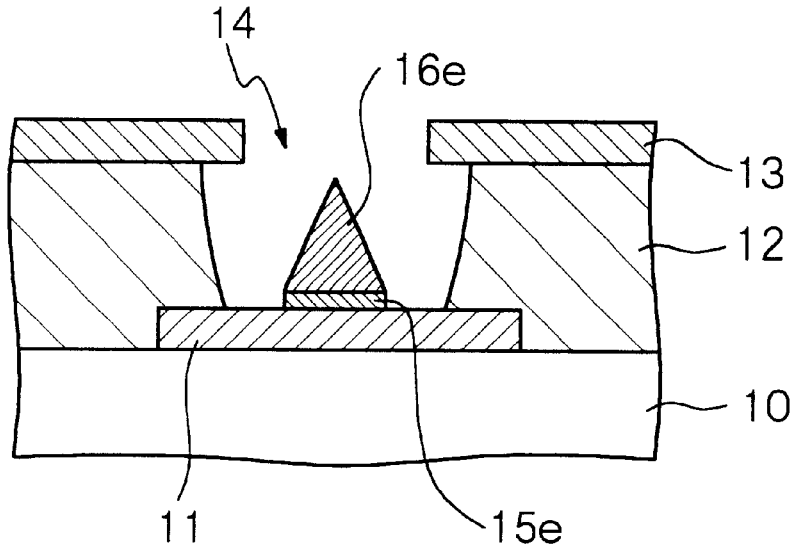
FIG. 1A is a schematic end view of the field emission device in Example 1.
Figure 1B:
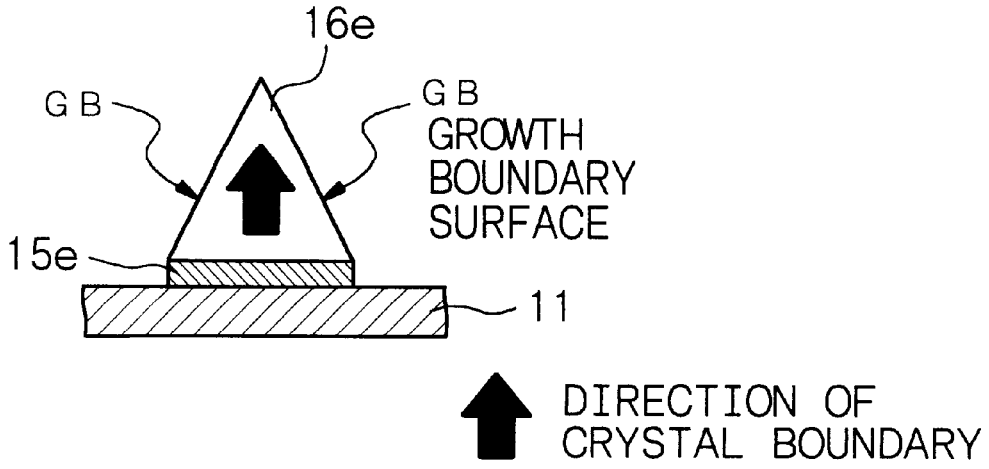
FIG. 1B is a schematic view for explaining the direction of a crystal boundary of an electron emitting portion.
Figure 2:
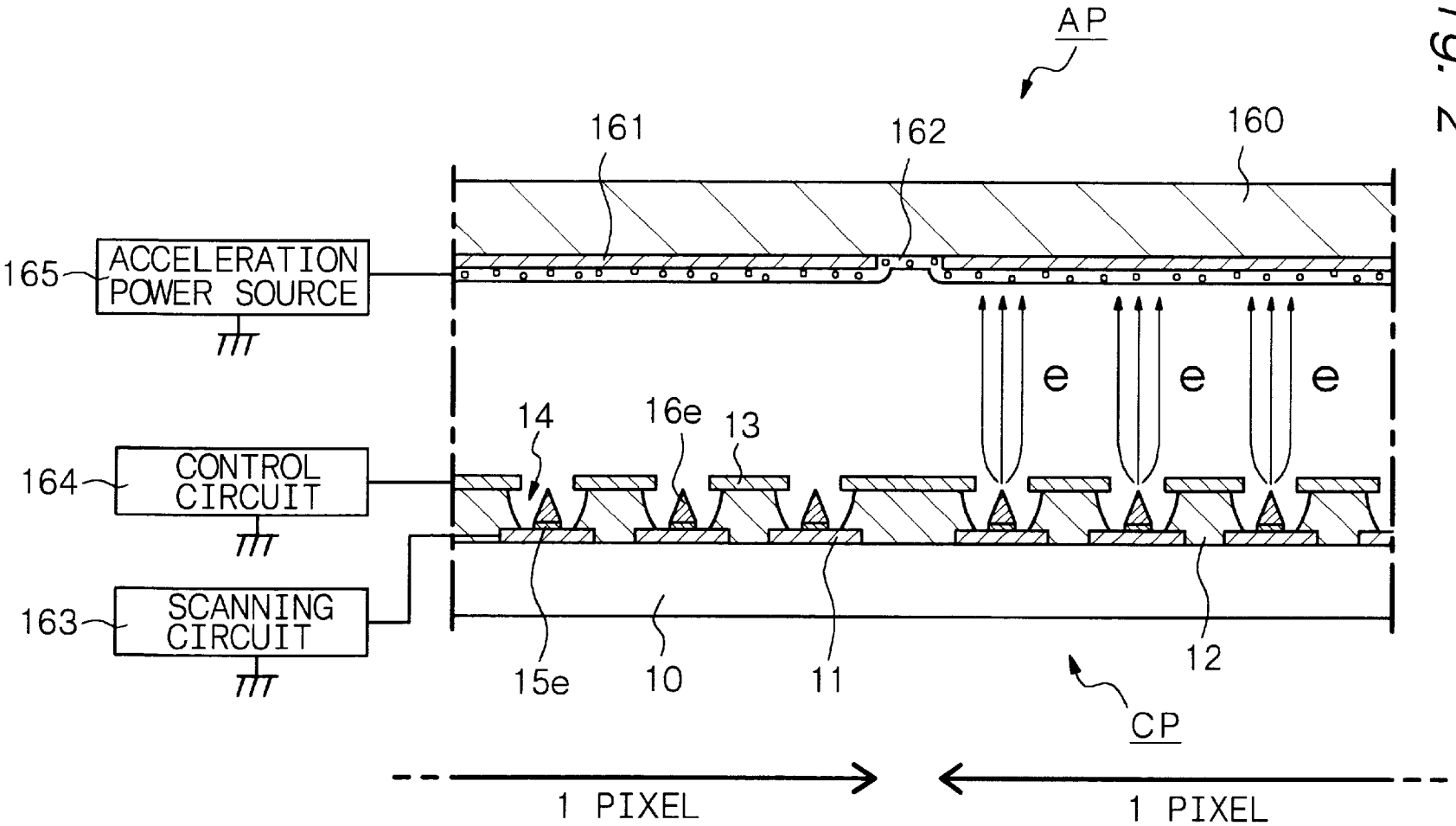
FIG. 2 is a schematic end view of an example of the display of the present invention.
Figure 3A:
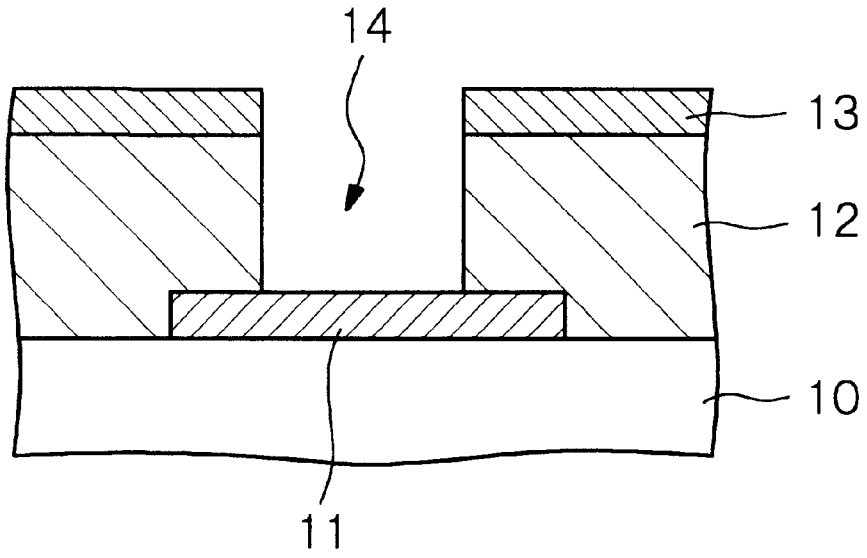
FIG. 3A is schematic end view showing the step of forming an opening portion.
Figure 3B:
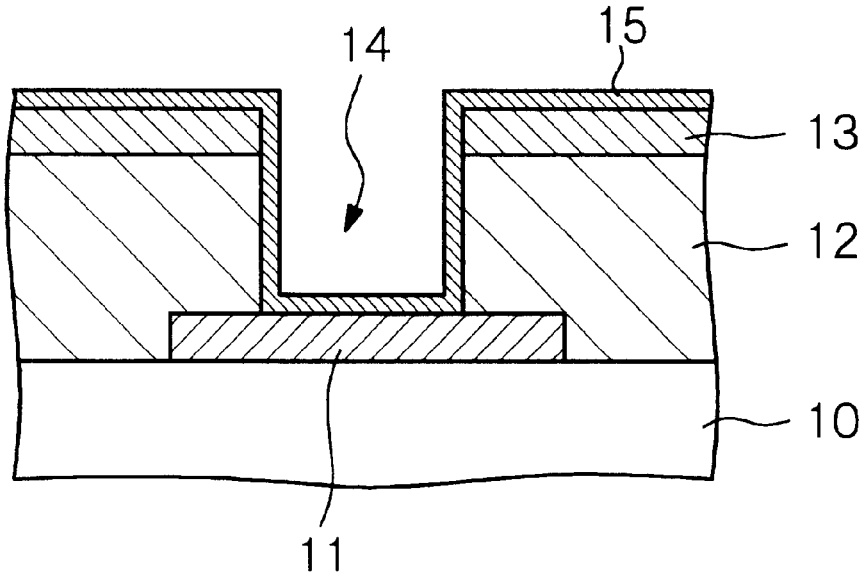
FIG. 3B is a schematic end view showing the step of forming an adhesive layer, in the process for the production of the field emission device in Example 1.

Example 1 is directed to a field emission device according to the first aspect of the present invention, a display having such field emission devices according to the first aspect of the present invention and a process for the production of a field emission device according to the first-A aspect of the present invention. FIG. 1A shows a schematic partial end view of the field emission device of Example 1, and particularly, FIG. 1B schematically shows an electron emitting portion and members in its vicinity. FIG. 2 shows a schematic partial end view of the display, and further, FIGS. 3A, 3B, 4A, 4B, 5A, 5B, 6A, 6B, 7A, 7B and 7C show the process for the production of the field emission device.

The field emission device comprises a support 10 formed, for example, of a glass substrate, a cathode electrode 11 composed of chromium (Cr), an insulating layer 12 composed of $SiO_2$, a gate electrode 13 composed of chromium and a conical electron emitting portion 16*e* formed of a tungsten (W) layer. The above cathode electrode 11 is formed on the support 10. The insulating layer 12 is formed on the support 10 and the cathode electrode 11, and further, the gate electrode 13 is formed on the insulating layer 12. An opening portion 14 penetrates through the gate electrode 13 and the insulating layer 12, and the opening portion formed in the insulating layer 12 has a wall surface present backward from an opening edge of the gate electrode 13. The electron emitting portion 16*e* is formed nearly in the center of a bottom portion of the above opening portion 14 and on the cathode electrode 11. The cathode electrode 11 is exposed on part of the bottom portion of the opening portion 14. The tip portion of the electron emitting portion 16*e*, more specifically, the whole of the electron emitting portion 16*e* has a conical form, specifically, the form of a cone. Further, the electron emitting portion 16*e* is composed of a crystalline conductive material. There is an electrically conductive adhesive layer 15*e* formed between the electron emitting portion 16*e* and the cathode electrode 11, while the adhesive layer 15*e* is not essential for the performance of the field emission device. It is formed for a production-related reason and remains when the electron emitting portion 16*e* is formed by etching.

The display of Example 1 comprises a plurality of pixels as shown in FIG. 2. Each pixel is constituted of a plurality of the above field emission devices and of an anode electrode 162 and a fluorescent layer 161 which face them and are formed on a substrate 160. The anode electrode 162 is composed of aluminum and formed such that it covers the fluorescence layer 161 formed on the substrate 160 of glass. The fluorescence layer 161 has a predetermined pattern. The order of the above lamination of the fluorescence layer 161 and the anode electrode 162 may be reversed. In this case, the anode electrode 162 comes to be located in front of the fluorescence layer 161 when viewed from a viewing surface side of the display, and it is therefore required to constitute the anode electrode 162 from a transparent electrically conductive material such as ITO (indium-tin oxide).

In the constitution of the actual display, the field emission device is a component for a cathode panel CP, and the anode electrode 162 and the fluorescence layer 161 are components for an anode panel AP. The cathode panel CP and the anode panel AP are jointed to each other through a frame (not shown), and a space surrounded by these two panels and the frame is evacuated to have a high vacuum. Relatively negative voltage is applied to the electron emitting portion 16*e* from a scanning circuit 163 through the cathode electrode 11, relatively positive voltage is applied to the gate electrode 13 from a control circuit 164, and positive voltage higher than the voltage to the gate electrode 13 is applied to the anode electrode 162 from an acceleration power source 165. When displaying is performed in the display, video signals are inputted to the control circuit 164, and scanning signals are inputted to the scanning circuit 163. When voltages are applied to the cathode electrode 11 and the gate electrode 13, an electric field is generated, and due to the electric field, electrons "ee" are extracted from the tip portion of the electron emitting portion 16*e*. These electrons "e" are attracted to the anode electrode 162 and collide with the fluorescence layer 161, and in this case, the fluorescence layer 162 emits light to give a desired image.

Meanwhile, the tip portion of the electron emitting portion 16*e* formed of a tungsten layer and, further, the whole of the electron emitting portion 16*e* have a conical form, and the direction of a crystal boundary of the tungsten layer is nearly perpendicular to the cathode electrode 11 as shown by an arrow mark in FIG. 1B. The above direction is an ideal electron emission direction, that is, nearly in agreement with the direction perpendicular to the anode electrode 162 when the field emission device is incorporated in the display. For this reason, even when electrons are repeatedly emitted under a high electric field, the crystal structure of the electron emitting portion 16*e* is not easily destroyed, and a longer lifetime of the field emission device and a consequent longer lifetime of the display are materialized.

The surface of the electron emitting portion 16*e* is formed ideally of a growth boundary surface GB. The growth boundary surface GB is inevitably formed when the conductive material layer for forming the electron emitting portion is grown in the opening portion 14. That is, the growth boundary surface GB is a site where growth front planes of the conductive material layer which grows from the bottom surface and wall surface of the opening portion 14 in directions nearly perpendicular thereto collide with each other, and directions of the crystal boundaries differ from each other in those regions of the conductive material layer which are adjacent to each other across the growth boundary surface GB. That the surface of the electron emitting portion 16*e* coincide with the growth boundary surface GB means that the crystal boundary has nearly a single orientation inside the electron emitting portion 16*e* and can be said to be ideal.

The process for the production of the field emission device of Example 1 will be explained with reference to FIGS. 3A, 3B, 4A, 4B, 5A, 5B, 6A, 6B, 7A, 7B and 7C.

[Step-100]

First, for example, the cathode electrode 11 of chromium (Cr) is formed on the support 10 obtained by forming an approximately 0.6 $\mu$m thick $SiO_2$ layer on a glass substrate. Specifically, a plurality of the stripe-shaped cathode electrodes 11 extending in parallel with the direction of rows are formed by depositing a chromium layer on the support 10, for example, by a sputtering method or a CVD method and patterning the chromium layer. The cathode electrode 11 is formed to have a width, for example, of 50 $\mu$m, and the cathode electrodes are formed to have a space, for example, of 30 $\mu$m therebetween. Then, the insulating layer 12 of $SiO_2$ is formed on the support 10 and the cathode electrode 11 by a plasma-enhanced CVD method. The following Table 1 shows a CVD condition as one example when TEOS (tetraethoxysilane) is used as a source gas. The insulating layer 12 is formed to have a thickness of approximately 1 $\mu$m. An electrically conductive layer of chromium is formed on the entire surface on the insulating layer 12 by a sputtering method, and the conductive layer is patterned to form a plurality of the stripe-shaped gate electrodes 13 extending in the direction of columns, i.e., in the direction extending in parallel with the direction at right angles with the cathode electrode 11. The following Table 2 shows a sputtering condition as one example. Further, the following Table 3 shows an etching condition of patterning the conductive layer as one example.

TABLE 1

| | |
|---|---|
| TEOS flow rate | 800 SCCM |
| $O_2$ flow rate | 600 SCCM |
| Pressure | 1.1 k Pa |
| RF power | 0.7 kw (13.56 MHz) |
| Layer formation temperature | 40° C. |

TABLE 2

| | |
|---|---|
| Ar flow rate | 100 SCCM |
| Pressure | 5 Pa |
| DC power | 2 kW |
| Sputtering temperature | 200° C. |

TABLE 3

| | |
|---|---|
| $Cl_2$ flow rate | 100 SCCM |
| $O_2$ flow rate | 100 SCCM |
| Pressure | 0.7 Pa |
| RF power | 0.8 kW (13.56 MHz) |
| Etching temperature | 60° C. |

Then, in a region where the cathode electrode 11 and the gate electrode 13 overlap, i.e., in one pixel region, an opening portion 14 is formed so as to penetrate through the gate electrode 13 and the insulating layer 12. The opening portion 14 has a circular form having a diameter of 0.3 $\mu$m when viewed as a plan view. Generally, 500 to 5000 opening portions 14 are formed per pixel. When the opening portion 14 is formed, an opening portion is formed in the gate electrode 13 first by an RIE (reactive ion etching) method using a chlorine-containing etching gas with using a resist layer formed by conventional photolithography as a mask, and then, an opening portion is formed in the insulating layer 12 by an RIE method using a fluorocarbon-containing etching gas. The opening portion 14 can be formed in the gate electrode 13 under the RIE condition as shown in Table 3. The following Table 4 shows an RIE condition as one example when the opening portion 14 is formed in the insulating layer 12. The resist layer after completion of the RIE is removed by ashing. The following Table 5 shows an ashing condition as one example. In this manner, a structure shown in FIG. 3A can be obtained.

TABLE 4

| Etching apparatus | Parallel plate type RIE apparatus |
|---|---|
| $C_4F_8$ flow rate | 30 SCCM |
| CO flow rate | 70 SCCM |
| Ar flow rate | 300 SCCM |
| Pressure | 7.3 Pa |
| RF power | 1.3 kW (13.56 MHz) |
| Etching temperature | 20° C. |

TABLE 5

| | |
|---|---|
| $O_2$ flow rate | 1200 SCCM |
| Pressure | 75 Pa |
| RF power | 1.3 kw (13.56 MHz) |
| Ashing temperature | 300° C. |

[Step-110]

Then, preferably, an electrically conductive adhesive layer 15 is formed on the entire surface by a sputtering method. The adhesive layer 15 works to improve the adhesiveness between the insulating layer 12 exposed in a gate-electrode-non-formation portion and on a wall surface of the opening portion 14 and a conductive material layer 16 to be formed on the entire surface to a step to follow. Example 1 uses tungsten for forming the conductive material layer 16, and titanium nitride (TiN) having excellent adhesiveness to tungsten is used to form the adhesive layer 15 having a thickness of 0.07 $\mu$m by a sputtering method. The following Table 6 shows a sputtering condition as one example.

TABLE 6

| | |
|---|---|
| Ar flow rate | 30 SCCM |
| $N_2$ flow rate | 60 SCCM |
| Pressure | 0.67 Pa |
| DC power | 3 kW |
| Sputtering temperature | 200° C. |

[Step-120]

Figure 4A:
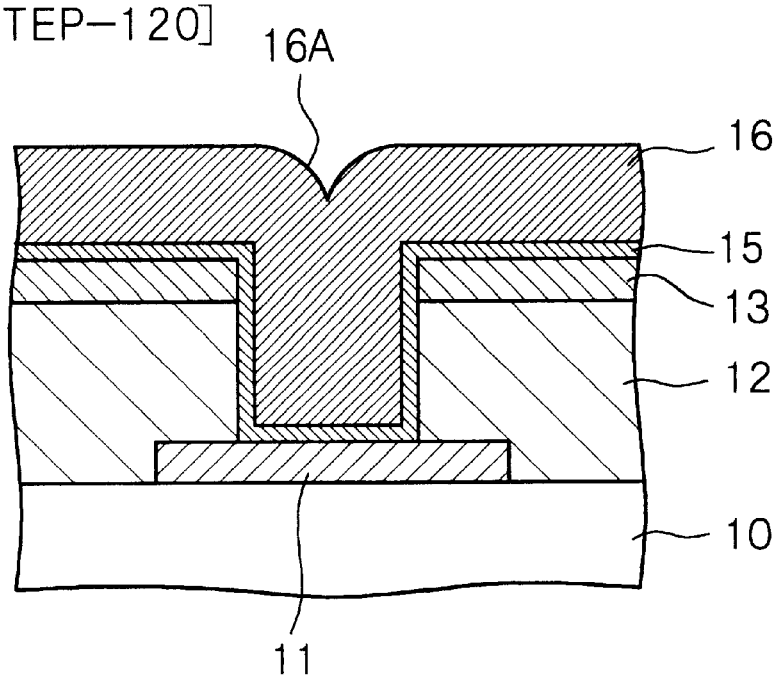
FIG. 4A following

A conductive material layer 16 for forming the electron emitting portion is formed on the entire surface including the inside of the opening portion 14 as shown in FIG. 4A. In Example 1, a tungsten layer having a thickness of approximately 0.6 $\mu$m as the conductive material layer 16 is formed by a hydrogen reduction low pressure CVD method. The following Table 7 shows a condition of forming the tungsten layer as one example. In the surface of the formed conductive material layer 16, a recess 16A is formed on the basis of a step between the upper end portion and the bottom portion of the opening portion 14.

TABLE 7

| | |
|---|---|
| $WF_6$ flow rate | 95 SCCM |
| $H_2$ flow rate | 700 SCCM |
| Pressure | $1.2 \times 10^4$ Pa |
| Layer formation temperature | 430° C. |

[Step-130]

Figure 4B:
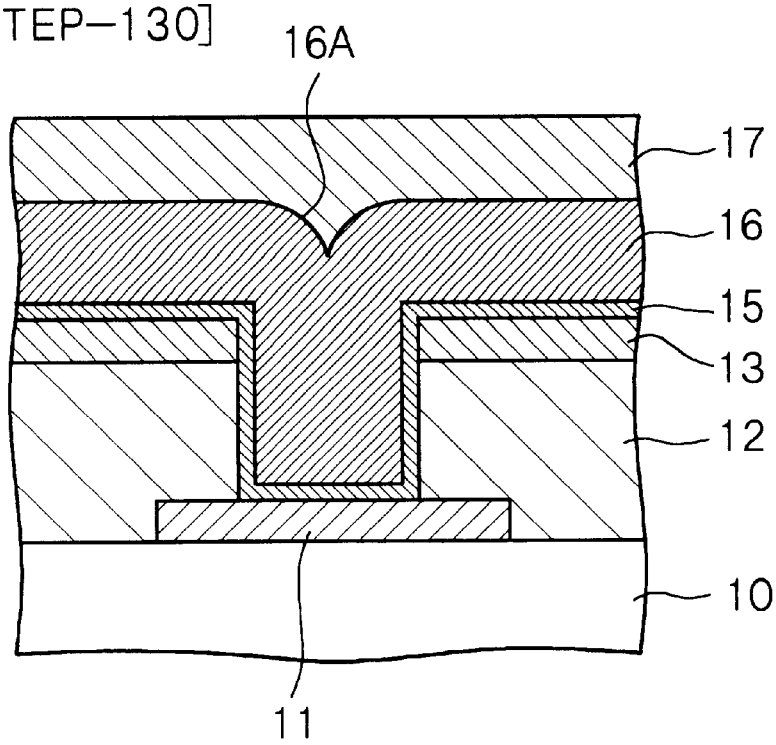
FIG. 4B is a schematic end view showing the step of forming a mask material layer, in the process for the production of the field emission device in Example 1.
Figure 5A:
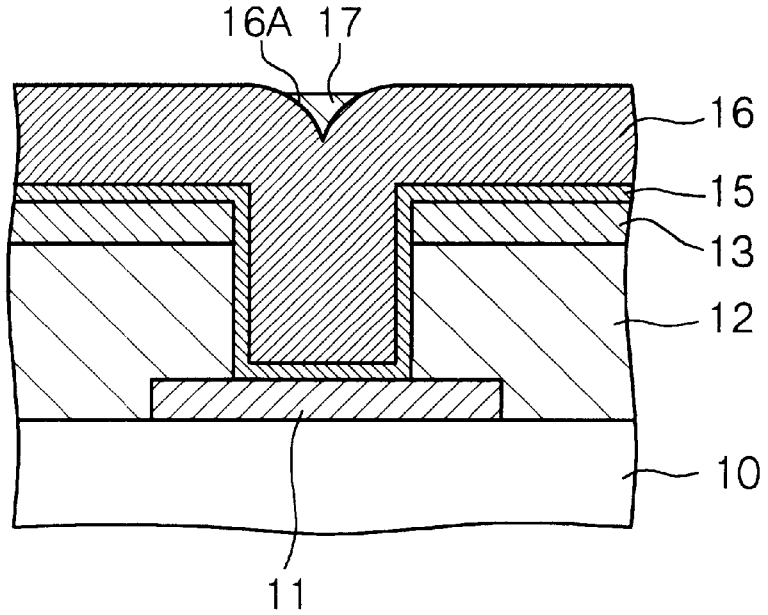
FIG. 5A following

Then, a mask material layer 17 is formed so as to mask (cover) a region of the conductive material layer 16 (specifically, the recess 16A) positioned in the central portion of the opening portion 14. That is, as shown in FIG. 4B, the mask material layer 17 is formed on the conductive material layer 17. The mask material layer 17 absorbs the recess 16A formed in the conductive material layer 16 to form a nearly flat surface. In this Example, a resist layer having a thickness of 0.35 $\mu$m is formed by a spin coating method and used as the mask material layer 17. Then, the mask material layer 17 is etched by an RIE method using an oxygen-containing gas as shown in FIG. 5A. The following Table 8 shows an RIE condition as one example. The etching is finished at a point of time when a flat plane of the conductive material layer 16 is exposed. In this manner, the mask material layer 17 remains so as to be filled in the recess 16A formed in the conductive material layer 16 and to form a nearly flat surface.

TABLE 8

| | |
|---|---|
| $O_2$ flow rate | 100 SCCM |
| Pressure | 5.3 Pa |

TABLE 8-continued

| | |
|---|---|
| RF Pressure | 0.7 kW (13.56 MHz) |
| Etching temperature | 20° C. |

[Step-140]

Figure 5B:
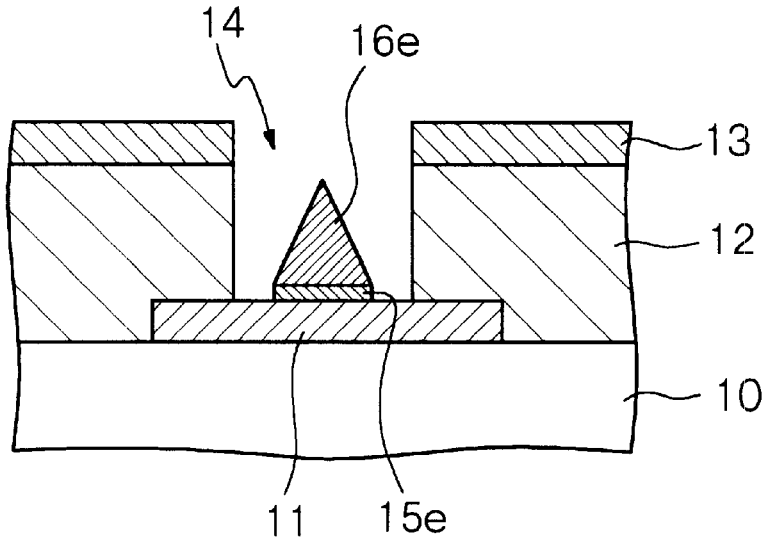
FIG. 5B is a schematic end view showing the step of forming the electron emitting portion, in the process for the production of the field emission device in Example 1.

Then, as shown in FIG. 5B, the electron emitting portion 16*e* having a conical form is formed by etching the conductive material layer 16, the mask material layer 17 and the adhesive layer 15. The etching of these layers is carried out under an anisotropic etching condition where the etch rate of the conductive material layer 16 is higher than the etch rate of the mask material layer 17. The following Table 9 shows an etching condition used above as one example.

TABLE 9

| | |
|---|---|
| $SF_6$ flow rate | 150 SCCM |
| $O_2$ flow rate | 30 SCCM |
| Ar flow rate | 90 SCCM |
| Pressure | 35 Pa |
| RF power | 0.7 kW (13.56 MHz) |

[Step-150]

Then, the wall surface of the opening portion 14 formed in the insulating layer 12 is etched backward under an isotropic etching condition, whereby the field emission device shown in FIG. 1A is completed. The isotropic etching can be carried out by dry etching using radical as main etching species such as chemical dry etching or by wet etching using an etching solution. As an etching solution, there may be used, for example, a mixture of a 49% hydrofluoric acid aqueous solution with pure water in a 49% hydrofluoric acid aqueous solution/pure water mixing ratio of 1/100 (volume ratio). Then, a cathode panel CP having a number of such field emission devices formed therein is combined with an anode panel AP to produce a display. Specifically, an approximately 1 mm high frame composed of ceramic or glass is provided, a seal material composed of frit glass is applied between the frame and the anode panel AP and between the frame and the cathode panel CP, the seal material is dried, and then the seal material is sintered at approximately 450° C. for 10 to 30 minutes. Then, the display is internally evacuated to a vacuum degree of approximately $10^{-4}$ Pa, and the display is sealed by a proper method.

Figure 6A:
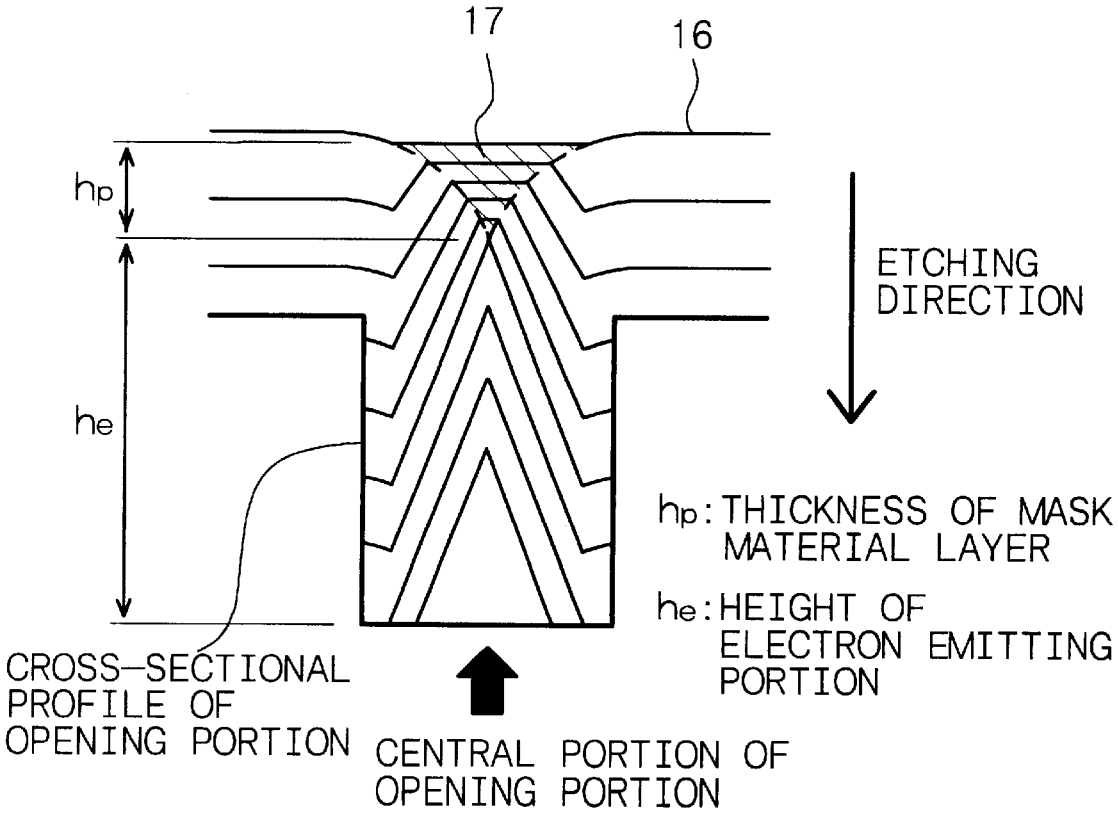
FIG. 6A is a conceptual view showing a change of the surface profile of a layer being etched with the passage of etching, for explaining the mechanism of forming an electron emitting portion.
Figure 6B:
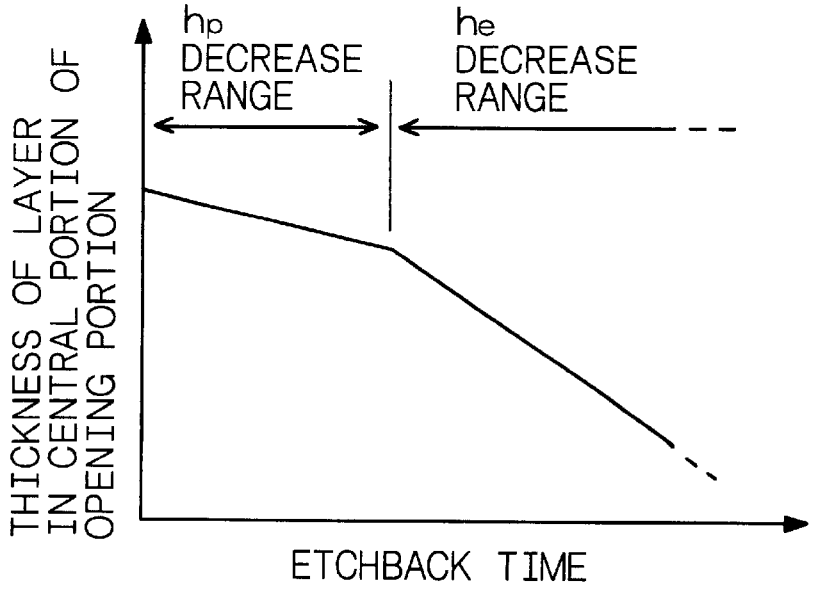
FIG. 6B is a graph showing a relationship between an etching time period and a thickness of the layer being etched in the center of an opening portion.

The mechanism of formation of the electron emitting portion 16*e* in [Step-140] will be explained below with reference to FIGS. 6A and 6B. FIG. 6A schematically shows how the surface profile of a layer which is being etched changes at intervals of a predetermined time length as the etching proceeds. FIG. 6B is a graph showing a relationship between an etching time length and a thickness of the layer, which is being etched, in the central portion of the opening portion. The thickness of the mask material layer in the central portion of the opening portion is taken as $h_p$, and the height of the electron emitting portion in the central portion of the opening portion is taken as $h_e$.

Under the etching condition shown in Table 9, the etch rate of the conductive material layer 16 is naturally higher than the etch rate of the mask material layer 17. In a region where the mask material layer 17 is absent, the conductive material layer 16 readily begins to be etched, and the surface of the layer being etched levels down readily. In contrast, in a region where the mask material layer 17 is present, the conductive material layer 16 begins to be etched only after the mask material layer 17 is removed first. While the mask material layer 17 is being etched, therefore, the decrease rate of thickness of the layer being etched is low ($h_p$ decrease range), and only after the mask material layer 17 disappeared, the decrease rate of thickness of the layer being etched comes to be as high as the decrease rate in the region where the mask material layer 17 is absent ($h_e$ decrease range). The time of initiation of the $h_p$ decrease range is the most deferred in the central portion of the opening portion where the mask material layer 17 has a maximum thickness, and it is expedited toward the circumference of the opening portion where the mask material layer 17 has a small thickness. In this manner, the electron emitting portion 16*e* having a conical form is formed.

The ratio of the etch rate of the conductive material layer 16 to the etch rate of the mask material layer 17 composed of a resist material will be referred to as "resist selectivity ratio". It will be explained with reference to FIGS. 7A, 7B and 7C that the above resist selectivity ratio is an essential factor for determining the height and form of the electron emitting portion 16*e*. FIG. 7A shows the form of the electron emitting portion 16*e* when the resist selectivity ratio is relatively small, FIG. 7C shows the form of the electron emitting portion 16*e* when the resist selectivity ratio is relatively large, and FIG. 7B shows the form of the electron emitting portion 16*e* when the resist selectivity ratio is intermediate. It is seen that with an increase in the resist selectivity ratio, the loss of the conductive material layer 16 increases as compared with a loss of the mask material layer 17, so that the electron emitting portion 16*e* has a larger height and is more sharpened. The resist selectivity ratio decreases as the ratio of the $O_2$ flow rate to the $SF_6$ flow rate increases. When there is used an etching apparatus which can change incidence energy of ions by the co-use of a substrate bias, the resist selectivity ratio can be decreased by increasing an RF bias power or decreasing the frequency of an AC power source used for applying a bias.

The resist selectivity ratio is set at a value of at least 1.5, preferably at least 2, more preferably at least 3. When that region of the conductive material layer 16 where the direction of a crystal boundary is aligned in a nearly perpendicular direction is used as an electron emitting portion 16*e* as shown in FIG. 1B, it is required to estimate a gradient of the growth boundary surface GB on the basis of the formation rate of the conductive material layer 16 and the dimensions of the opening portion 14 and set the resist selectivity ratio for obtaining the above gradient.

In the above etching, naturally, it is required to secure a high etching selectivity ratio with regard to the gate electrode 13 and the cathode electrode 11, while the condition shown in Table 9 is adequate for the above requirement. That is because chromium constituting the gate electrode 13 and the cathode electrode 11 is scarcely etched with fluorine-containing etching species, so that an etching selectivity ratio of approximately at least 10 for chromium can be obtained under the above condition.

EXAMPLE 2

Example 2 is directed to the process for the production of a field emission device according to the first-B aspect of the present invention. FIGS. 8A, 8B, 9A, 9B, 10A, 10B, 11A and 11B show the production process of Example 2. Those portions which are the same as those in FIGS. 1A and 1B are shown by the same reference numerals, and detailed explanations thereof are omitted.

[Step-200]

First, the cathode electrode 11 is formed on the support 10. The cathode electrode 11 is formed by subsequently forming a TiN layer (thickness 0.1 μm), a Ti layer (thickness 5 nm), an Al—Cu layer (thickness 0.4 μm), a Ti layer (thickness 5 nm), a TiN layer (thickness 0.02 μm and a Ti layer (thickness 0.02 μm) in this order by a DC sputtering method, for example, according to a sputtering condition shown in the following Table 10 to form laminated layers and patterning the laminated layers. In the drawings, the cathode electrode 11 is shown as a single layer. Then, the insulating layer 12 is formed on the support 10 and the cathode electrode 11. The insulating layer 12 is formed by a plasma-enhanced CVD method using TEOS (tetraethoxysilane) as a source gas so as to have a thickness of 0.7 μm. Then, the gate electrode 13 is formed on the insulating layer 12. The gate electrode 13 is formed by patterning a 0.1 μm thick TiN layer formed by a sputtering method. The TiN layer can be patterned by an RIE method. The following Table 11 shows an RIE condition for the above as one example.

TABLE 10

| | |
|---|---|
| Ar flow rate | 39 SCCM |
| $N_2$ flow rate | 60 SCCM (only during formation of TiN layer) |
| Pressure | 0.67 Pa |
| DC power | 3 kW |
| Sputtering temperature | 200° C. |

TABLE 11

| Etching apparatus | Parallel plate type RIE apparatus |
|---|---|
| $BCl_3$ flow rate | 30 SCCM |
| $Cl_2$ flow rate | 70 SCCM |
| Pressure | 7 Pa |
| RF power | 1.3 kW (13.56 MHz) |
| Etching temperature | 60° C. |

Figure 8A:
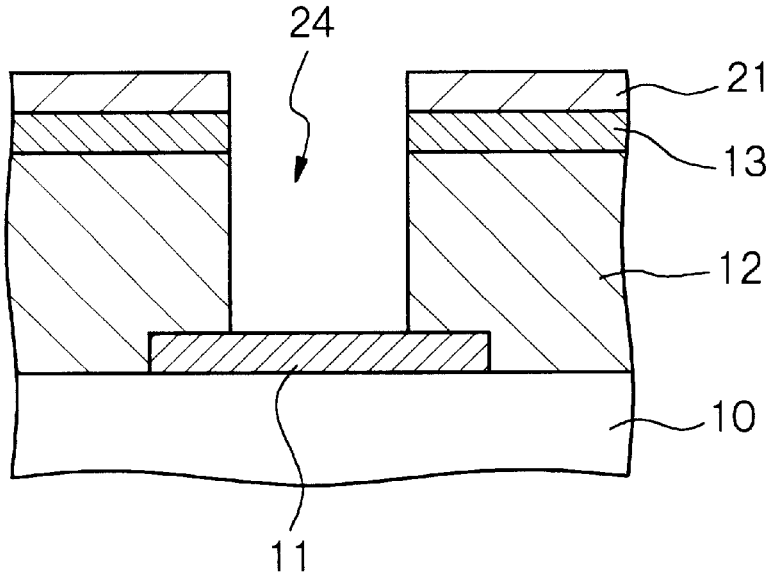
FIG. 8A is a schematic end view showing the step of forming an opening portion.

A 0.2 μm thick etching stop layer 21 of $SiO_2$ is formed on the entire surface. The etching stop layer 21 is not any functionally essential member of the field emission device, but it works to protect the gate electrode 13 during the etching of a conductive material layer 26 in a post step. The condition of formation of the etching stop layer 21 is as shown in Table 1. When the gate electrode 13 has high etching durability against the etching condition of the conductive material layer 26, the etching stop layer 21 may be omitted. Then, the opening portion 24 is formed by an RIE method, which opening portion penetrates through the etching stop layer 21, the gate electrode 13 and the insulating layer 12 and has a bottom portion where the cathode electrode 11 is exposed. The RIE condition of the etching stop layer 21 and the insulating layer 12 is as shown in Table 4. The following Table 12 shows an RIE condition of the gate electrode 13 as one example. In this manner, a state shown in FIG. 8A is obtained.

TABLE 12

| | |
|---|---|
| $Cl_2$ flow rate | 30 SCCM |
| Ar flow rate | 300 SCCM |
| Pressure | 5.3 Pa |
| RF power | 0.7 kW (13.56 MHz) |
| Etching temperature | 20° C. |

[Step-210]

Figure 8B:
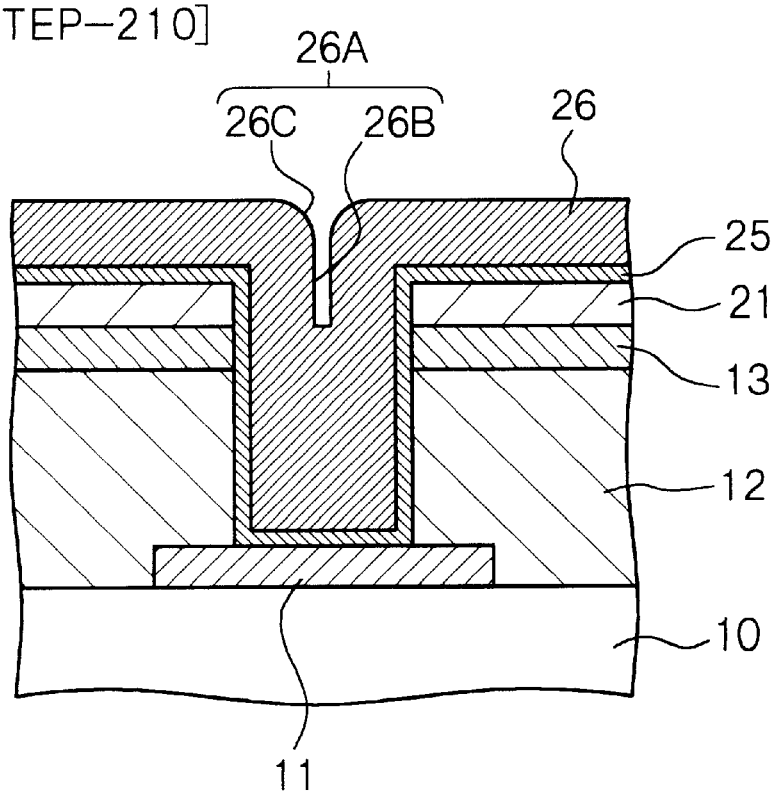
FIG. 8B is a schematic end view showing the step of forming an adhesive layer and a conductive material layer, in the process for the production of the field emission device in Example 2.

Then, as shown in FIG. 8B, an electrically conductive adhesive layer 25 is formed on the entire surface including the inside of the opening portion 24. As the above adhesive layer 25, for example, a titanium nitride (TiN) layer having a thickness of 0.03 μm is formed. Then, a conductive material layer 26 for forming an electron emitting portion is formed on the entire surface including the inside of the opening portion 24. In Example 2, the thickness of the conductive material layer 26 is selected so as to form a deeper recess 26A in its surface than the recess 16A described in Example 1. In this case, by forming the conductive material layer 26 having a thickness of 0.25 μm, a nearly funnel-like recess 26A having a columnar portion 26B and a widened portion 26C communicating with an upper end of the columnar portion 26B is formed in the surface of the conductive material layer 26, on the basis of a step between the upper end portion and the bottom portion of the opening portion 24.

[Step-220]

Figure 9A:
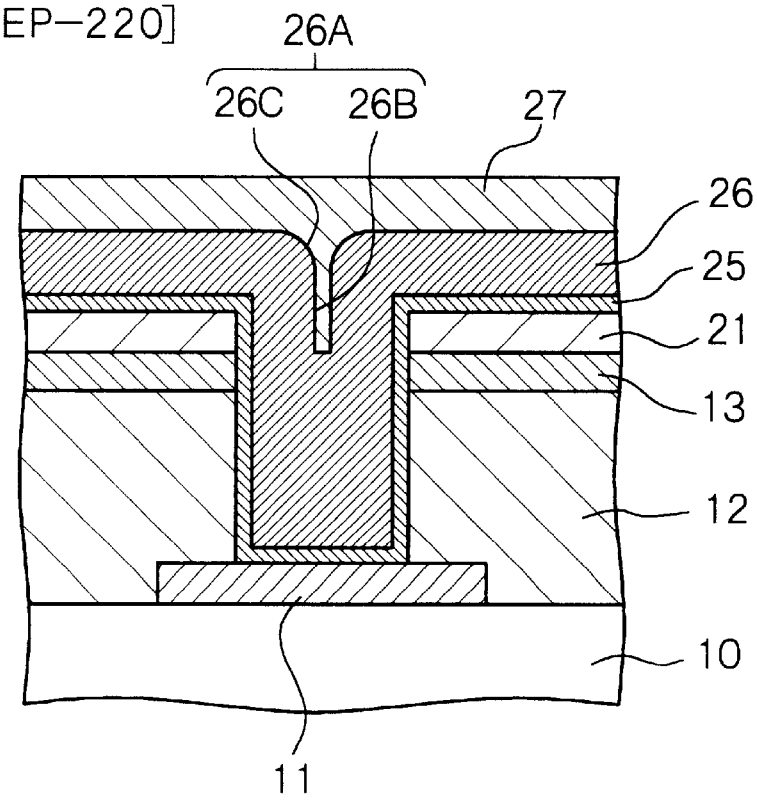
FIG. 9A following

Then, as shown in FIG. 9A, a mask material layer 27 is formed on the entire surface of the conductive material layer 26. In this case, for example, a copper (Cu) layer having a thickness of approximately 0.5 μm is formed by an electroless plating method. The following Table 13 shows an electroless plating condition as one example.

TABLE 13

| Plating solution: | |
|---|---|
| Copper sulfate ($CuSO_4.5H_2O$) | 7 g/liter |
| Formalin (37% HCHO) | 20 ml/liter |
| Sodium hydroxide (NaOH) | 10 g/liter |
| Potassium sodium tartarate | 20 g/liter |
| Plating bath temperature | 50° C. |

[Step-230]

Figure 9B:
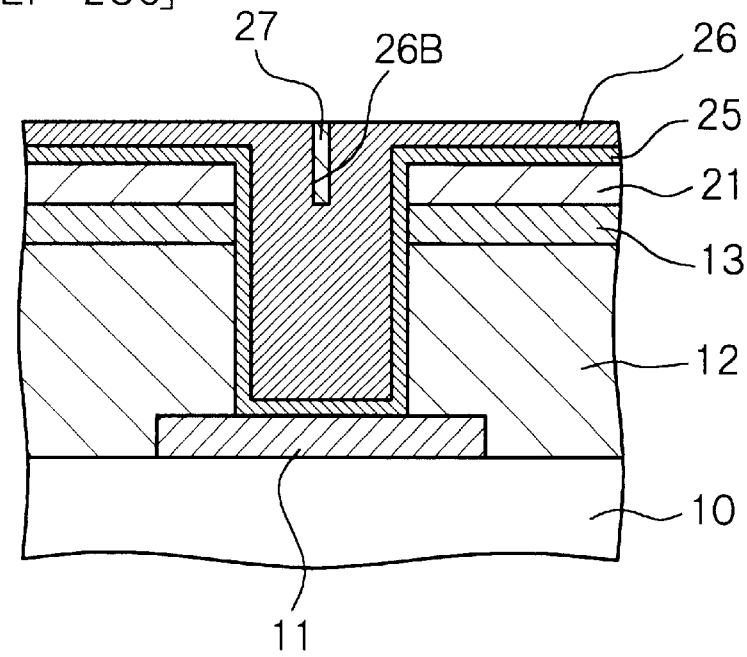
FIG. 9B is a schematic end view showing the step of leaving the mask material layer in a columnar portion, in the process for the production of the field emission device in Example 2.

Then, as shown in FIG. 9B, the mask material layer 27 and the conductive material layer 26 are removed in a plane which is in parallel with the surface of the support 10, to leave the mask material layer 27 in the columnar portion 26B. The above removal can be carried out by a chemical/mechanical polishing (CMP) method, for example, according to a condition shown in the following Table 14 as one example. In the following condition, a term "wafer" is conventionally used, and in the present invention, a member corresponding to the wafer is the support 10.

TABLE 14

| | |
|---|---|
| Wafer pressing pressure | $3.4 \times 10^4$ Pa (= 5 psi) |
| Delta pressure | 0 Pa |
| Number of turn of table | 280 rpm |
| Number of turn of wafer holding bed | 16 rpm |
| Slurry flow rate | 150 ml/minute |

[Step-240]

Figure 10A:
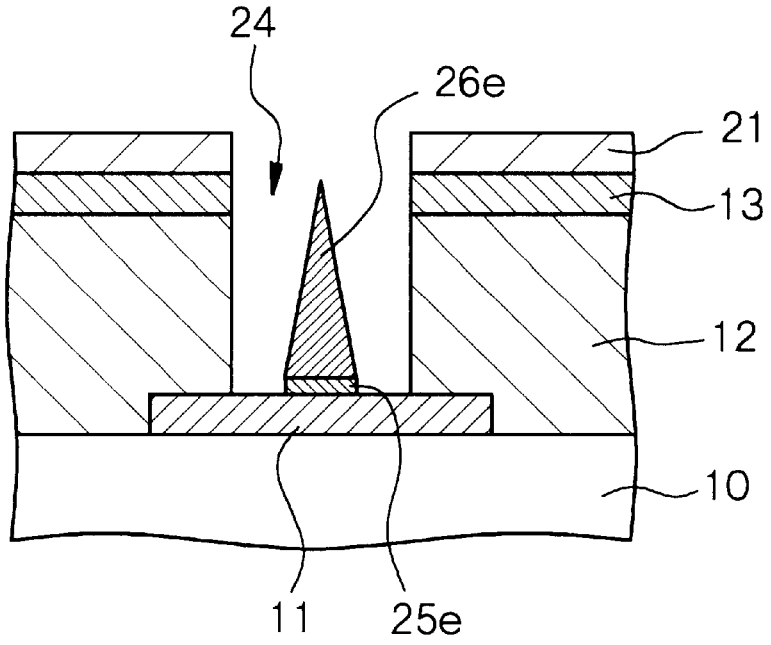
FIG. 10A following

Then, the conductive material layer 26, the mask material layer 27 and the adhesive layer 25 are etched under an anisotropic etching condition where the etch rates of the conductive material layer 26 and the adhesive layer 25 are higher than the etch rate of the mask material layer 27. The following Table 15 shows a condition of the above etching as one example. As a result, an electron emitting portion 26*e* having a conical form is formed in the opening portion 24 as shown in FIG. 10A. When mask material layer 27 remains on the tip portion of the electron emitting portion 26*e*, the mask material layer 27 can be removed by wet etching using diluted hydrofluoric acid.

TABLE 15

| Etching apparatus | Magnetic field possessing microwave plasma etching apparatus |
|---|---|
| $SF_6$ flow rate | 100 SCCM |
| $Cl_2$ flow rate | 100 SCCM |
| Ar flow rate | 300 SCCM |
| Pressure | 3 Pa |
| Microwave power | 1.1 kW (2.45 GHz) |
| RF bias power | 40 W (13.56 MHz) |
| Upper-stage coil current | 13 A |
| Middle-stage coil current | 17 A |
| Lower-stage coil current | 5.5 A |
| Etching temperature | −40° C. |

[Step-250]

Figure 10B:
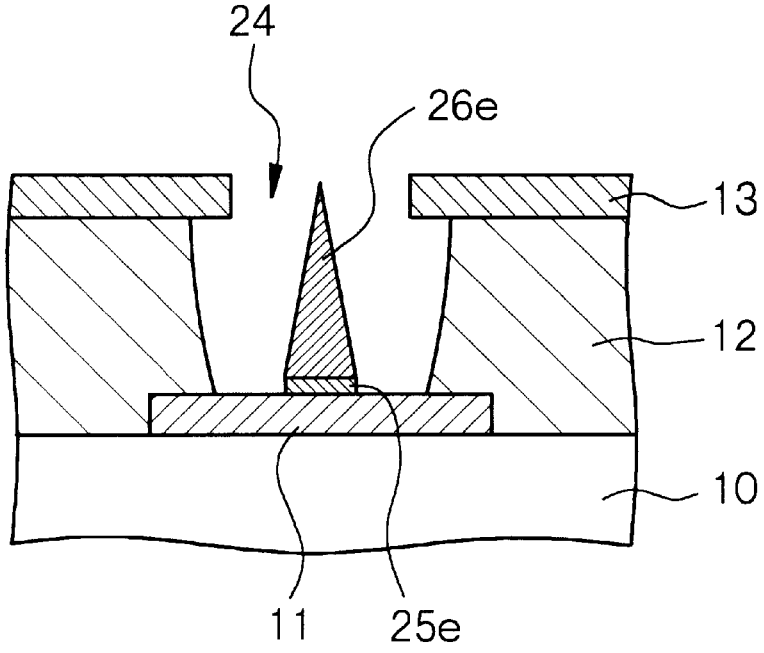
FIG. 10B is a schematic end view showing the step of etching a wall surface of an opening portion backward, in the process for the production of the field emission device in Example 2.

Then, the wall surface of the opening portion 24 formed in the insulating layer 12 is etched backward under an isotropic etching condition, to complete a field emission device shown in FIG. 10B. The isotropic etching is as described in Example 1. When such field emission devices are used, a display can be constituted in the same manner as in Example 1.

Figure 11A:
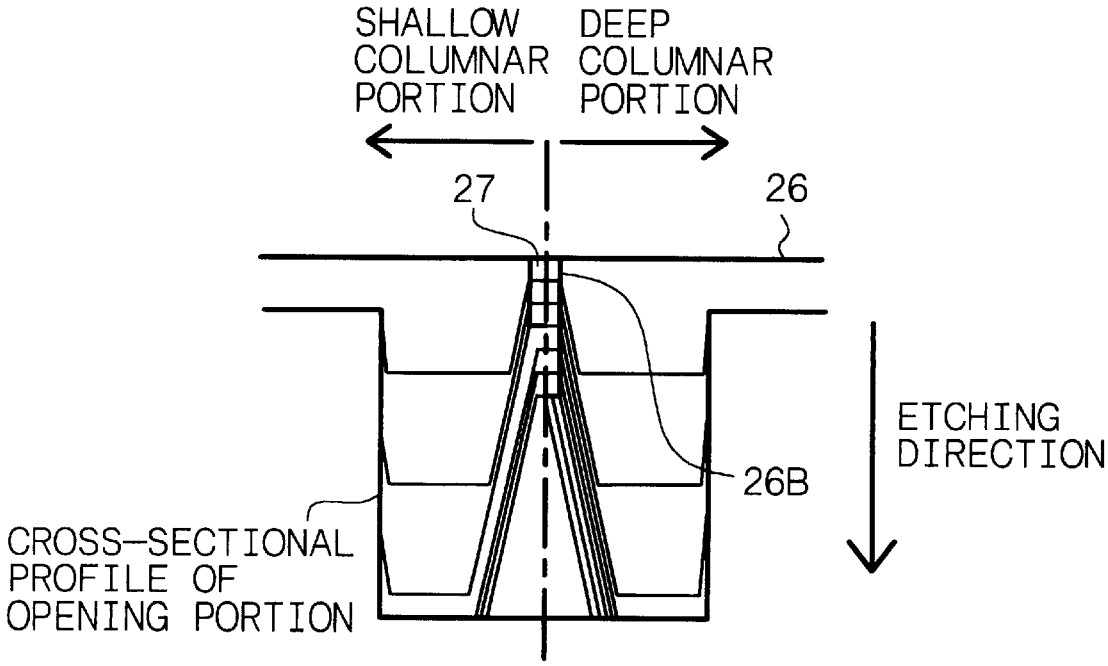
FIG. 11A is a schematic view for explaining a change in the form of the electron emitting portion when the mask material layer is left in the columnar portion.
Figure 11B:
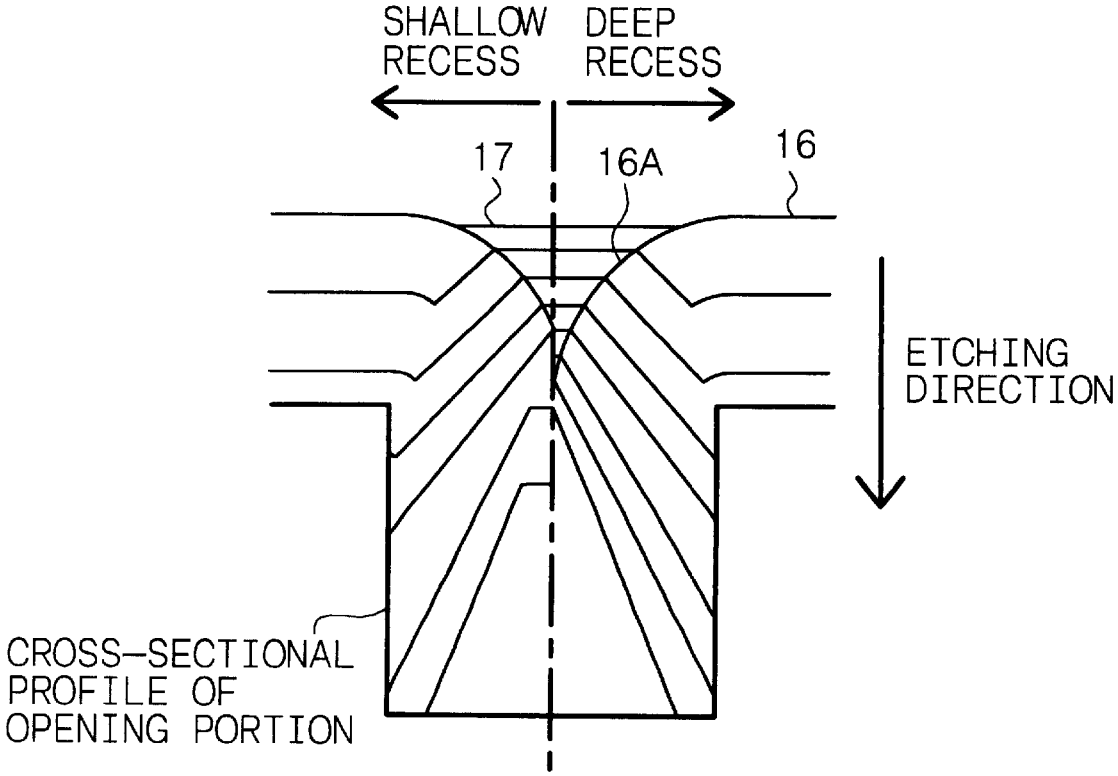
FIG. 11B is a schematic view for explaining a change in the form of the electron emitting portion when the mask material layer is left in the recess.

Meanwhile, the electron emitting portion 26*e* formed in Example 2 has a more sharpened conical form than the electron emitting portion 16*e* formed in Example 1. This is caused by the form (shape) of the mask material layer and a difference in the ratio of the etch rate of the conductive material layer 26 to the etch rate of the mask material layer 27. The above difference will be explained with reference to FIGS. 11A and 11B. FIGS. 11A and 11B show how the surface profile of a layer being etched changes at intervals of a predetermined time length. FIG. 11A shows a case where the mask material layer 27 composed of copper is used, and FIG. 11B shows a case where the mask material layer 17 composed of a resist material is used. For simplification, it is assumed that the etch rate of the conductive material layer 26 and the etch rate of the adhesive layer 25 are the same and that the etch rate of the conductive material layer 16 and the etch rate of the adhesive layer 15 are the same. FIGS. 11A and FIG. 11B omit showing of the adhesive layers 25 and 15.

When the mask material layer 27 composed of copper is used (see FIG. 11A), the etch rate of the mask material layer 27 is sufficiently low as compared with the etch rate of the conductive material layer 26, and the mask material layer 27 therefore cannot disappear during the etching, so that the electron emitting portion 26*e* having a sharpened tip portion can be formed. In contrast, when the mask material layer 17 composed of a resist material is used (see FIG. 11B), the etch rate of the mask material layer 17 is not sufficiently low as compared with the etch rate of the conductive material layer 16, and the mask material layer 17 easily disappears during the etching, so that the conical form of the electron emitting portion 16*e* tends to be dulled after the mask material layer 17 disappears.

Further, the mask material layer 27 remaining in the columnar portion 26B has another merit that the form of the electron emitting portion 26*e* does not easily vary even if the depth of the columnar portion 26B varies to some extent. That is, the depth of the columnar portion 26B can vary depending upon the thickness of the conductive material layer 26 and the variability of a step coverage. Since, however, the width of the columnar portion 26B is constant regardless of the depth, the width of the mask material layer 27 comes to be constant, and there is no big difference caused in the form (shape) of the electron emitting portion 26*e* to be finally formed. In contrast, in the mask material layer 17 remaining in the recess 16A, the width of the mask material layer varies depending upon a case where the recess 16A has a large depth or a small depth. Therefore, with a decrease in the depth of the recess 16A and with a decrease in the thickness of the mask material layer 17, the conical form of the electron emitting portion 16*e* begins to be dulled earlier. The electron emission efficiency of the field emission device changes depending upon a potential difference between the gate electrode and the cathode electrode, a distance between the gate electrode and the electron emitting portion and a work function of a material constituting the electron emitting portion, and it also changes depending upon the form (shape) of the tip portion of the electron emitting portion. For these reasons, preferably, the form (shape) and the etch rate of the mask material layer are selected as described as required.

EXAMPLE 3

Example 3 is directed to the process for the production of a field emission device according to the first-C aspect of the present invention. The production process of Example 3 will be explained with reference to FIGS. 12A, 12B and 13. Those portions which are the same as those in FIGS. 8A, 8B, 9A, 9B, 10A and 10B are shown by the same reference numerals, and detailed explanations thereof are omitted.

[Step-300]

Figure 12A:
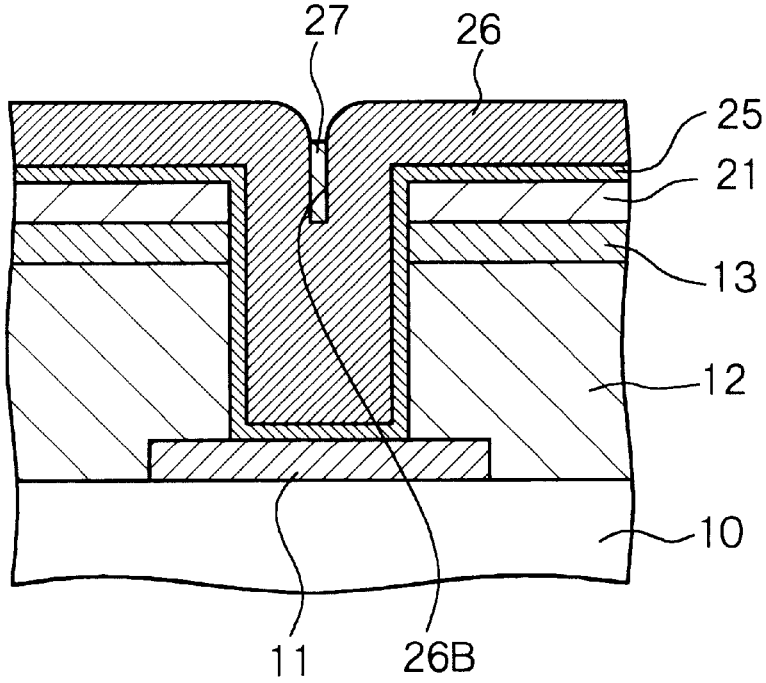
FIG. 12A is a schematic end view showing the step of leaving a mask material layer in a columnar portion.

Procedures up to the formation of the mask material layer 27 are carried out in the same manner as in [Step-200] to [Step-220] in Example 2. Then, the mask material layer 27 only on the conductive material layer 26 and in the widened portion 26C is removed to leave the mask material layer 27 in the columnar portion 26B as shown in FIG. 12A. In this case, wet etching using a diluted hydrofluoric acid aqueous solution is carried out, whereby only the mask material layer 27 composed of copper can be selectively removed without removing the conductive material layer 26 composed of tungsten. The height of the mask material layer 27 remaining in the columnar portion 26B differs depending upon the time period of the etching, while the etching time period is not much critical so long as a portion of the mask material layer 27 filled in the widened portion 26C can be fully removed. That is because the discussion on the height of the mask material layer 27 is substantially the same as the discussion made with regard to the depth of the columnar portion 26B with reference to FIG. 11A and because the height of the mask material layer 27 has no big influence on the form (shape) of the electron emitting portion 26*e* to be finally formed. [Step-310]

Figure 12B:
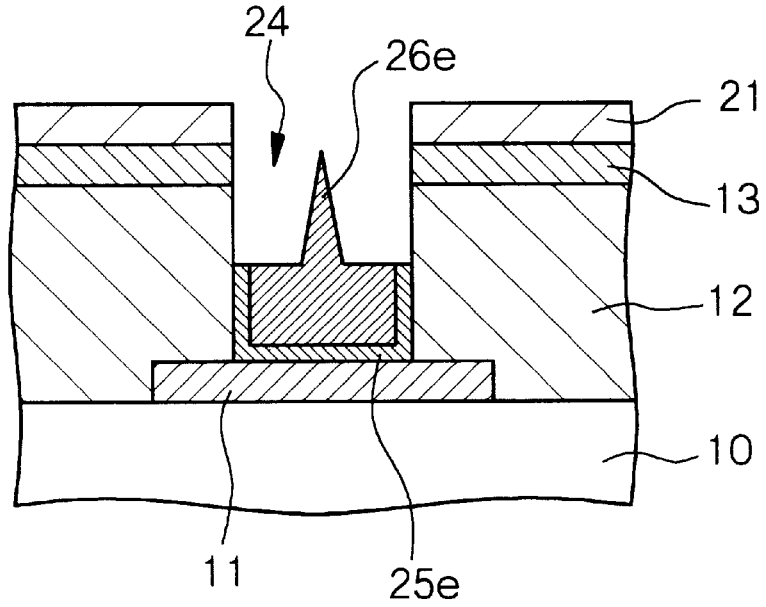
FIG. 12B is a schematic end view showing the step of forming an electron emitting portion, in the process for the production of the field emission device in Example 3.

Then, the conductive material layer 26, the mask material layer 27 and the adhesive layer 25 are etched in the same manner as in Example 2, to form the electron emitting portion 26*e* as shown in FIG. 12B. The electron emitting portion 26 may have a conical form as a whole as shown in FIG. 10A, while FIG. 12B shows a variant whose tip portion alone has a conical form. The above form (shape) can be formed when the mask material layer 27 filled in the columnar portion 26B has a small height or when the etch rate of the mask material layer 27 is relatively high, while the form (shape) is not functionally critical as the electron emitting portion 26*e*.

[Step-320]

Figure 13:
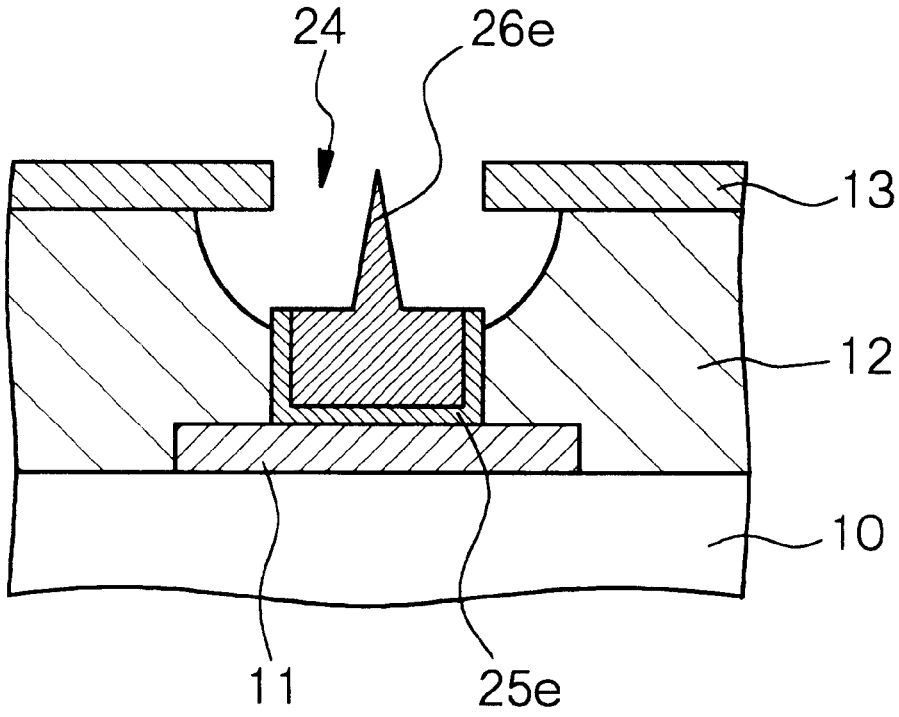
FIG. 13 following

Then, the wall surface of the opening portion 24 formed in the insulating layer 12 is etched backward under an isotropic etching condition, whereby a field emission device shown in FIG. 13 is completed. The isotropic etching is as explained in Example 1. A display can be constituted of such field emission devices as explained in Example 1.

EXAMPLE 4

Figure 14A:
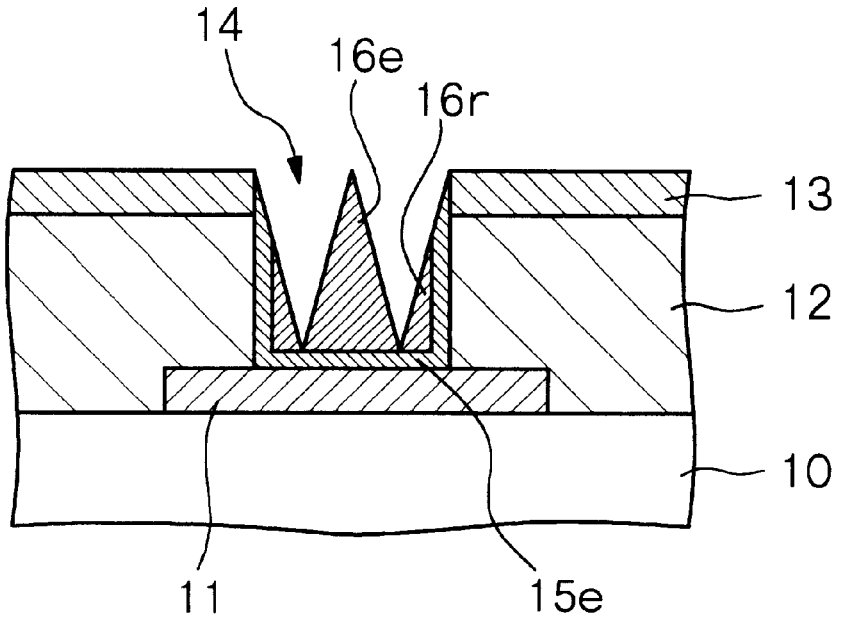
FIG. 14A is a schematic end view showing a state where an etching residue remains.
Figure 14B:
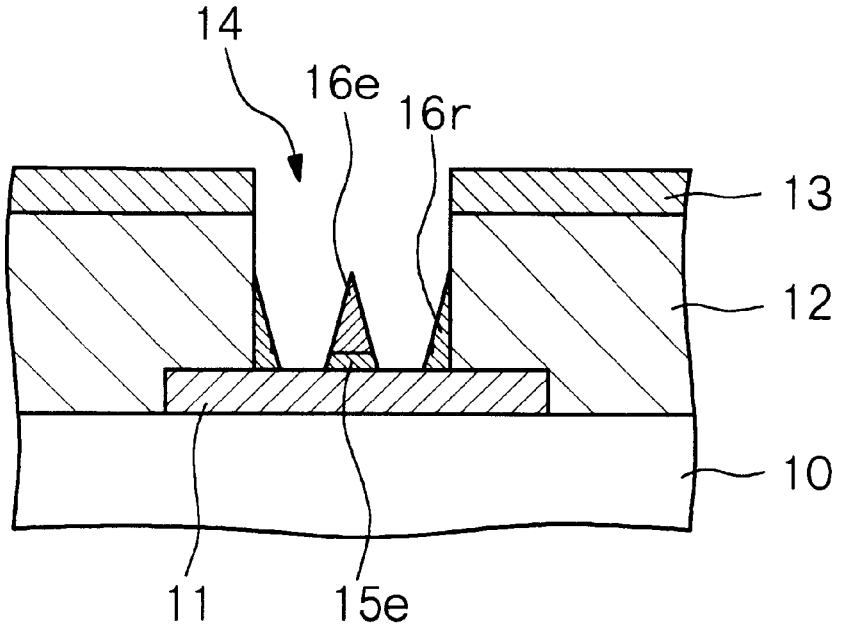
FIG. 14B is a schematic end view showing a state where an electron emitting portion is decreased in size along with the removal of an etching residue, as a technical background of Example 4.
Figure 15:
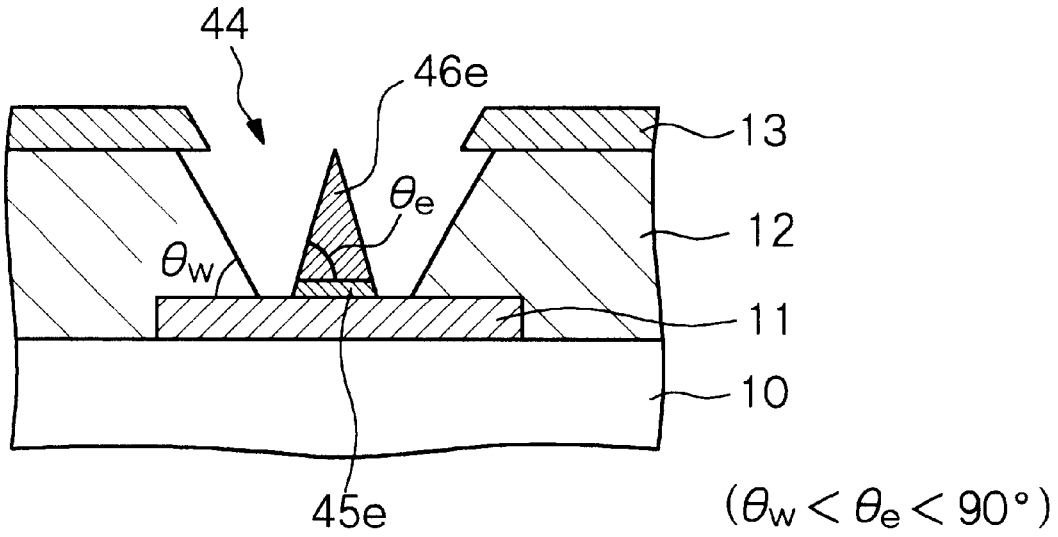
FIG. 15 is a schematic end view showing a field emission device in Example 4.
Figure 16A:
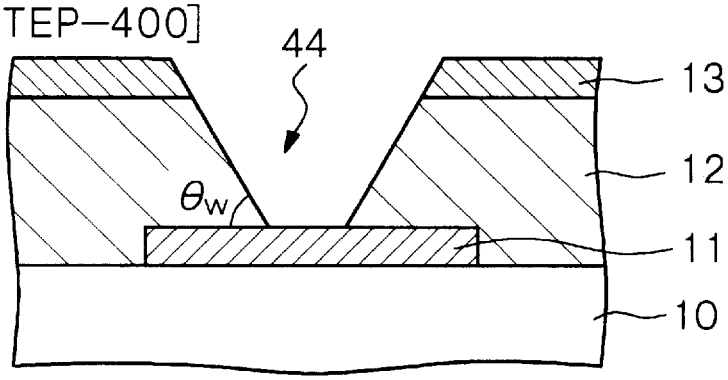
FIG. 16A is a schematic end view showing the step of forming an opening portion.
Figure 16B:
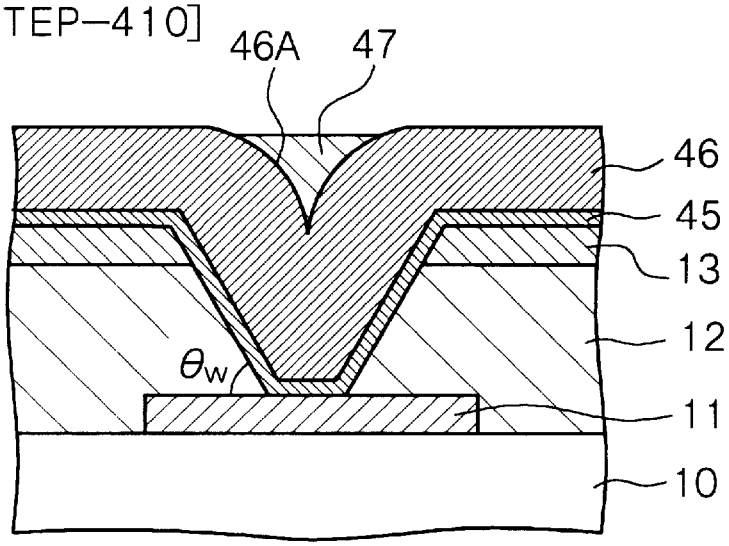
FIG. 16B is a schematic end view showing the step of leaving a mask material layer in a recess.
Figure 16C:
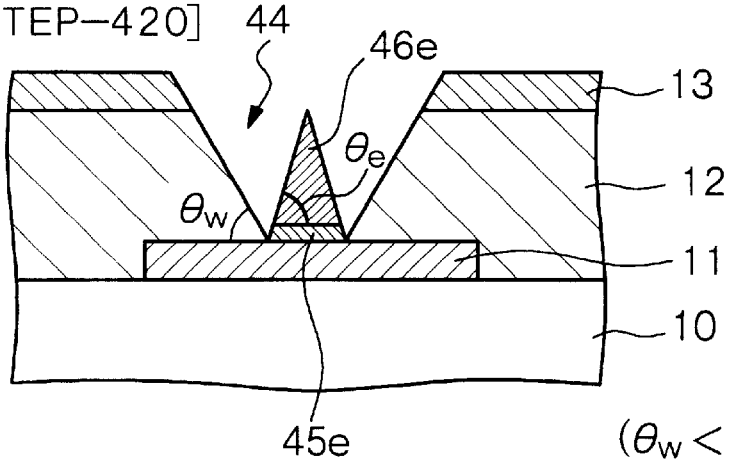
FIG. 16C is a schematic end view showing the step of forming an electron emitting portion, in the process for the production of the field emission device in Example 4.

Example 4 is directed to the field emission device according to the second aspect of the present invention and the production process according to the first-A aspect of the present invention for producing the above field emission device. First, a technical background of the field emission device provided in Example 4 will be explained with reference to FIGS. 14A and 14B. FIG. 15 shows a conceptual view of the field emission device of Example 4, and FIGS. 16A, 16B and 16C show steps of producing the above field emission device. Those portions which are the same as those in FIGS. 1A and 1B are shown by the same reference numerals, and detailed explanations thereof are omitted.

FIGS. 5A and 5B show a process from [Step-130] to [Step-140] in Example 1, i.e., a case where the etching of the conductive material layer 16 and the adhesive layer 15 is ideally proceeded with. In a practical process, an etching residue 16*r* can sometimes remain on the wall surface of the opening portion 14 as shown in FIG. 14A when an etching condition varies to some extent. In an example shown in FIG. 14A, the gate electrode 13 and the cathode electrode 11 form a short circuit with the etching residue 16*r*. Therefore, it is required to decrease the etching residue 16*r* to such an extent that the short circuit is overcome. However, if the etching of the conductive material layer 16 is continued therefor, the height of the electron emitting portion 16*e* is decreased as shown in FIG. 14B. That is, the distance between the end portion of the gate electrode 13 and the tip portion of the electron emitting portion 16*e* increases, resulting in a decrease in the electron emission efficiency and a consequent increase in power consumption.

The field emission device of Example 4 overcomes the above problem by slanting the wall surface of the opening portion 44 as shown in FIG. 15. That is, the relationship of $\theta_w<\theta_e<90°$ is satisfied, where $\theta_w$ is an inclination angle of the wall surface of the opening portion 44 measured from the surface of the cathode electrode 11 as a reference and $\theta_e$ is an inclination angle of slant of the tip portion of an electron emitting portion 46*e* measured from the surface of the cathode electrode 11 as a reference. The process for the production of the above field emission device will be explained below.

[Step-400]

First, procedures up to the formation of the insulating layer 12 are carried out in the same manner as in Example 1, and then, the formation of the gate electrode 13 composed of TiN is carried out in the same manner as in Example 1. Then, the gate electrode 13 is etched under already described etching condition shown in Table 12, and further, the insulating layer 12 is etched under a condition shown in the following Table 16 as one example. As a result, an opening portion 44 having a slanting wall surface and having an opening portion where the cathode electrode 11 is exposed as shown in FIG. 16A is obtained. In this case, the wall surface of the opening portion 44 have an inclination angle $\theta_w$ of approximately 75°.

TABLE 16

| | |
|---|---|
| $C_4F_8$ flow rate | 100 SCCM |
| CO flow rate | 70 SCCM |
| Ar flow rate | 100 SCCM |
| Pressure | 7.3 Pa |
| RF power | 0.7 kW (13.56 MHz) |
| Etching temperature | 20° C. |

[Step-410]

Then, an electrically conductive adhesive layer 45 of TiN is formed under the sputtering condition shown in the already described Table 6. Then, a conductive material layer 46 for forming an electron emitting portion is formed on the entire surface including the inside of the opening portion 44. In this Example, as the conductive material layer 46, a tungsten layer having a thickness of approximately 0.3 $\mu$m is formed by a silane reduction low pressure CVD method. The following Table 17 shows a CVD condition as one example. A recess 46A on the basis of a step between the upper end portion and the bottom portion of the opening portion 44 is formed in the surface of the formed conductive material layer 46. Further, a mask material layer 47 is left in the recess 46A in the same manner as in Example 1. FIG. 16B shows a state where the process up to the above is finished.

TABLE 17

| | |
|---|---|
| $WF_6$ flow rate | 10 SCCM |
| $SiH_4$ flow rate | 70 SCCM |
| $H_2$ flow rate | 1000 SCCM |
| Pressure | 26.6 Pa |
| Layer formation temperature | 430° C. |

[Step-420]

Then, as shown in FIG. 16C, the conductive material layer 46, the mask material layer 47 and the adhesive layer 45 are etched to form an electron emitting portion 46*e* having a conical form. The etching of these layers is carried out under an isotropic etching condition where the etch rates of the conductive material layer 46 and the adhesive layer 45 are higher than the etch rate of the mask material layer 47. Table 18 shows an etching condition as one example. The slant of tip portion of the electron emitting portion 46*e* has an inclination angle $\theta_e$ of approximately 80° when measured from the surface of the cathode electrode 11 as a reference, which data is larger than the inclination angle $\theta_w$ (approximately 75°) of the wall surface of the opening portion 44 measured from the surface of the cathode electrode 11 as a reference. The above inclination angles satisfy the relationship of $\theta_w<\theta_e$, so that the electron emitting portion 46*e* having a sufficient height is formed without leaving an etching residue (see reference numeral 16*r* in FIG. 14A) on the wall surface of the opening portion 44 during the above etching.

TABLE 18

| | |
|---|---|
| $SF_6$ flow rate | 30 SCCM |
| $Cl_2$ flow rate | 70 SCCM |
| Ar flow rate | 500 SCCM |
| Pressure | 3 Pa |
| Microwave power | 1.3 kW (2.45 GHz) |
| RF bias power | 20 W (8 MHz) |
| Etching temperature | −30° C. |

Then, the wall surface of the opening portion 44 formed in the insulating layer 12 is etched backward under an isotropic etching condition, whereby a field emission device shown in FIG. 15 is completed. The isotropic etching condition is as shown in Example 1. The display according to the second aspect of the present invention can be constituted of such field emission devices. The display can be constituted by the method explained in Example 1.

EXAMPLE 5

Figure 17:
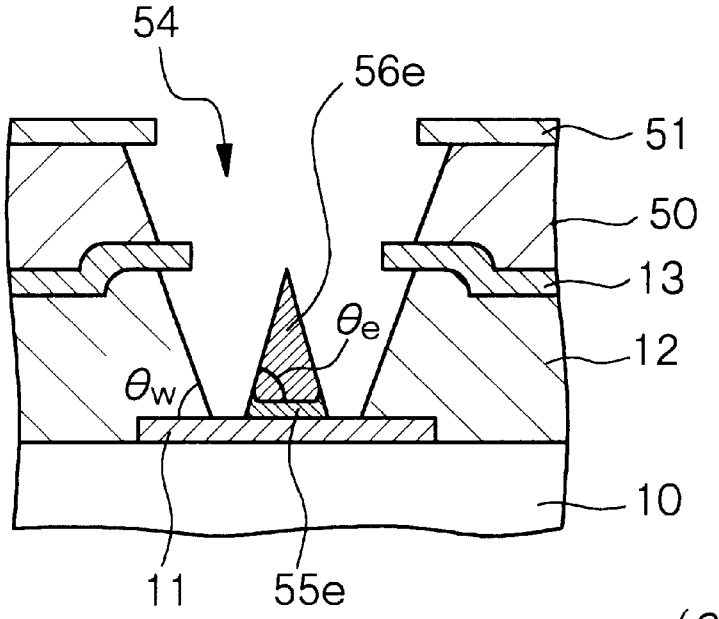
FIG. 17 is a schematic end view showing a field emission device in Example 5.
Figure 18A:
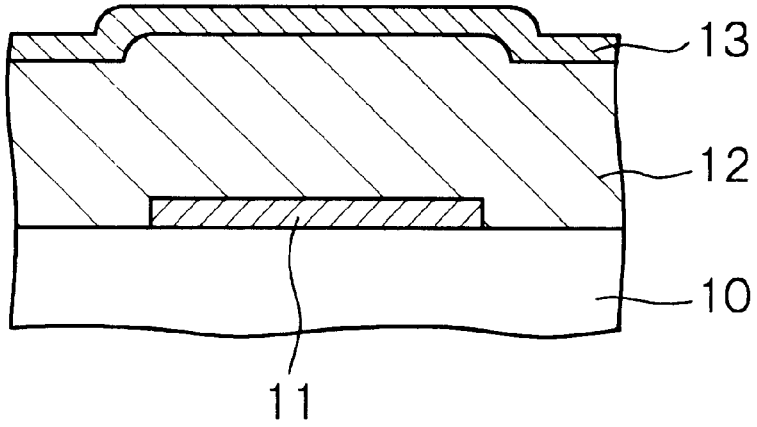
FIG. 18A is a schematic end view showing the step of forming a gate electrode.
Figure 18B:
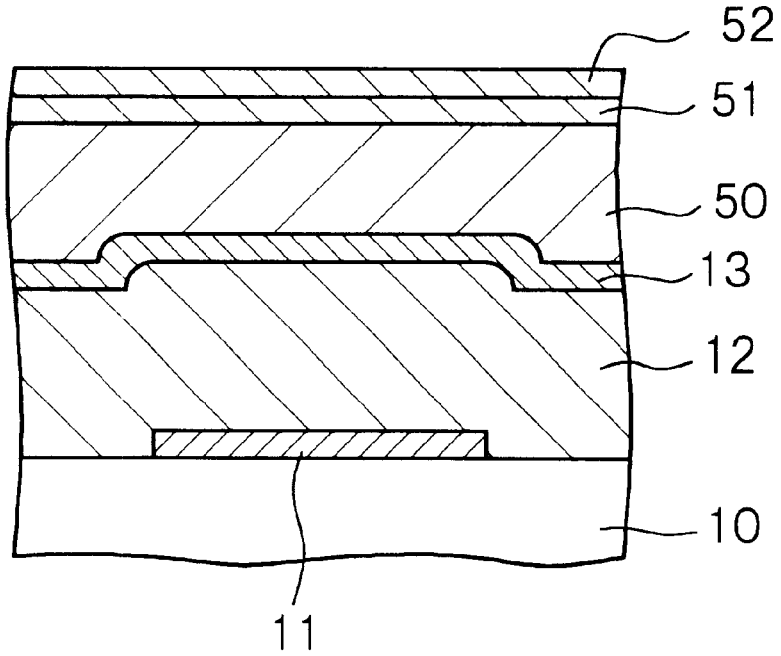
FIG. 18B is a schematic end view showing the step of forming a focus electrode and an etching stop layer, in the process for the production of the field emission device in Example 5.

Example 5 is a variant of Example 4. The field emission device of Example 5 differs from the counterpart of Example 4 in that a second insulating layer is further formed on the insulating layer and the gate electrode and that a focus electrode is formed on the second insulating layer. FIG. 17 shows a conceptual view of the field emission device of Example 5, and FIGS. 18A, 18B, 19A, 19B, 20A and 20B show the steps of the production process according to the first-A aspect of the present invention, for producing the above field emission device. In these Figures, those portions which are the same as those in FIGS. 1A and 1B are shown by the same reference numerals, and detailed explanations thereof are omitted.

The field emission device of Example 5 has a structure in which a second insulating layer 50 is formed on the insulating layer 12 and the gate electrode 13 of the field emission device shown in FIG. 15 and a focus electrode 51 of, for example, chromium (Cr) is formed on the second insulating layer 50. The focus electrode 51 is a member provided for preventing the divergence of paths of electrons emitted from an electron emitting portion in a so-called high-voltage type display in which the potential difference between an anode electrode and a cathode electrode is the order of several thousands volts and the distance between these two electrodes is relatively large. A relatively negative voltage is applied to the focus electrode 51 from a focus power source (not shown). By improving the convergence of paths of the emitted electrons, an optical crosstalk between pixels is decreased, color mixing is prevented when color displaying is performed in particular, and further, a higher fineness of a display screen can be attained by further finely dividing each pixel. The edge portion of the focus electrode 51 is present more backward than the edge portion of the gate electrode 13. The focus electrode is originally intended to modify the paths of only those electrons which are to deviate from the direction perpendicular to the cathode electrode 11 to a great extent. When the opening diameter of the focus electrode 51 is too small, the field emission device may decrease in the electron emission efficiency. The edge portion of the focus electrode 51 is positioned backward as compared with the edge portion of the gate electrode 13 as described above, which is remarkably desirable in that a necessary focus effect alone can be obtained without preventing the emission of electrons.

An opening portion 54 is formed so as to penetrate through the focus electrode 51, the second insulating layer 50, the gate electrode 13 and the insulating layer 12. The cathode electrode 11 is exposed on part of a bottom portion of the opening portion 54. The wall surface of the opening portion 54 is constituted of processed surfaces of the focus electrode 51, the second insulating layer 50, the gate electrode 13 and the insulating layer 12. The upper end of the opening portion formed in the second insulating layer 50 is positioned backward as compared with the edge portion of the focus electrode 51, and the upper end of the opening portion formed in the insulating layer 12 is positioned backward as compared with the edge portion of the gate electrode 13, whereby there is formed a structure in which an electric field having a desired intensity can be effectively formed in the opening portion 54. An electron emitting portion 56*e* is formed in the opening portion 54, and an electrically conductive adhesive layer 55*e* of titanium nitride (TiN) is formed between the electron emitting portion 56*e* and the cathode electrode 11. The inclination angle $\theta_w$ of a wall surface of the opening portion 54 formed in the insulating layer 12 measured from the surface of the cathode electrode 11 as a reference is smaller than the inclination angle $\theta_e$ of slant of the tip portion of the electron emitting portion 56*e* measured from the surface of the cathode electrode 11 as a reference ($\theta_w<\theta_e<90°$).

The process for the production of the field emission device of Example 5 will be explained with reference to FIGS. 18A, 18B, 19A, 19B, 20A and 20B hereinafter.

[Step-500]

First, a plurality of stripe-shaped cathode electrodes 11 extending in parallel with the direction of rows are formed on a support 10. The cathode electrode 11 is formed, for example, of a laminate of a TiN layer, a Ti layer, an Al—Cu layer, a Ti layer, a TiN layer and a Ti layer. Figures show the cathode electrode 11 as a single layer. Then, an insulating layer 12 is formed on the support 10 and the cathode electrode 11. Further, a plurality of stripe-shaped gate electrodes 13 extending in parallel with direction of columns are formed on the insulating layer 12, to obtain a state shown in FIG. 18A. The gate electrode 13 is composed, for example, of TiN. The above step can be carried out as explained in [Step-200] in Example 2.

[Step-510]

Then, an approximately 1 $\mu$m thick second insulating layer 50 of $SiO_2$ is formed on the entire surface by a CVD method. Further, an approximately 0.07 $\mu$m thick TiN layer is formed on the entire surface of the second insulating layer 50 and patterned as determined to form a focus electrode 51. Further, an approximately 0.2 $\mu$m thick etching stop layer 52 of $SiO_2$ is formed on the second insulating layer 50 and the focus electrode 51, to obtain a state shown in FIG. 18B. The formation of each of the second insulating layer 50 and the etching stop layer 52 can be carried out under the same condition as that for the formation of the insulating layer 12. Further, the focus electrode 51 can be formed under the condition as that for the formation of the gate electrode 13.

[Step-520]

Figure 19A:
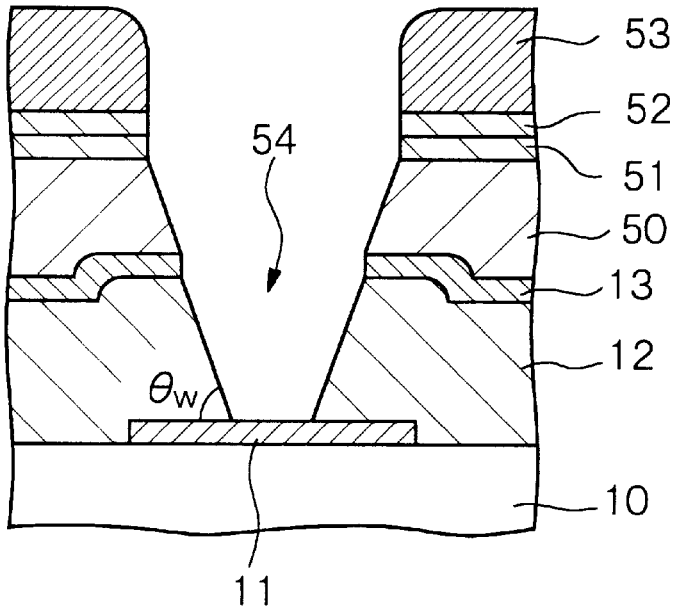
FIG. 19A following

A resist layer 53 having a predetermined pattern is formed on the etching stop layer 52, and the etching stop layer 52, the focus electrode 51, the second insulating layer 50, the gate electrode 13 and the insulating layer 12 are consecutively etched with the above resist layer 53 as a mask. As a result of the above etching procedure, a circular opening portion 54 having a bottom portion where the cathode electrode 11 is exposed as shown in FIG. 19A is formed. The etching of each of the focus electrode 51 and the gate electrode 13 can be carried out under the condition shown in already described Table 12. Further, the etching of each of the etching stop layer 52, the second insulating layer 50 and the insulating layer 12 can be carried out under the condition shown in already described Table 16. In this case, the wall surface of the opening portion 54 formed in the insulating layer 12 has an inclination angle $\theta_w$ of approximately 75° when measured from the surface of the cathode electrode 11 as a reference.

[Step-530]

Figure 19B:
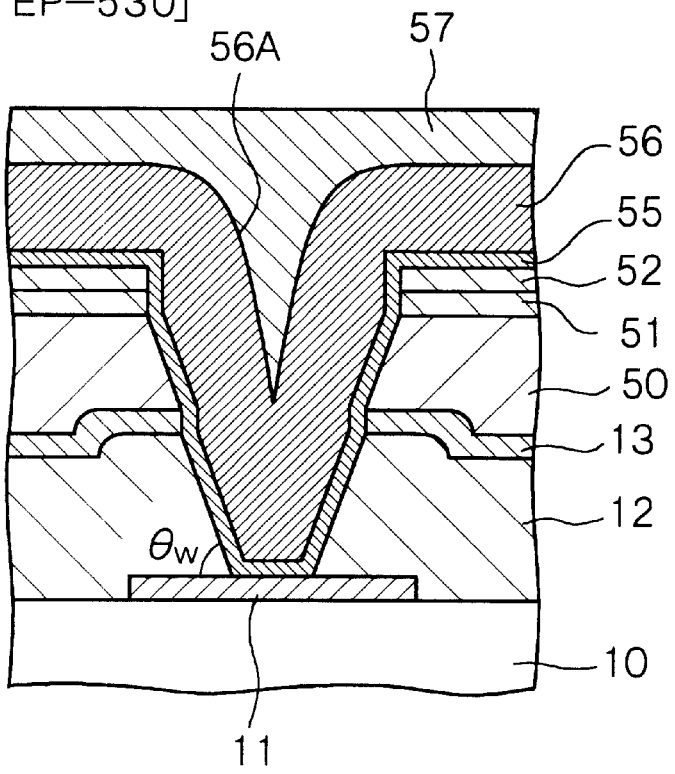
FIG. 19B is a schematic end view showing the step of forming a conductive material layer and a mask material layer, in the process for the production of the field emission device in Example 5.

Then, the resist layer 53 is removed, and an electrically conductive adhesive layer 55 of TiN is formed on the entire surface including the inside of the opening portion 54, for example, according to the sputtering condition shown in the already described Table 6. A conductive material layer 56 of tungsten for forming an electron emitting portion is formed on the entire surface including the inside of the opening portion 54, for example, according to the low pressure CVD method described in already described Table 17. A recess 56A is formed in the surface of the formed conductive material layer 56 on the basis of a step between the upper end portion and the bottom portion of the opening portion 54. Further, a mask material layer 57 is formed on the conductive material layer 56 in the same manner as in Example 1. FIG. 19B shows a state where procedures up to the above are finished.

[Step-540]

Figure 20A:
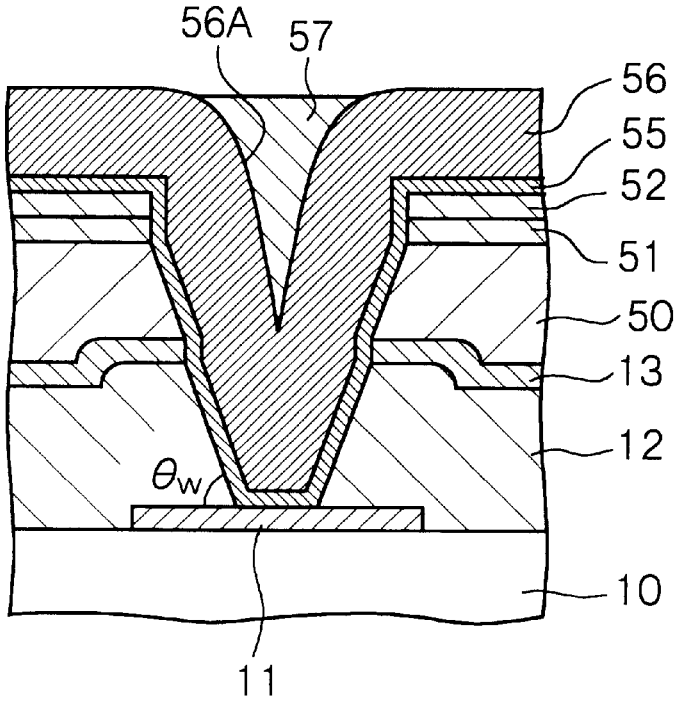
FIG. 20A following

Then, the mask material layer 57 is etched to leave the mask material layer 57 in the recess 56A as shown in FIG. 20A. The process for leaving the mask material layer 57 in the recess 56A can be carried out in the same manner as in [Step-130] in Example 1.

[Step-550]

Figure 20B:
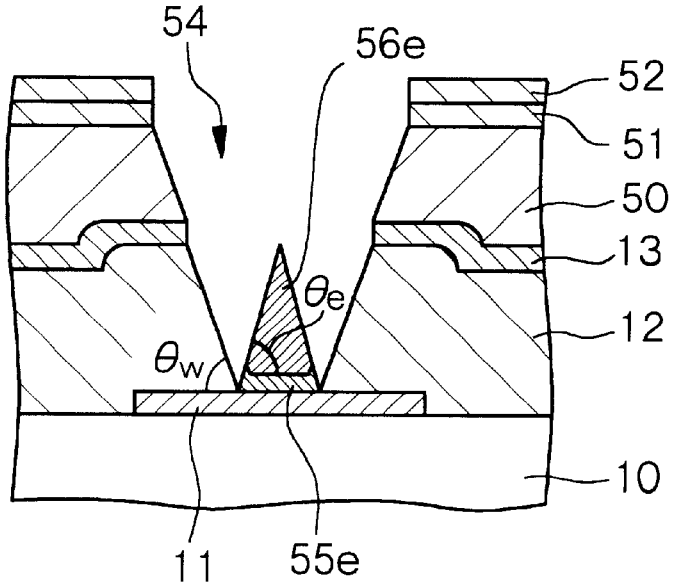
FIG. 20B is a schematic end view showing the step of forming an electron emitting portion, in the process for the production of the field emission device in Example 5.

Then, as shown in FIG. 20B, the conductive material layer 56, the mask material layer 57 and the adhesive layer 55 are etched to form an electron emitting portion 56*e* having the form of a circular cone. The above layers can be etched in the same manner as in [Step-420] in Example 4. The tip portion of the electron emitting portion 56*e* has a slant having an inclination angle $\theta_e$ of approximately 80° when measured from the surface of the cathode electrode 11 as a reference, which inclination angle $\theta_e$ is larger than the inclination angle $\theta_w$ (approximately 75°) of the wall surface of the opening portion 54 formed in the insulating layer 12 measured from the surface of the cathode electrode 11 as a reference. The above two inclination angles satisfy the relationship of $\theta_w<\theta_e<90°$, and the electron emitting portion 56*e* having a sufficient height is therefore formed without leaving an etching residue (see reference numeral 16*r* in FIG. 14A) on the wall surface of the opening portion 54 during the above etching.

Then, the wall surfaces of the opening portion 54 formed in the insulating layer 12 and the second insulating layer 50 are etched backward under an isotropic etching condition, to complete a field emission device shown in FIG. 17. The above isotropic etching is as described in Example 1. The display according to the second aspect of the present invention can be constituted of such field emission devices. The display can be constituted by the same method as that explained in Example 1.

EXAMPLE 6

Example 6 is directed to the field emission device according to the first-D aspect of the present invention. First, a technical background of the field emission device provided in Example 6 will be explained with reference to FIGS. 21A and 21B, and the process for the production of the field emission device according to the first-D aspect of the present invention will be explained with reference to FIGS. 22A, 22B, 23A and 23B. In these Figures, those portions which are the same as those in FIGS. 1A and 1B are shown by the same reference numerals, and detailed explanations thereof are omitted.

Figure 21A:
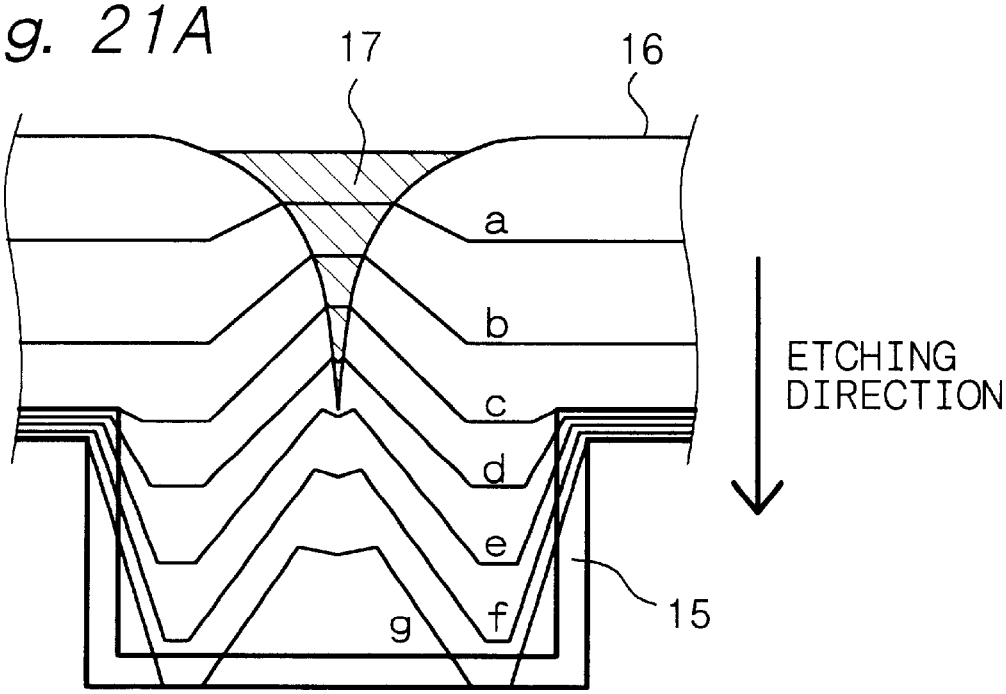
FIG. 21A is a conceptual view showing a change of a surface profile of a layer being etched with the passage of the etching.
Figure 21B:
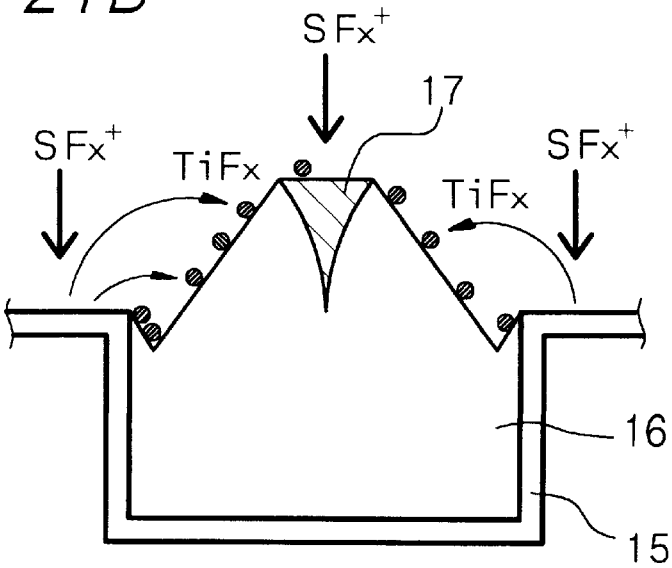
FIG. 21B is a conceptual view showing a state where the etching is under way, as a technical background of Example 6.

The previous process shown in FIGS. 5A and 5B shows a case where the process from [Step-130] to [Step-140], i.e., the etching of the conductive material layer 16 ideally proceeds. In a practical process, however, the conical form of the electron emitting portion 16*e* is sometimes dulled or an etching residue sometimes remains on the wall surface of the opening portion 14 due to a delicate variability of etching conditions. One reason therefor is presumably that an etching reaction product derived from the adhesive layer 15 inhibits the etching of the conductive material layer 16 depending upon a combination of materials constituting the conductive material layer 16 and the adhesive layer 15. For example, FIGS. 21A and 21B conceptually shows a phenomenon which may take place in a case where the conductive material layer 16 is composed of tungsten (W), the adhesive layer 15 is composed of titanium nitride (TiN) and these layers are etched with a fluorine-containing chemical species. FIGS. 21A and 21B show an example of a state where $SF_6$ is used as an etching gas and $SF_x^+$ is formed as a fluorine-containing chemical species. When $NF_3$ is used as an etching gas, $NF_x^+$ is formed, and when a fluorocarbon-containing gas is used as an etching gas, $CF_x^+$ is formed, as a fluorine-containing chemical species. FIG. 21A shows changes in surface profiles a to g of layers being etched (i.e., conductive material layer 16, adhesive layer 15 and mask material layer 17) along with the proceeding of the etching, and FIG. 21B schematically shows a phenomenon that may take place at a time when a surface profile c is reached. In the above case, it is assumed that the ratio of the etch rate of the conductive material layer 16 to the etch rate of the mask material layer 17 is 2:1, and that the ratio of the etch rate of the conductive material layer 16 to the etch rate of the adhesive layer 15 is 10:1.

On the initial stage of the above etching, the area of the conductive material layer 16 composed of tungsten covers most of the area of a layer being etched, and the surface profile changes like a→b. In this case, the conductive material layer 16 is readily removed by a reaction represented by $W+F_x \rightarrow WF_x$ (where x is a natural number of 6 or less, and typically x=6). When the surface profile c is attained, however, the area of the adhesive layer 15 composed of TiN comes to cover most part of the area of the layer being etched, and the ratio of the area of the conductive material layer 16 in the area of the layer being etched comes to be 1% or less as far as the designing of a general field emission device is concerned. Since, however, titanium fluoride ($TiF_x$ where x is a natural number of 3 or less, and typically x=3) generated by a reaction between TiN and a fluorine-containing chemical species has a low vapor pressure, it adheres to the surface of the conductive material layer 16 to prevent the etching. Therefore, as the surface profile after the mask material layer 17 has disappeared changes like d→e→f→g, not only the conical form may be dulled but also an etching residue may remain on the wall surface of the opening portion 14. These cause disadvantages such as a decrease in the electron emission efficiency and a short circuit by the etching residue between the gate electrode and the cathode electrode.

In the process for the production of the field emission device of Example 6, the above problem is overcome by bringing the etch rate $R_1$ of the conductive material layer 16 and the etch rate $R_2$ of the adhesive layer into conformity to each other or by determining the etch rate $R_1$ of the conductive material layer 16 to be 5 times or less than 5 times as high as the etch rate $R_2$ of the adhesive layer 15 even though the etch rate $R_1$ may be higher ($R_2 \leqq R_1 \leqq 5R_2$). For bringing the etch rates of the conductive material layer 16 and the adhesive layer 15 into conformity to each other, it is the simplest to use the same electrically conductive material to form these two layers. Even the materials constituting the these two layers are the same, excellence in the step coverage which the conductive material layer is required to have and excellence in the adhesiveness which the adhesive layer is required to have can be attained by selecting methods for forming the layers. The process for the production of the field emission device of Example 6 will be explained below.

[Step-600]

Figure 22A:
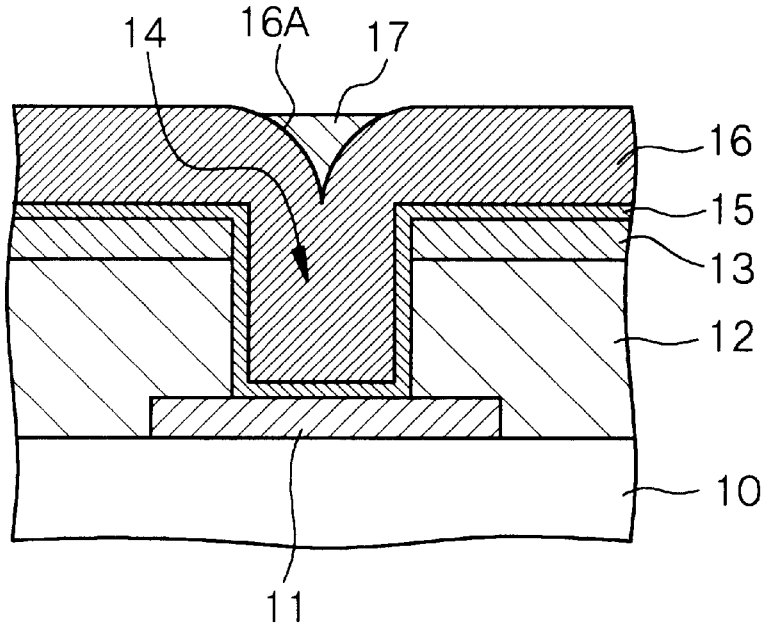
FIG. 22A is a schematic end view showing the step of leaving a mask material layer in a recess.

First, procedures up to the formation of the opening portion 14 are carried out in the same manner as in [Step-100] in Example 1. Then, an electrically conductive adhesive layer 15 of an approximately 0.07 μm thickness, composed of tungsten, is formed on the entire surface including the inside of the opening portion 14 by a DC sputtering method. The following Table 19 shows a sputtering condition as one example. The tungsten layer formed by the sputtering method can fully work as the adhesive layer 15. The formation of the conductive material layer 16 of tungsten and the process for leaving the mask material layer 17 in a recess 16A in the surface of the conductive material layer 16 can be carried out in the same manner as in [Step-120] to [Step-130] in Example 1. FIG. 22A shows a state where the steps up to the above are finished.

TABLE 19

| | |
|---|---|
| Ar flow rate | 100 SCCM |
| Pressure | 0.67 Pa |
| FR power | 3 kW (13.56 MHz) |
| Sputtering temperature | 200° C. |

[Step-610]

Figure 22B:
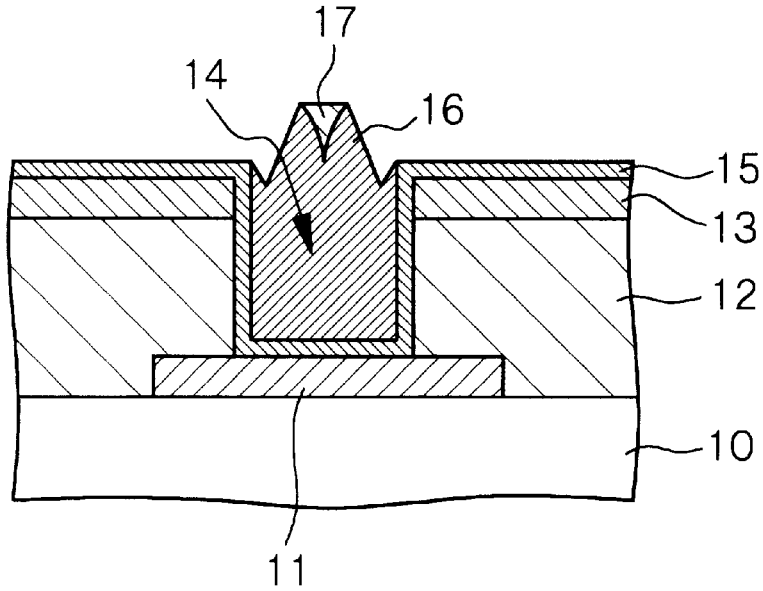
FIG. 22B is a schematic end view showing a state where the etching of a conductive material layer is under way, in the process for the production of the field emission device in Example 6.

Then, the conductive material layer 16 and the mask material layer 17 are etched in the same manner as in [Step-140] in Example 1. FIG. 22B shows a state where the adhesive layer 15 is just exposed. In Example 6, since the material that covers most part of area of a layer being etched is still tungsten at this point of time, the etching reaction product having a low vapor pressure, explained with reference to FIGS. 21A and 21B, is not generated, and the etching still readily proceeds as well.

[Step-620]

Figure 23A:
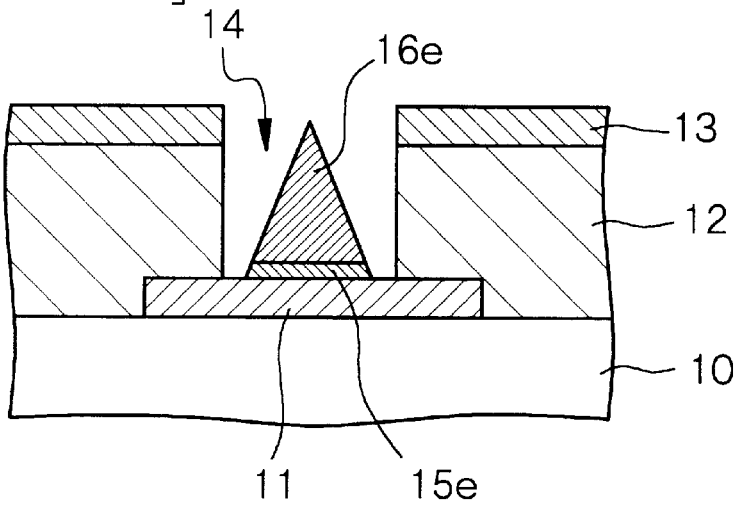
FIG. 23A following
Figure 23B:
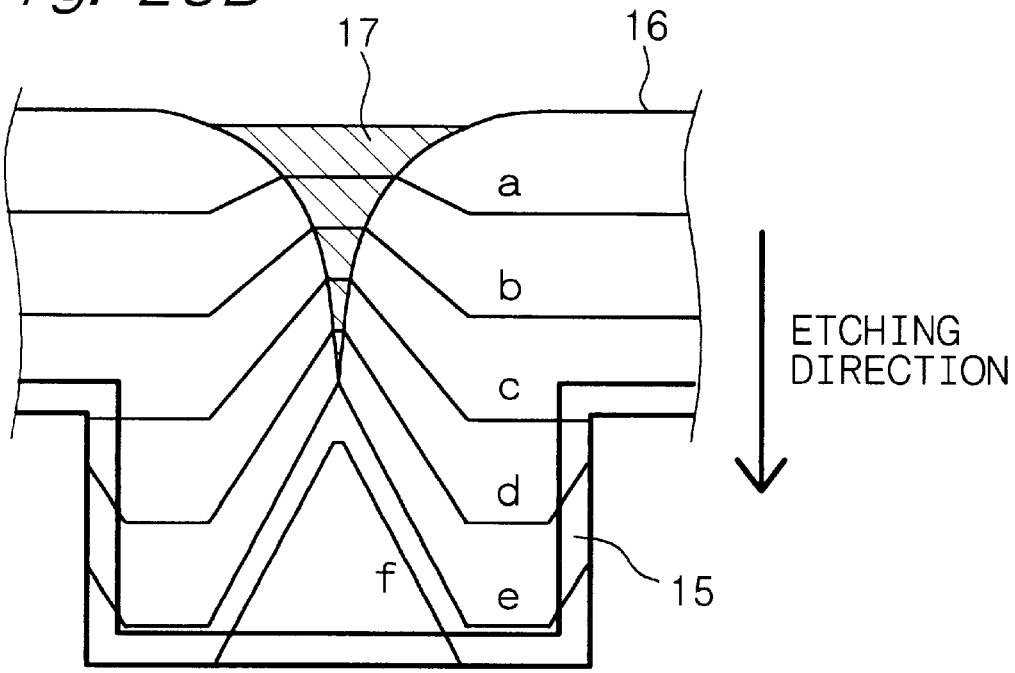
FIG. 23B is a schematic end view sowing a change of a surface profile of a layer being etched with the passage of the etching, in the production of the field emission device in Example 6.

Further, when the etching including the etching of the adhesive layer 15 still proceeds, an electron emitting portion 16*e* having an excellent conical form can be finally formed as shown in FIG. 23A. FIG. 23B shows a change in the surface profile a to f of the layer being etched (i.e., the conductive material layer 16, the adhesive layer 15 and the mask material layer 17) along with the proceeding of the etching. In the above case, it is assumed that the ratio of the etch rate of the conductive material layer 16 to the etch rate of the mask material layer 17 is 2:1 and that the ratio of the etch rate of the conductive material layer 16 to the etch rate of the adhesive layer 15 is 1:1. Even after the mask material layer 17 disappears, clearly, the dulling of the conical form of the electron emitting portion 16*e* and the remaining of the etching residue are effectively prevented.

Then, the wall surface of the opening portion 14 formed in the insulating layer 12 is etched backward under an isotropic etching condition, to complete a field emission device shown in FIGS. 1A and 1B. The above isotropic etching is as described in Example 1. The display according to each of the first and second aspects of the present invention can be constituted of such field emission devices. The display according to each of the first and second aspects of the present invention can be constituted by the same method as that explained in Example 1.

EXAMPLE 7

Figure 24:
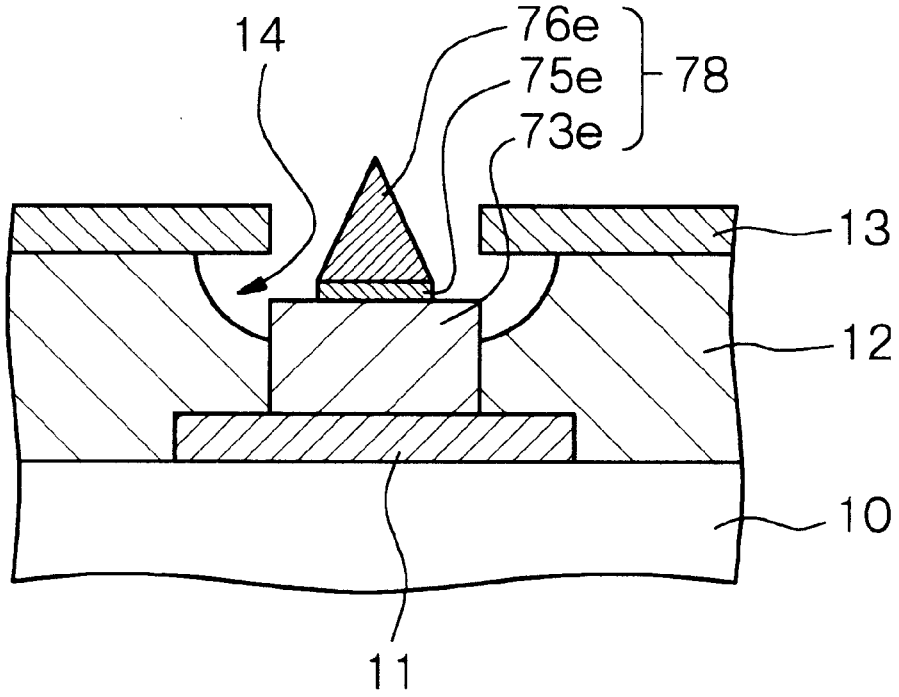
FIG. 24 is a schematic end view showing a field emission device in Example 7.

Example 7 is directed to the field emission device according to the third aspect of the present invention, more specifically, the third-A aspect and the production process according to the second aspect, more specifically the second-A aspect. FIG. 24 shows a schematic partial end view of the field emission device of Example 7, and FIGS. 25A, 25B, 26A, 26B, 27A and 27B show the process for the production thereof. In these Figures, those portions which are the same as those in FIGS. 1A and 1B are shown by the same reference numerals, and detailed explanations thereof are omitted.

The field emission device of Example 7 differs from the field emission device of Example 1 to a great extent in that an electron emitting portion 78 comprises a base portion 73*e* and a conical sharpened portion 76*e* formed on the base portion 73*e*. The base portion 73*e* and the sharpened portion 76*e* are composed of different electrically conductive materials. Specifically, the base portion 73*e* is a member for adjusting the substantial height of the electron emitting portion 78, and it is composed of a polysilicon layer containing an impurity. The sharpened portion 76*e* is a member which mainly serves to emit electrons, and it is constituted of a tungsten layer having a crystal boundary nearly perpendicular to the cathode electrode 11. The sharpened portion 76*e* has a conical form, more specifically, the form of a circular cone. An electrically conductive adhesive layer 75*e* of TiN is formed between the base portion 73*e* and the sharpened portion 76*e*. In this Example, the adhesive layer 75*e* is included in the electron emitting portion 78. However, it is not an essential component for the function of the electron emitting portion 78 but is formed for a production-related reason. The opening portion 14 is formed by removing a portion of the insulating layer 12 from immediately below the gate electrode 13 to the upper end portion of the base portion 73*e*.

The process for the production of the field emission device of Example 7 will be explained with reference to FIGS. 25A, 25B, 26A, 26B, 27A and 27B hereinafter.

[Step-700]

Figure 25A:
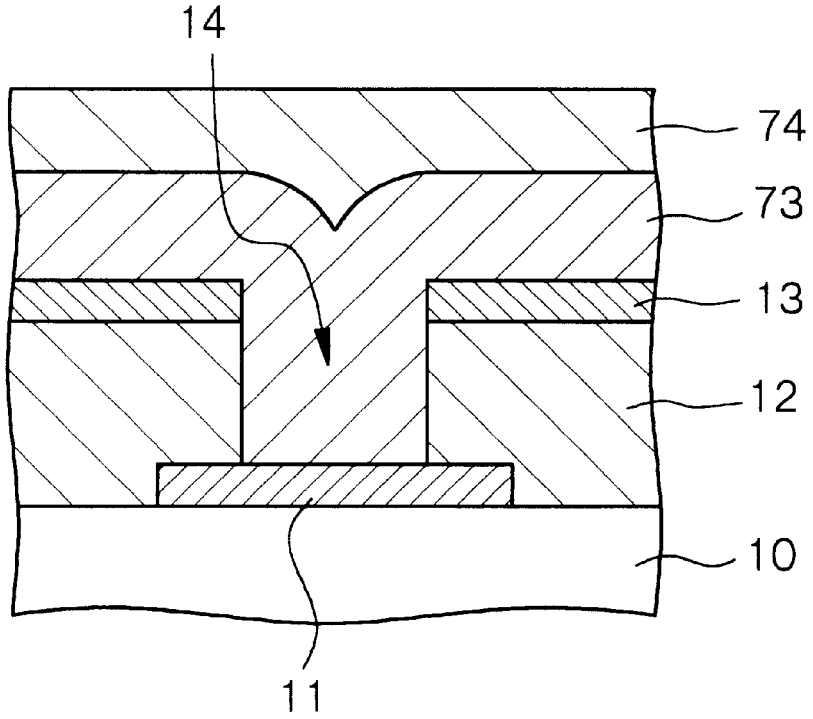
FIG. 25A is a schematic end view showing the step of forming a first conductive material layer for forming a base portion and a planarization layer.
Figure 25B:
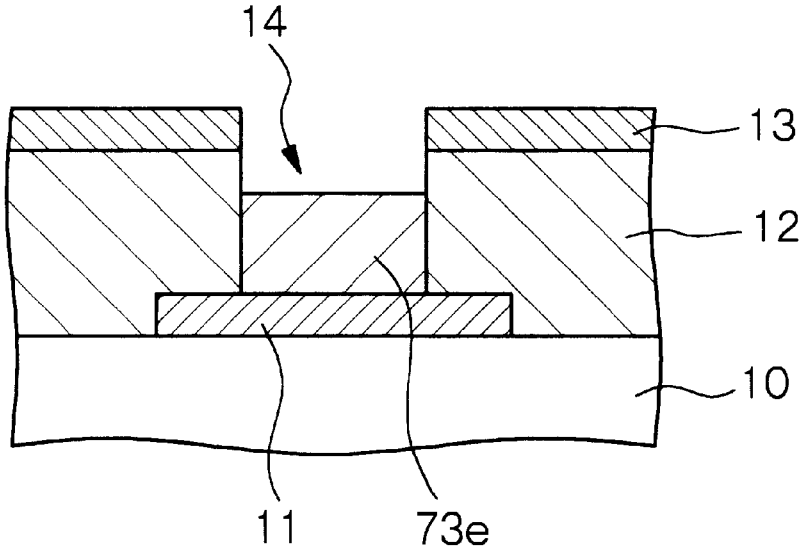
FIG. 25B is a schematic end view for explaining the step of forming the base portion, in the production of the field emission device in Example 7.

First, procedures up to the formation of the opening portion 14 are carried out in the same manner as in [Step-100] in Example 1. Then, as shown in FIG. 25A, a first conductive material layer 73 for forming the base portion is formed on the entire surface including the inside of the opening portion 14. As the first conductive material layer 73, a polysilicon layer containing the order of $10^{15}/cm^3$ of phosphorus as an impurity is formed by a plasma-enhanced CVD method. Further, a planarization layer 74 is formed on the entire surface so as to have a nearly flat surface. In this Example, a resist layer formed by a spin coating method is used as the planarization layer 74. Then, the planarization layer 74 and the first conductive material layer 73 are etched under a condition where the etch rates of these two layers equal to each other, and as shown in FIG. 25B, the bottom portion of the opening portion 14 is filled with the base portion 73*e* having a flat upper surface. The etching can be carried out by an RIE method using an etching gas containing chlorine-containing gas and oxygen-containing gas. The etching is carried out after the surface of the first conductive material layer 73 is once flattened with the planarization layer 74, so that the base portion 73*e* has a flat upper surface.

[Step-710]

Figure 26A:
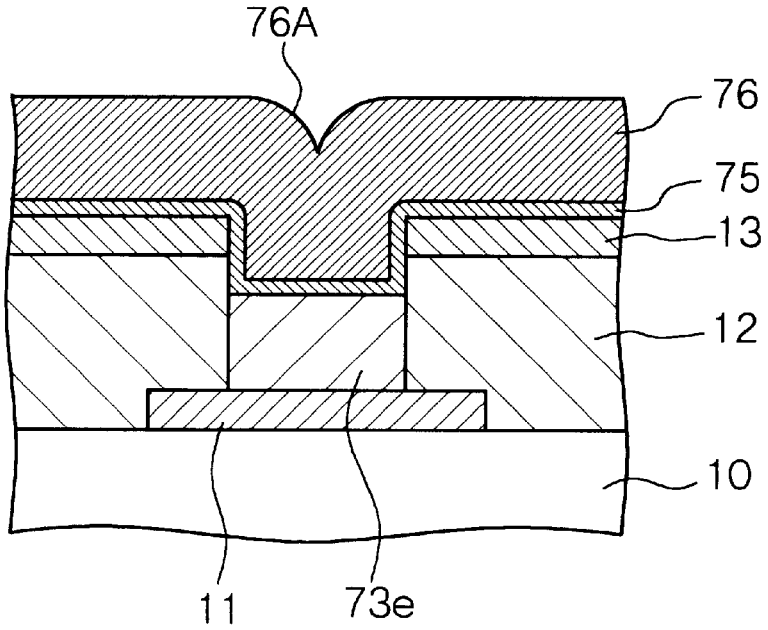
FIG. 26A following

Then, as shown in FIG. 26A, an electrically conductive adhesive layer 75 is formed on the entire surface including the residual portion of the opening portion 14, and a second conductive material layer 76 for forming a sharpened portion is formed on the entire surface including the residual portion of the opening portion 14, to fill the residual portion of the opening portion 14 with the second conductive material layer 76. The adhesive layer 75 is a 0.07 $\mu$m thick TiN layer formed by a sputtering method, and the second conductive material layer 76 is a 0.6 $\mu$m thick tungsten layer formed by a low pressure CVD method. The adhesive layer 75 can be formed under the sputtering condition shown in Table 6, and the second conductive material layer 76 can be formed under the CVD condition shown in Table 7 or 17. In the surface of the second conductive material layer 76, there is formed a recess 76A reflecting a step between the upper end portion and the bottom portion of the opening portion 14.

[Step-720]

Figure 26B:
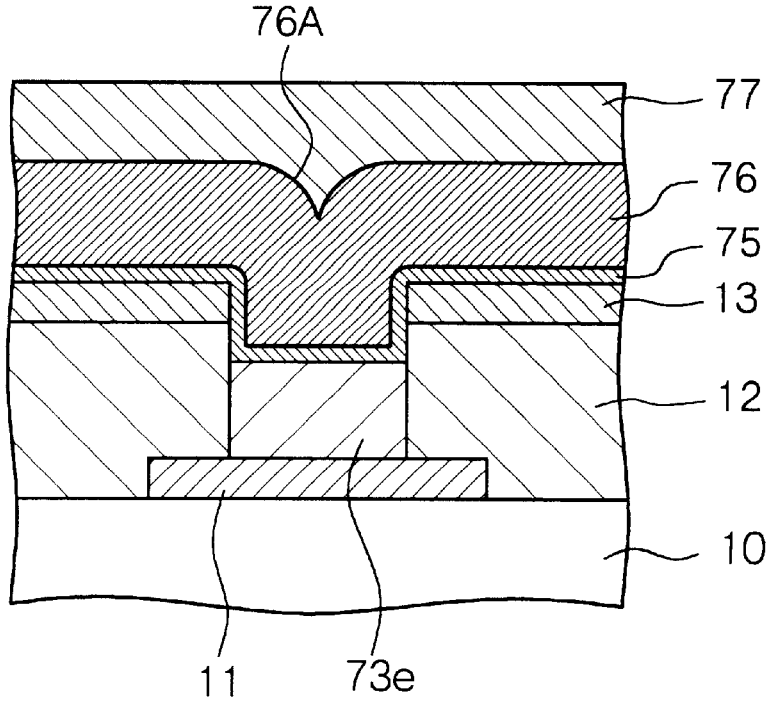
FIG. 26B is a schematic end view showing the step of forming a mask material layer, in the process for the production of the field emission device in Example 7.
Figure 27A:
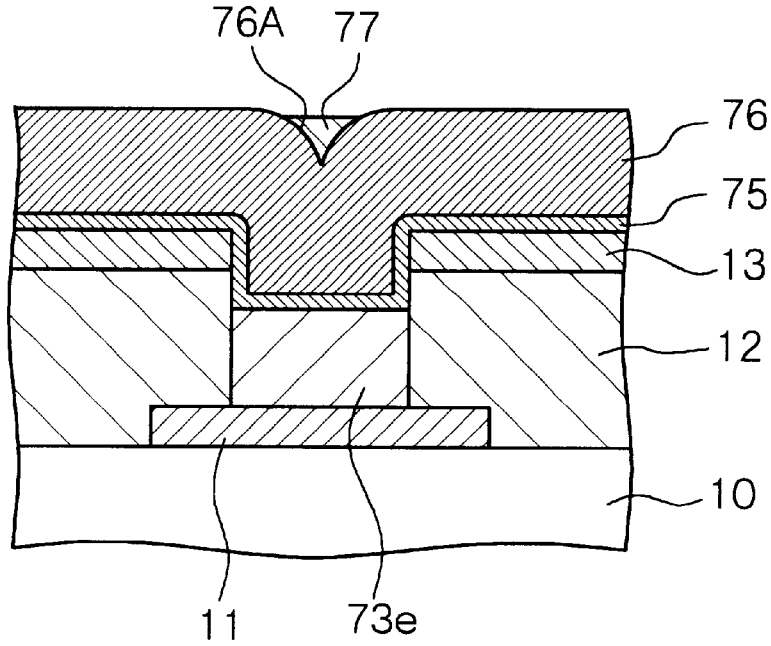
FIG. 27A following
Figure 27B:
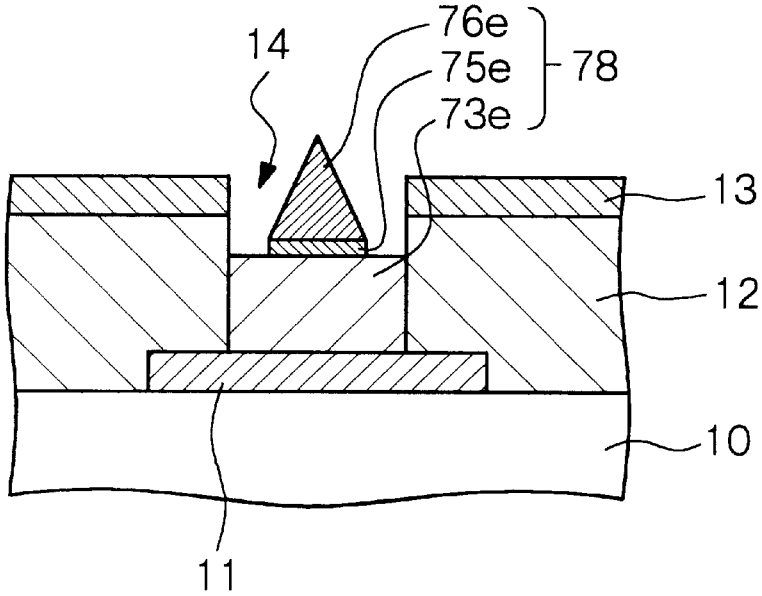
FIG. 27B is a schematic end view showing the step of forming an electron emitting portion, in the process for the production of the field emission device in Example 7.

Then, as shown in FIG. 26B, a mask material layer 77 is formed on the entire surface of the second conductive material layer 76 so as to form a nearly flat surface. The mask material layer 77 is constituted of a resist layer formed by a spin coating method, and it absorbs the recess 76A in the surface of the second conductive material layer 76 to form a nearly flat surface. Then, the mask material layer 77 is etched by an RIE method using an oxygen-containing gas. The etching is finished at a pint of time when the flat plane of the second conductive material layer 76 is exposed, whereby the mask material layer 77 is left in the recess 76A in the second conductive material layer 76 so that the surface as a whole has a flat upper surface as shown in FIG. 27A. The mask material layer 77 is formed so as to block (mask) a region of the second conductive material layer 76 positioned in the central portion of the opening portion 14.

[Step-730]

Then, the second conductive material layer 76, the mask material layer 77 and the adhesive layer 75 are etched together in the same manner as in [Step-140] in Example 1, whereby there are formed a sharpened portion 76*e* having the form of a circular cone depending upon the largeness or smallness of resist selectivity ratio and an adhesive layer 75*e* according to the already described mechanism, and the electron emitting portion 78 is completed. Then, the field emission device shown in FIG. 24 can be obtained by etching the wall surface of the opening portion 14 formed in the insulating layer 12 backward. The display according to the third aspect of the present invention, more specifically the third-A aspect can be constituted of such field emission devices. The display according to the third-A aspect of the present invention can be constituted by the same process as that explained in Example 1.

EXAMPLE 8

Figure 28:
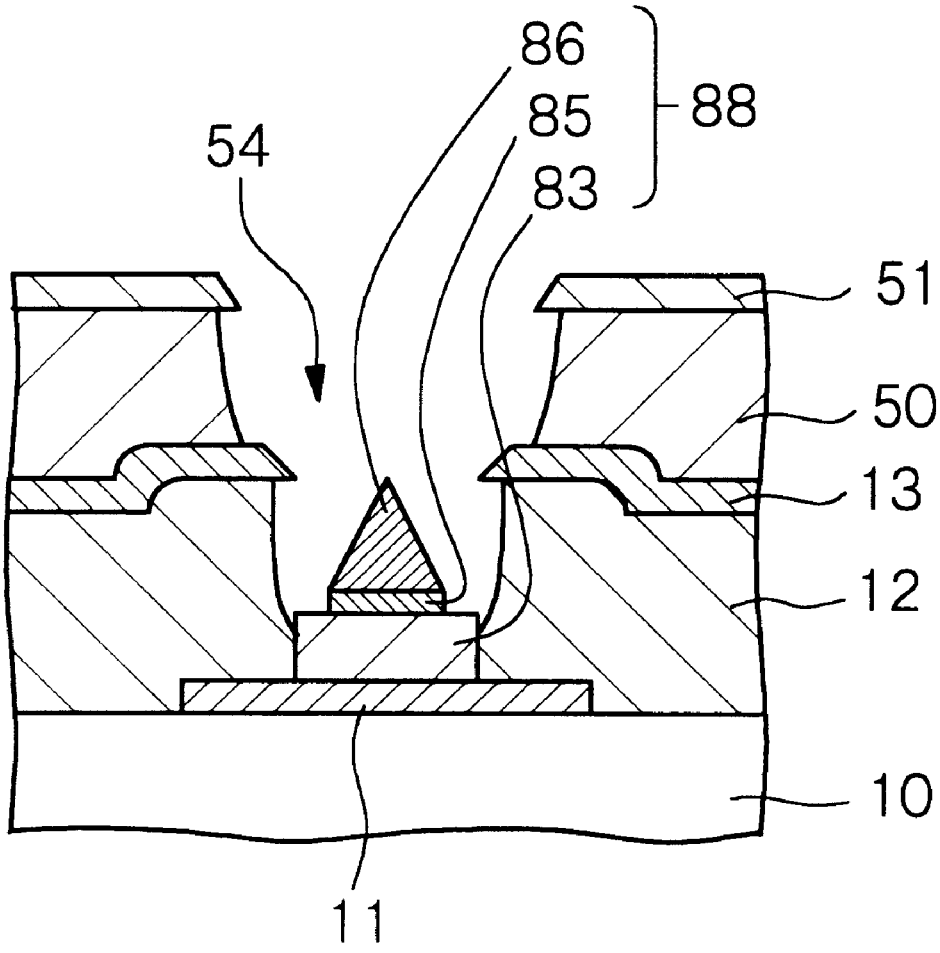
FIG. 28 is a schematic end view showing a field emission device in Example 8.
Figure 29A:
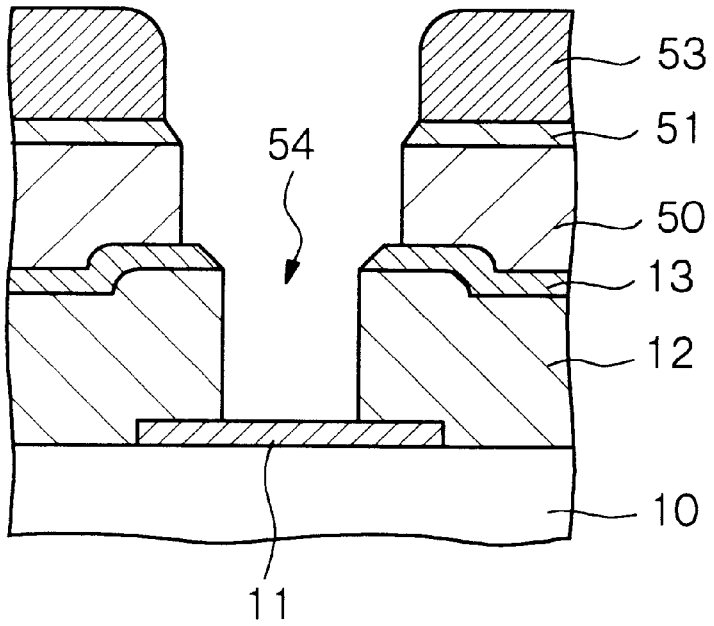
FIG. 29A is a schematic end view showing the step of forming an opening portion.
Figure 29B:
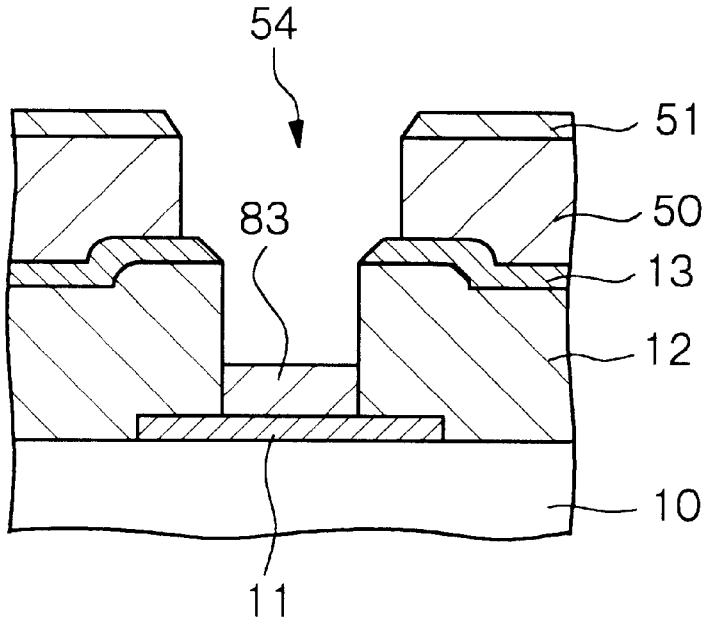
FIG. 29B is a schematic end view showing the step of forming a base portion, in the process for the production of the field emission device in Example 8.
Figure 30:
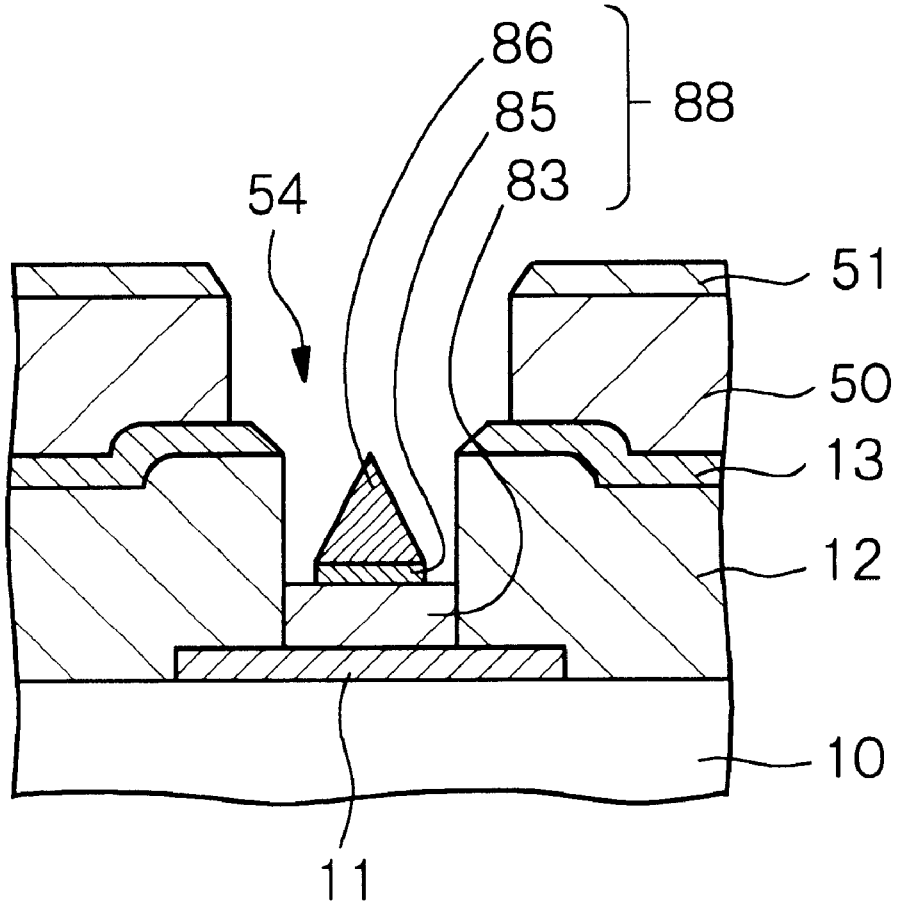
FIG. 30 following

Example 8 is a variant of Example 7. The field emission device of Example 8 differs from the field emission device of Example 7 in that a second insulating layer is further formed on the insulating layer and the gate electrode and that a focus electrode is formed on the second insulating layer. FIG. 28 shows a schematic partial end view of the field emission device of Example 8, and FIGS. 29A, 29B and 30 show the process for the production thereof. In these Figures, those portions which are the same as those in FIG. 17 are shown by the same reference numerals, and detailed explanations thereof are omitted.

As shown in FIG. 28, the field emission device of Example 8 comprises a support 10 formed, for example, of a glass substrate, a cathode electrode 11 composed of chromium (Cr), an insulating layer 12 composed of $SiO_2$, a gate electrode 13 composed of chromium, a second insulating layer 50 composed of $SiO_2$, a focus electrode 51 composed of chromium and an electron emitting portion 88. A plurality of stripe-shaped cathode electrodes 11 are arranged on the support 10. The insulating layer 12 is formed on the support 10 and the cathode electrode 11, and further, the gate electrode 13 is formed on the insulating layer 12. The second insulating layer 50 is formed on the gate electrode 13 and the insulating layer 12, and further, the focus electrode 51 is formed on the second insulating layer 50. The focus electrode 51 is a member provided for preventing the divergence of paths of electrodes emitted from an electron emitting portion in a so-called high-voltage type display in which the potential difference between an anode electrode and a cathode electrode is several thousands volts and the distance between these two electrodes is relatively large. A relatively negative voltage is applied thereto from a focus power source (not shown). By improving the convergence of paths of the emitted electrons, an optical crosstalk between pixels is decreased, color mixing is prevented when color displaying is performed in particular, and further, a higher fineness of an image on a display screen can be attained by further finely dividing each pixel. An etching stop layer 52 shown in FIG. 18B may be formed on the focus electrode 51.

An opening portion 54 is formed so as to penetrate through the focus electrode 51, the second insulating layer 50, the gate electrode 13 and the insulating layer 12. The wall surface of the opening portion 54 is constituted of processed surfaces of the focus electrode 51, the second insulating layer 50, the gate electrode 13 and the insulating layer 12. For attaining a smooth path for the emitted electrons, preferably, the opening portion as the whole is formed so as to decrease in dimensions from the upper portion side to the bottom portion side. Further, the wall surface of the opening portion formed in the second insulating layer 50 is positioned backward as compared with the edge portion of the focus electrode 51, the wall surface of the opening portion formed in the insulating layer 12 is positioned backward as compared with the edge portion of the gate electrode 13, and the focus electrode 51 and the gate electrode 13 are decreased in thickness toward their edge portions, whereby there is formed a structure in which an electric field having a desired intensity can be formed effectively in the opening portion 54. The electron emitting portion 88 is formed in the opening portion 54 and comprises a base portion 83 and a sharpened portion 86 having the conical form (specifically, the form of a circular cone) formed on the base portion 83. The base portion 83 is constituted of a polysilicon layer containing an impurity, and the sharpened portion 86 is constituted of a tungsten layer. An electrically conductive adhesive layer 85 is formed between the base portion 83 and the sharpened portion 86. The adhesive layer 85 is composed of TiN, while it is not a functionally essential component for the electron emitting portion 88 but is formed for a production-related reason.

The process for the production of the field emission device of Example 8 will be explained with reference to FIGS. 29A, 29B and 30 hereinafter. In Examples to be described hereinafter, including Example 8, process conditions in already described Tables can be employed as required in each process unless otherwise specified.

[Step-800]

First, procedures up to the formation of the focus electrode 51 are carried out in the same manner as in [Step-500] to [Step-510] in Example 5. Then, a resist layer having a predetermined pattern is formed on the focus electrode 51, and the focus electrode 51, the second insulating layer 50, the gate electrode 13 and the insulating layer 12 are consecutively etched with using the above resist layer 53 as a mask, whereby there can be formed the circular opening portion 54 having a bottom portion where the cathode electrode 11 is exposed as shown in FIG. 29A. The opening diameter of the opening portion 54 is not uniform in the direction of a depth, and the opening portion 54 has a diameter of approximately 0.5 $\mu$m in the vicinity of the focus electrode 51 and has a diameter of 0.35 $\mu$m in the vicinity of the gate electrode 13. In FIG. 29A, the wall surfaces of the opening portion 54 formed in the second insulating layer 50 and the insulating layer 12 are perpendicular to the surface of the support 10, 30 while they may be slanted by employing the condition shown in Table 16 for the etching.

[step-810]

Then, as shown in FIG. 29B, the base portion 83 is formed so as to be filled in the bottom portion of the opening portion 54, more specifically in that portion of the opening portion 54 which penetrates through the insulating layer 12. The above base portion 83 can be formed by a process including a combination of the formation of a first conductive material layer for forming the base portion on the entire surface, flattening with a planarization layer and etching in the same manner as in [Step-700] in Example 7. As the first conductive material layer, this Example uses a polysilicon layer containing phosphorus (P).

[Step-820]

Then, as shown in FIG. 30, the adhesive layer 85 and the sharpened portion 86 of tungsten having the form of a circular cone are formed on the base portion 83, to complete the electron emitting portion 88. The sharpened portion 86 can be formed by a process including a combination of the formation of the electrically conductive adhesive layer 85 on the entire surface, the formation of a second conductive material layer (not shown) for forming the sharpened portion on the entire surface, the formation of a mask material layer (not shown), the filling of the mask material layer in a recess (not shown) and the etching of the second conductive material layer, the mask material layer and the adhesive layer 85 in the same manner as in [Step-710] to [Step-730] in Example 7. Then, the wall surfaces of the opening portion 54 formed in the insulating layer 12 and the second insulating layer 50 are etched backward by isotropic etching, whereby the field emission device shown in FIG. 28 is obtained. The display according to the third aspect of the present invention, more specifically the third-A aspect can be constituted of such field emission devices. The display according to the third-A aspect of the present invention can be constituted by the same process as that explained in Example 1.

EXAMPLE 9

Figure 31A:
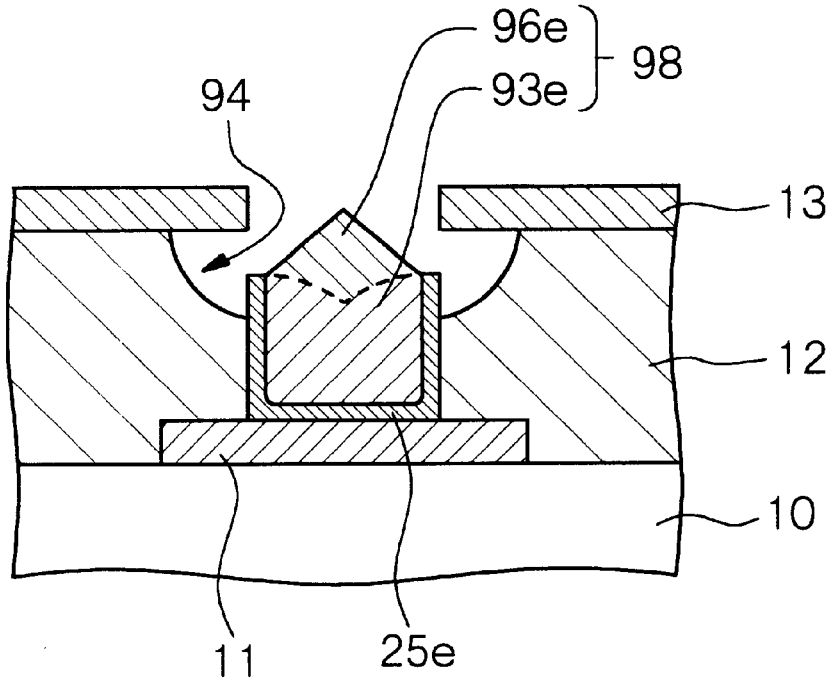
FIG. 31A is a schematic end view of field emission device in Example 9.
Figure 31B:
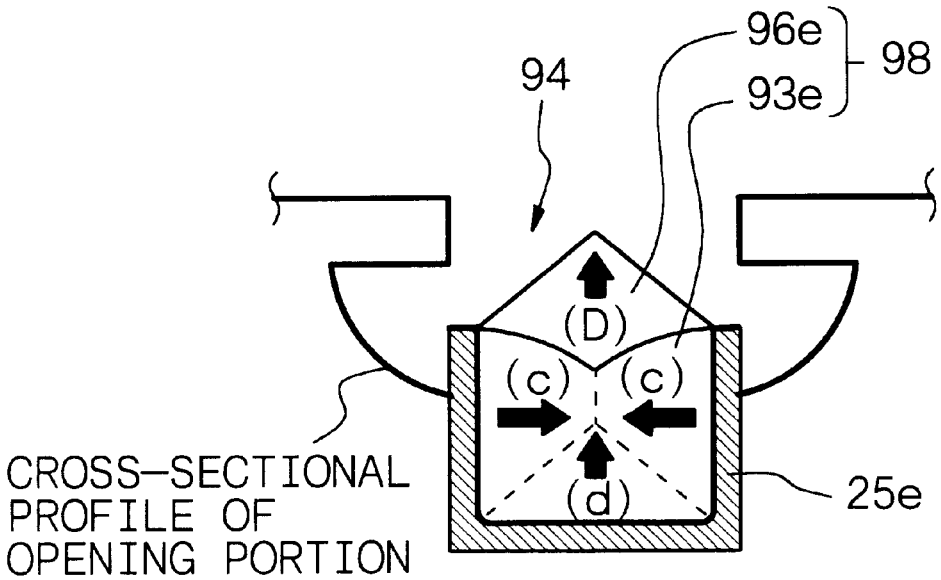
FIG. 31B is a schematic view for explaining the direction of the crystal boundaries of an electron emitting portion.

Example 9 is directed to the field emission device according to the third aspect of the present invention, more specifically the third-B aspect, and the production process according to the second aspect of the present invention. In the foregoing Example 7, the base portion and the sharpened portion constituting the electron emitting portion are composed of different electrically conductive materials, while the base portion and the sharpened portion in Example 9 are composed of the same electrically conductive material. FIGS. 31A and 31B show schematic partial end views of the field emission device of Example 9, and FIGS. 32A, 32B, 33A, 33B, 34A, 34B, 35A and 35B show the process for the production thereof. In these Figures, those portions which are the same as those in FIGS. 1A and 1B are shown by the same reference numerals, and detailed explanations thereof are omitted.

As shown in FIG. 31A, the field emission device of Example 9 has an electron emitting portion 98 comprising a base portion 93*e* composed of tungsten and a conical sharpened portion 96*e* which is similarly composed of tungsten and is formed on the base portion 93*e*. An electrically conductive adhesive layer 25*e* is formed between the base portion 93*e* and the cathode electrode 11. An opening portion 94 is formed by removing a portion of the insulating layer 12 from immediately below the gate electrode 13 to the upper end portion of the base portion 93*e*.

FIG. 31B schematically shows directions of crystal boundaries of the electron emitting portion 98. When a tungsten layer is formed by a CVD method, tungsten generally undergoes crystal growth in the direction nearly perpendicular to the growth plane. Inside the opening portion, therefore, there are a region (c) where the crystal boundary is formed in the nearly horizontal direction from the wall surface and a region (d) where the crystal boundary is formed in the direction nearly perpendicular to the bottom surface. In such a narrowly limited space as the opening portion, the regions growing from the wall surface and the bottom surface finally collide with each other, and a plane where the collision takes place form a growth boundary plane. In FIG. 31B, dotted lines show the growth boundary plane. The growth boundary plane between the regions (c) and (d) has a profile nearly equivalent to a surface of a cone. In the electron emitting portion 98, that portion which mainly serves to emit electrons is the sharpened portion 96*e*. In the field emission device of Example 9, the sharpened portion 96*e* is constituted of the region (D) having a nearly perpendicular crystal boundary, which is remarkably advantageous in view of electron emission efficiency and a lifetime.

The process for the production of the field emission device of Example 9 will be explained with reference to FIGS. 32A, 32B, 33A, 33B, 34A, 34B, 35A and 35B.

[Step-900]

Figure 32A:
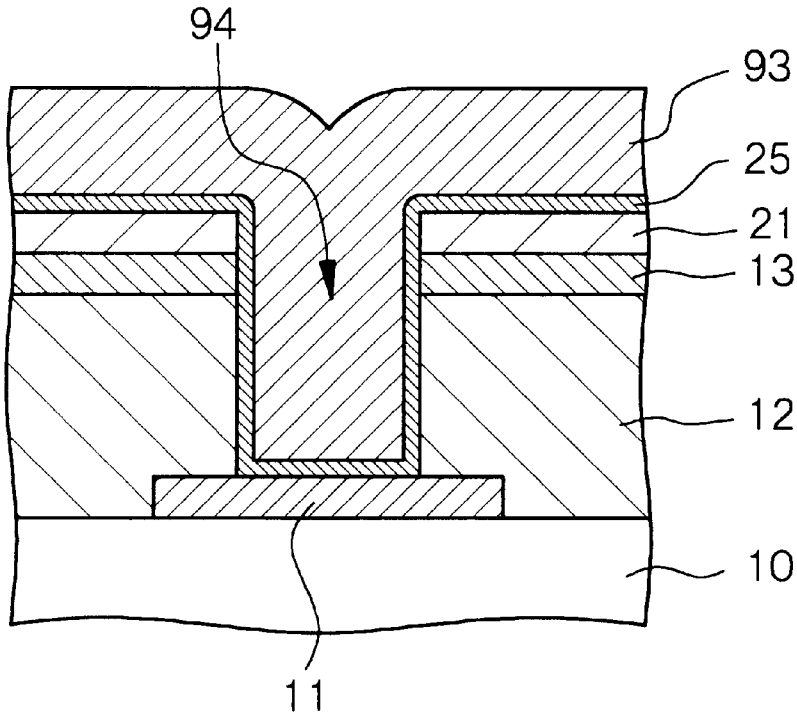
FIG. 32A is a schematic end view showing the step of forming a first conductive material layer for forming a base portion.
Figure 32B:
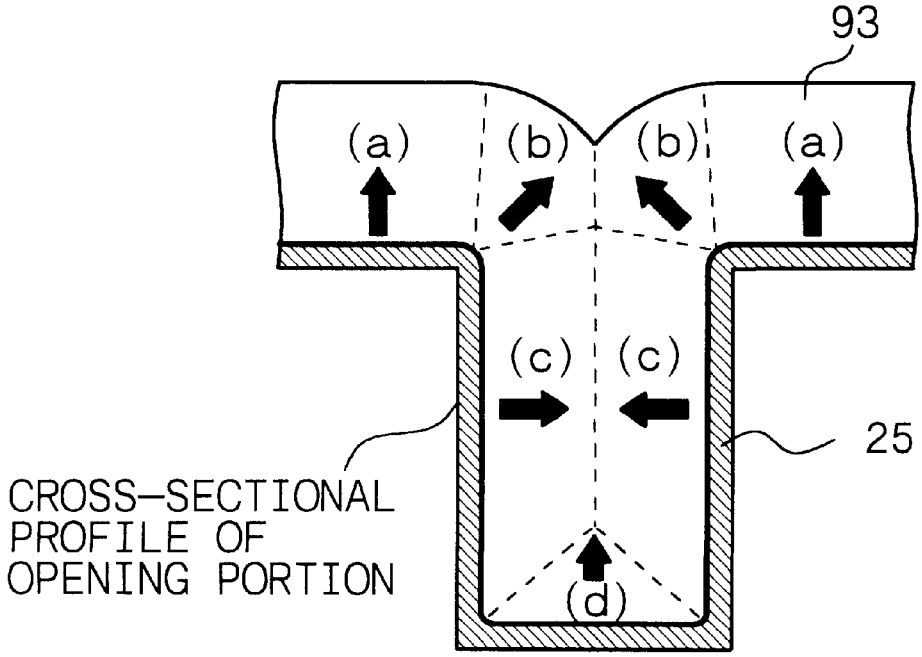
FIG. 32B is a schematic view for explaining the direction of crystal boundaries of the first conductive material layer, in the process for the production of the field emission device in Example 9.

Procedures up to the formation of the electrically conductive adhesive layer 25 are carried out in the same manner as in [Step-200] to [Step-210] in Example 2. However, the opening portion is indicated by reference numeral 94 (see FIG. 32A). Then, a first conductive material layer 93 for forming the base portion is formed on the entire surface including the inside of the opening portion 94. The first conductive material layer 93 is a 0.7 $\mu$m thick tungsten (W) layer formed by a low pressure CVD method. FIG. 32B shows the direction of crystal boundaries of the first conductive material layer 93 for forming the base portion. On the bottom surface of the opening portion 94 is formed the region (d) which is surrounded by a conical growth boundary plane and has a crystal boundary oriented nearly perpendicularly as described above, and in a portion along the wall surface of the opening portion 94 is formed the region (c) which has a crystal boundary oriented nearly horizontally. Outside the opening portion 94 is formed a region (a) having a crystal boundary oriented nearly perpendicularly to the surface of the insulating layer 12. Further, in a corner portion of the opening portion 94 is formed a transition region (b) which is in a transition between the regions (a) and (b) has a crystal boundary oriented obliquely.

[Step-910]

Figure 33A:
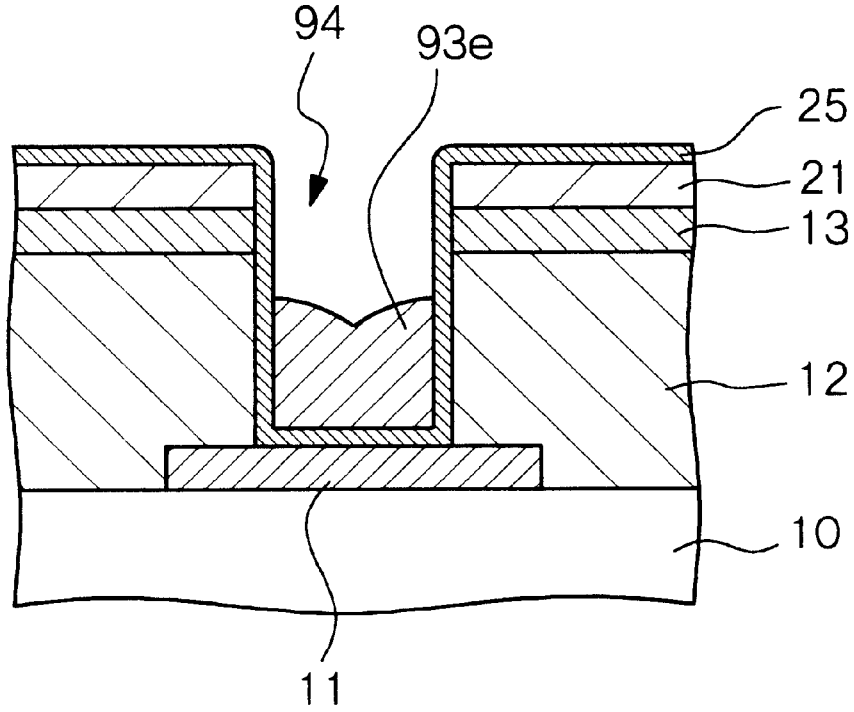
FIG. 33A following
Figure 33B:
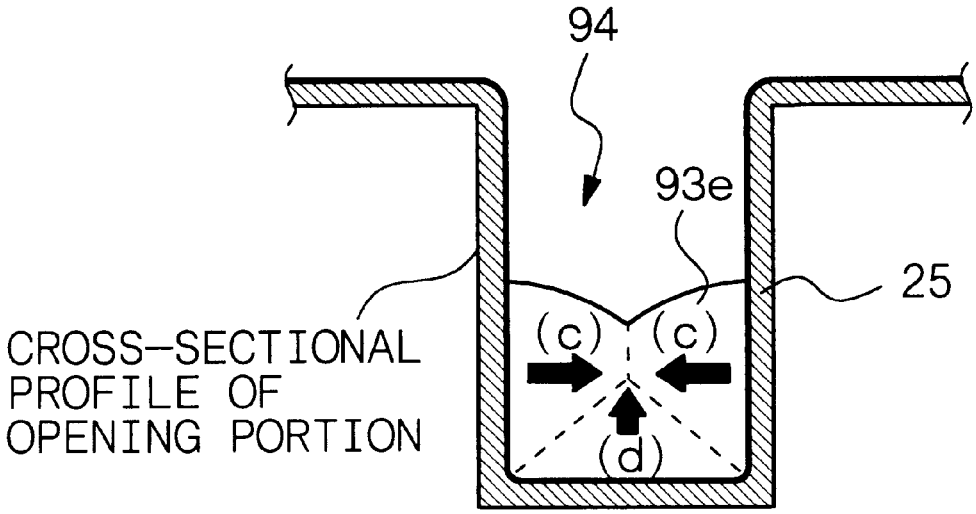
FIG. 33B is a schematic view for explaining the direction of crystal boundaries of the base portion, in the process for the production of the field emission device in Example 9.

Then, as shown in FIGS. 33A and 33B, the first conductive material layer 93 is etched to form the base portion 93*e* which has a thickness of approximately 0.5 $\mu$m so as to be filled in the bottom portion of the opening portion 94. As a surface of the base portion 93*e*, the region (c) is exposed as shown in FIG. 33B.

[Step-920]

Figure 34A:
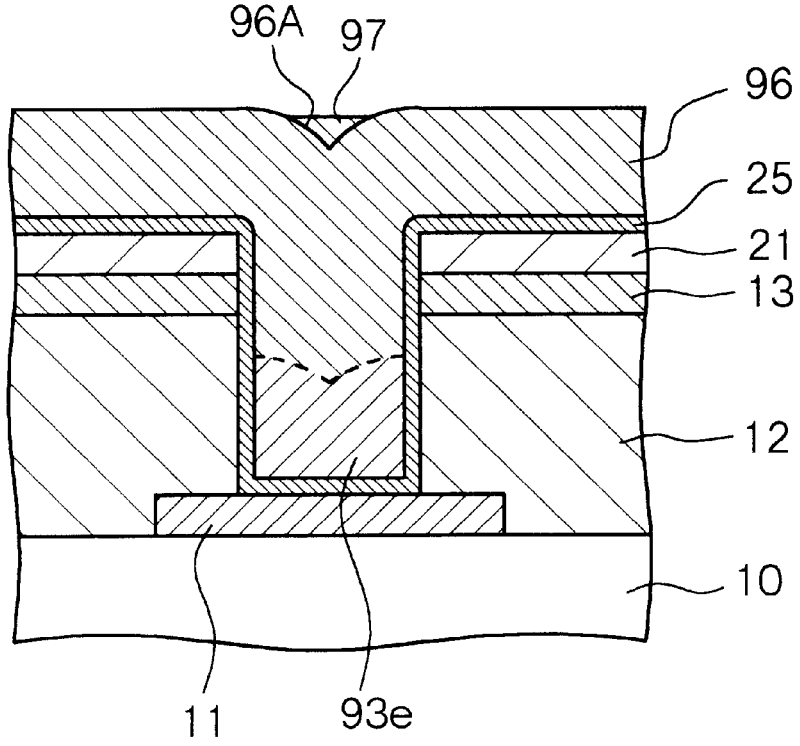
FIG. 34A following
Figure 34B:
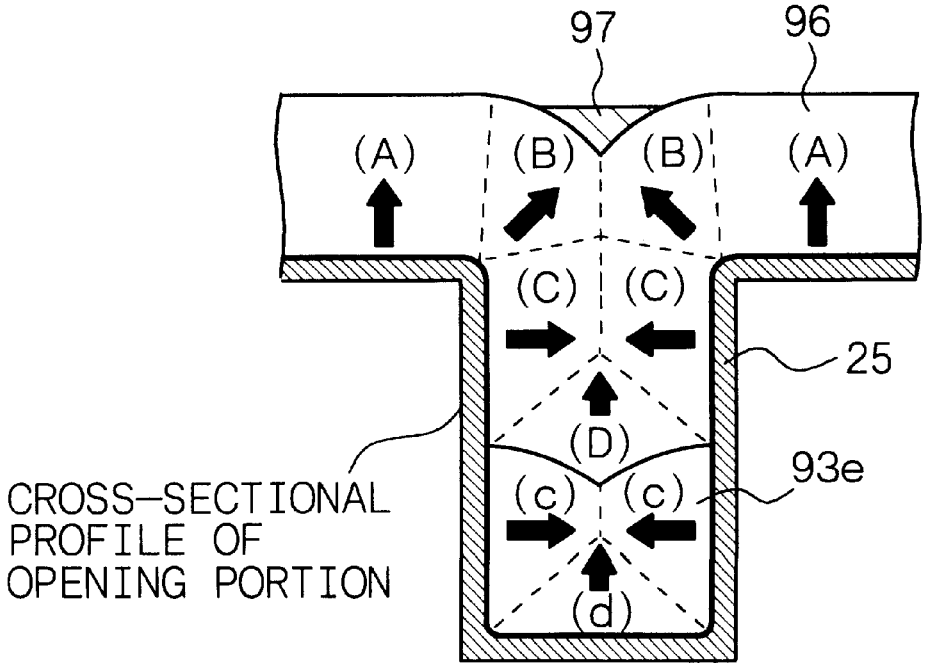
FIG. 34B is a schematic end view for explaining the direction of crystal boundaries of the base portion and the second conductive material layer, in the process for the production of the field emission device in Example 9.
Figure 35A:
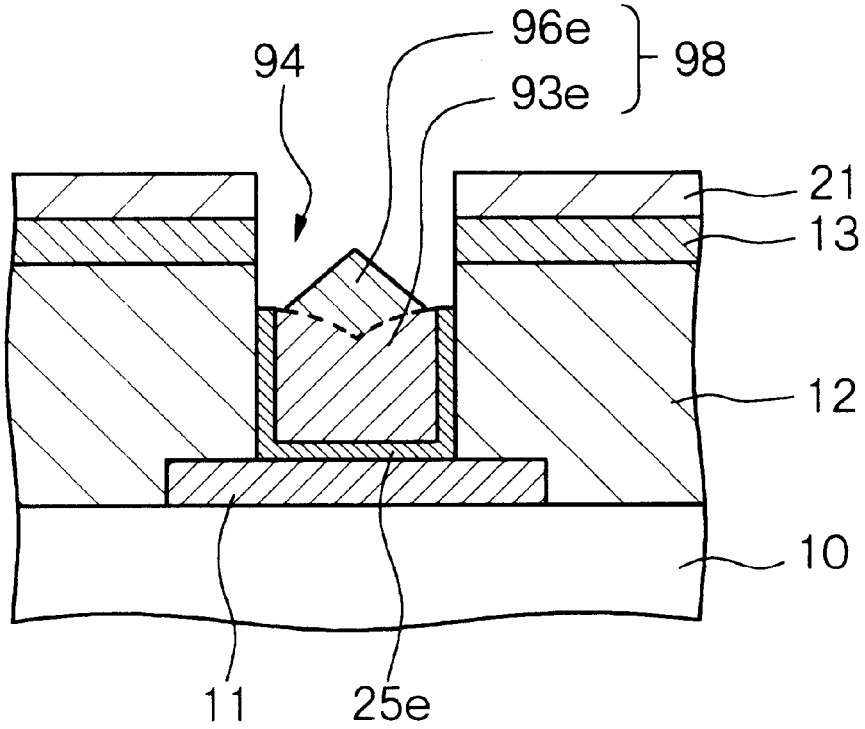
FIG. 35A following
Figure 35B:
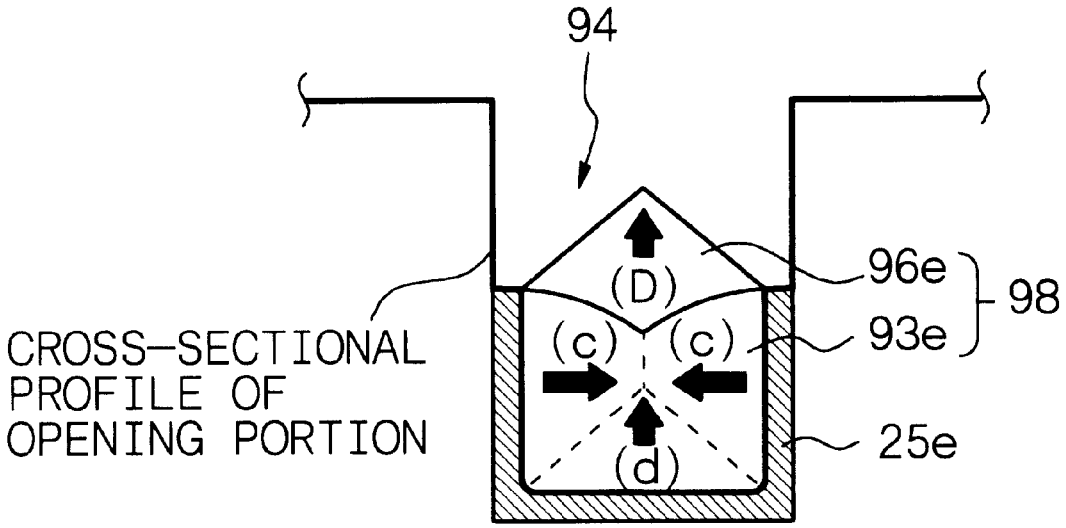
FIG. 35B is a schematic view for explaining the direction of crystal boundaries of the electron emitting portion, in the process for the production of the field emission device in Example 9.

Then, a second conductive material layer 96 for forming the sharpened portion is formed on the entire surface including the residual portion of the opening portion 94. The second conductive material layer 96 is a 0.7 $\mu$m thick tungsten layer formed by a low pressure CVD method. FIG. 34B shows directions of crystal boundaries of the second conductive material layer 96 for forming the sharpened portion. In [Step-920], the surface of the base portion 93*e* becomes a new bottom surface of the opening portion 94, so that the region (D) which is surrounded by a conical growth boundary plane and has a crystal boundary oriented nearly perpendicularly is formed on the surface of the base portion 93*e*. The mode of each of the other regions (A), (B) and (C) is the same as the mode of each of regions (a), (b) and (c) in the first conductive material layer 93 for forming the base portion. A recess 96A is formed in the surface of the second conductive material layer 96 on the basis of a step between the upper end portion and the bottom portion of the opening portion 94. Then, a mask material layer 97 is formed in the recess 96A in the surface of the second conductive material layer 96. This mask material layer 97 can be formed by etching the mask material layer (not shown) formed on the entire surface until the flat plane of the second conductive material layer 96 is exposed (see FIGS. 34A and 34B).

[Step-930]

Then, the second conductive material layer 96, the mask material layer 97 and the adhesive layer 25 are etched together, to form a conical sharpened portion 96*e* depending upon the largeness or smallness of the resist selectivity ratio according to the foregoing mechanism, whereby the electron emitting portion 98 is completed. In this case, the etching selectivity between the second conductive material layer 96 and the mask material layer 97 is optimized, whereby the surface of the sharpened portion 96 can be brought into conformity with the growth boundary plane, while a non-conformity to some extent is allowable. That is, when the conical form of the sharpened portion 96*e* becomes more moderate, the sharpened portion 96*e* is still constituted of the region (D) alone. When the above conical form becomes steeper, however, the sharpened portion 96*e* includes the region (C). The adhesive layer 25*e* remains between the base portion 93*e* and the cathode electrode 11. Then, the wall surface of the opening portion 94 formed in the insulating layer 12 is etched backward, whereby the field emission device shown in FIGS. 31A and 31B can be obtained. The display according to the third aspect of the present invention, more specifically the third-B aspect can be constituted of such field emission devices. The display according to the third-B aspect of the present invention can be constituted by the same process as that explained in Example 1.

EXAMPLE 10

Figure 36A:
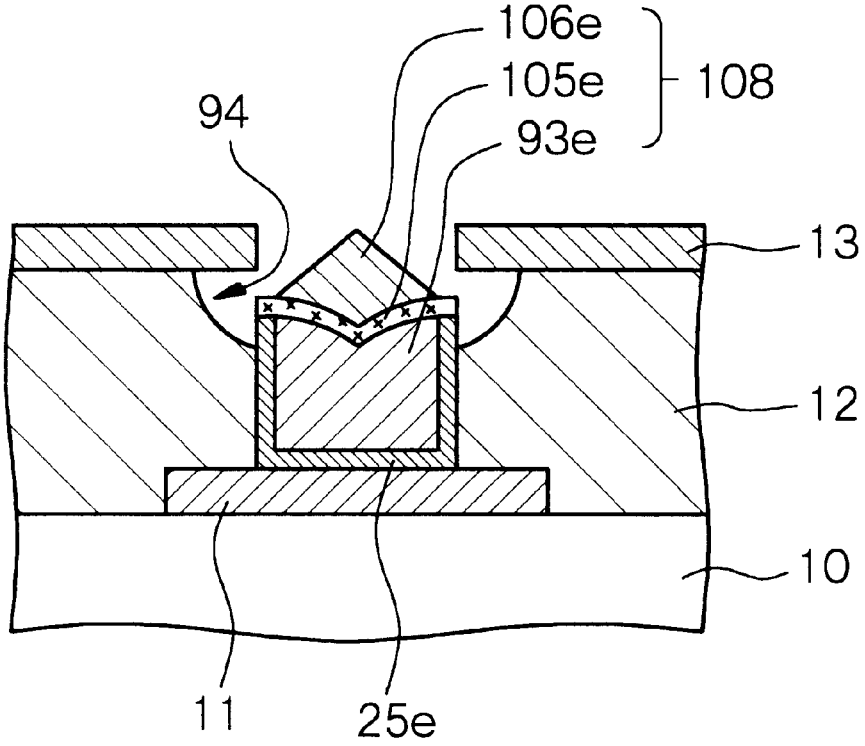
FIG. 36A is a schematic end view of a field emission device in Example 10.
Figure 36B:
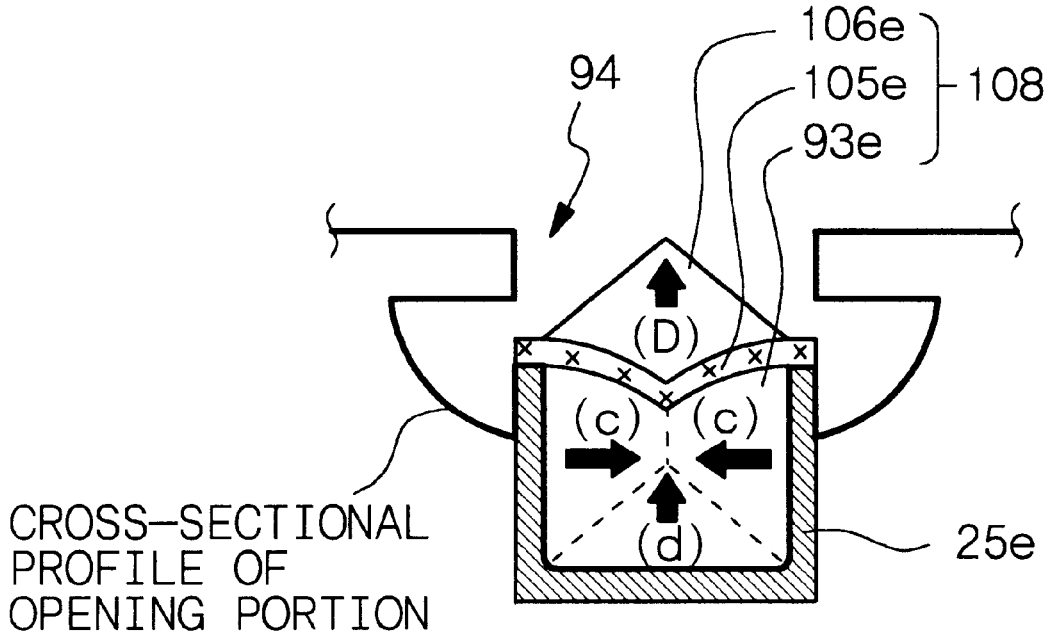
FIG. 36B is a schematic view for explaining the direction of crystal boundaries of an electron emitting portion.

Example 10 is a variant of Example 9. The field emission device of Example 10 differs from the counterpart of Example 9 in that an adhesive layer is formed between the base portion and the sharpened portion as well. FIGS. 36A and 36B show schematic partial end views of the field emission device of Example 10, and FIGS. 37A, 37B, 38A, 38B, 39A and 39B show the process for the production thereof. In these Figures, those portions which are the same as those in FIGS. 31A and 31B are shown by the same reference numerals, and detailed explanations thereof are omitted.

As shown in FIGS. 36A and 36B, the field emission device of Example 10 has an electron emitting portion 108 comprising a base portion 93*e* composed of tungsten and a sharpened portion 106*e* which is composed of tungsten and formed on the basis portion 93*e* and which has a conical form (specifically, the form of a circular cone). An electrically conductive adhesive layer 25*e* of TiN is formed between the base portion 93*e* and the cathode electrode 11, and an electrically conductive adhesive layer 105*e* of TiN is formed between the base portion 93*e* and the sharpened portion 106*e*. In this Example, the adhesive layer 105*e* is included in the electron emitting portion 108 for the convenience, while it is not a functionally essential component for the field emission device but is formed for a production-related reason. The opening portion 94 is formed by removing a portion of the insulating layer 12 from immediately below the gate electrode 13 to the upper end portion of the base portion 93*e*. The sharpened portion 106*e* of the electron emitting portion 108 is constituted of a region (D) which is composed of a crystalline conductive material and has a crystal boundary oriented nearly perpendicularly. The region (D) is spaced from the region (c) constituting the surface of the base portion 93*e* through the adhesive layer 105*e*, so that it grows almost without being affected by the orientation of the region (c). The region (D) therefore has an excellent orientation as compared with Example 9 and is improved in durability against repeated emission of electrons.

Figure 37A:
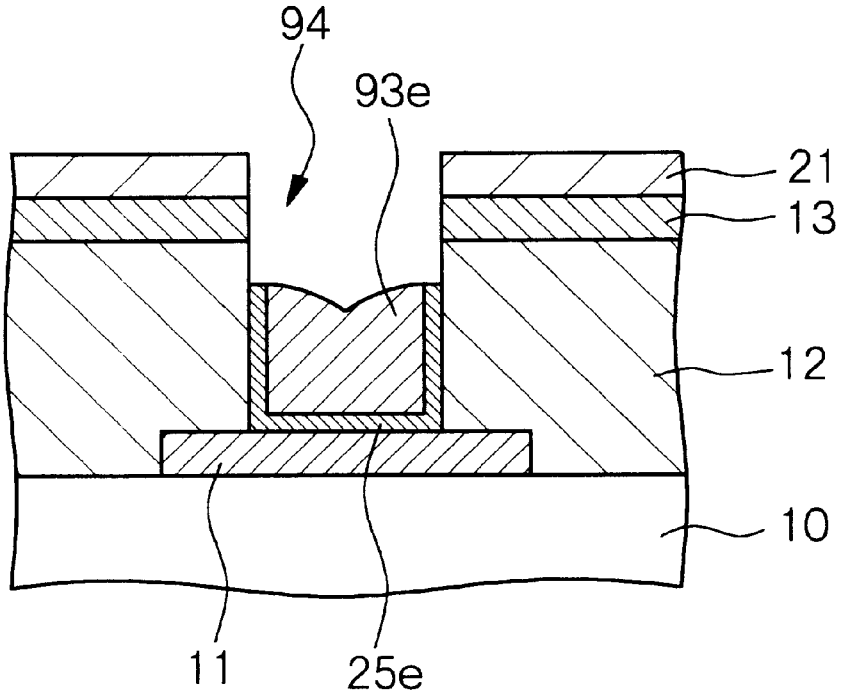
FIG. 37A is a schematic end view showing the step of forming a base portion.
Figure 37B:
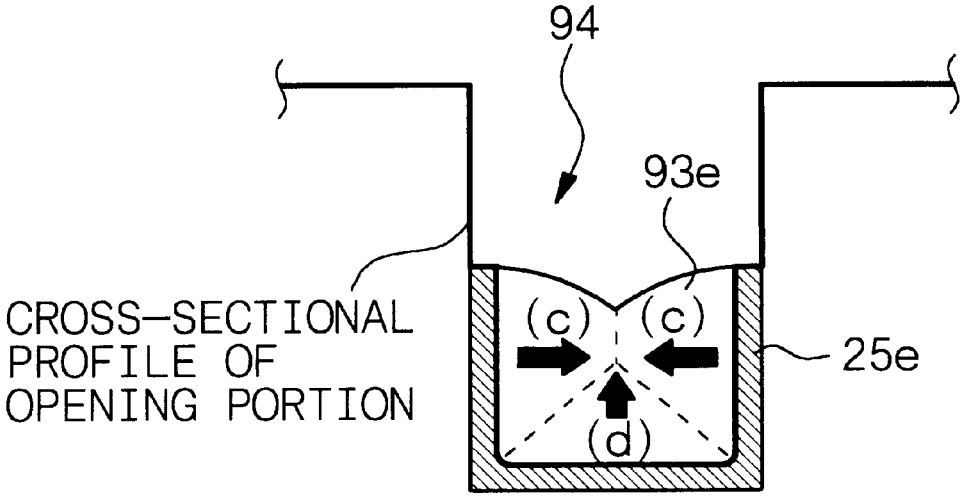
FIG. 37B is a schematic view for explaining the direction of crystal boundaries of the base portion, in the process for the production of the field emission device in Example 10.
Figure 38A:
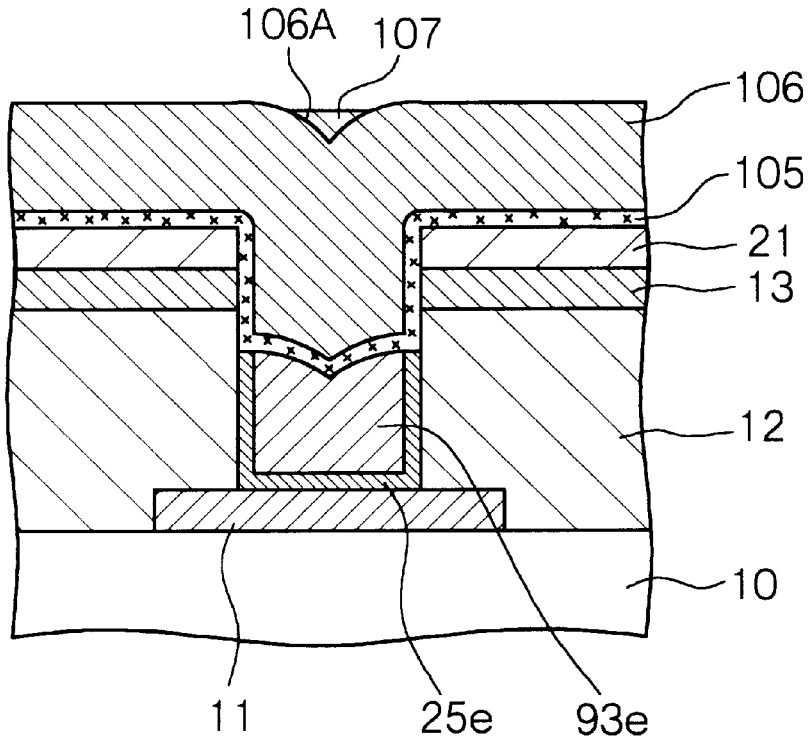
FIG. 38A following
Figure 38B:
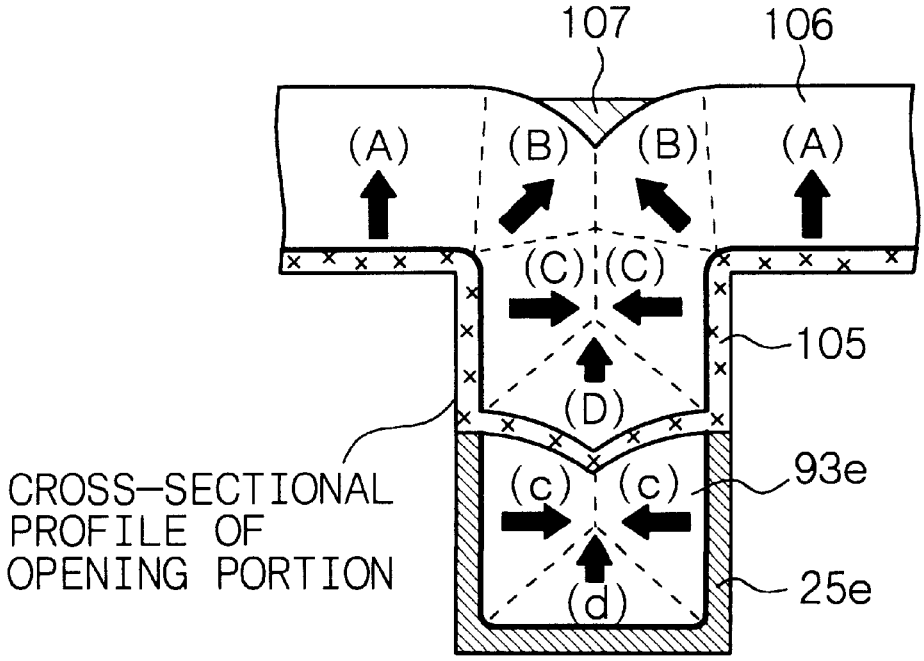
FIG. 38B is a schematic view for explaining the direction of crystal boundaries of the base portion and the second conductive material layer, in the production of the field emission device in Example 10.
Figure 39A:
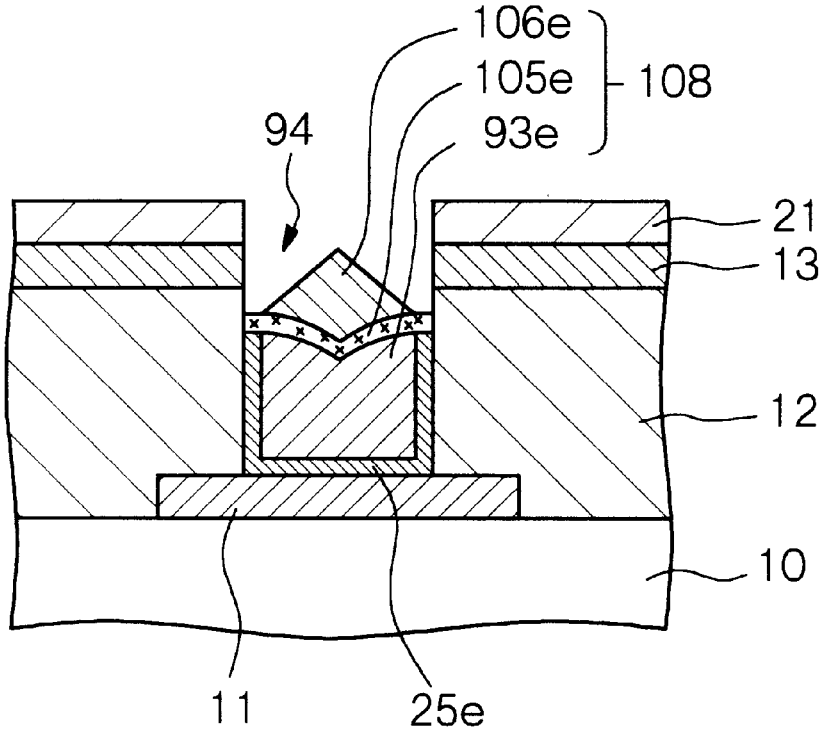
FIG. 39A following
Figure 39B:
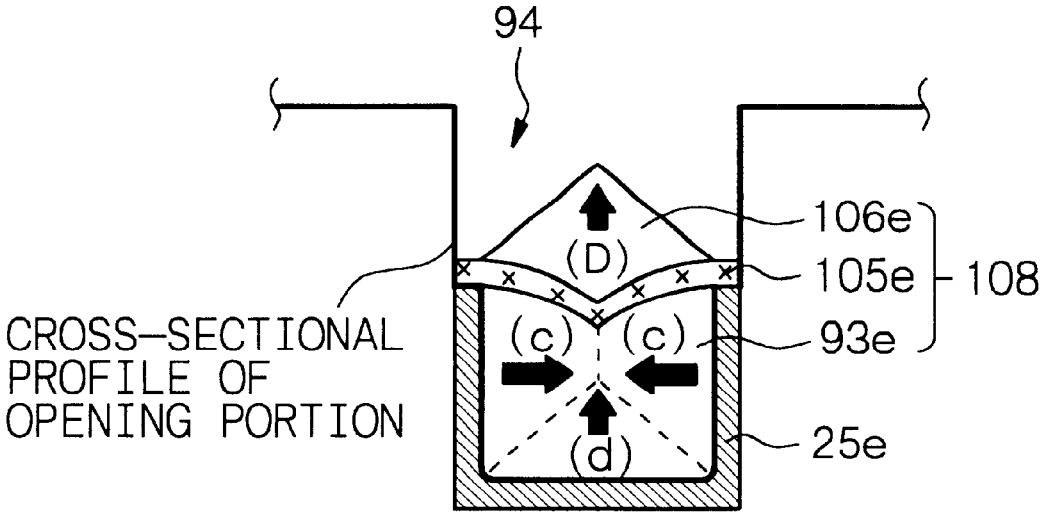
FIG. 39B is a schematic view for explaining the direction of crystal boundaries of the electron emitting portion, in the process for the production of the field emission device in Example 10.

The process for the production of the field emission device of Example 10 will be explained with reference to FIGS. 37A, 37B, 38A, 38B, 39A and 39B hereinafter. FIGS. 37A, 38A and 39A are schematic end views of the field emission device, and FIGS. 37B, 38B and 39B are schematic views of the electron emitting portion for explaining the crystal boundaries of the electron emitting portion.

[Step-1000]

First, the steps similar to [Step-900] to [Step-910] in Example 9 are carried out to form the electrically conductive adhesive layer 25 of tungsten and to form the first conductive material layer 93 of tungsten for forming a base portion on the entire surface including the inside of the opening portion 94. Then, the adhesive layer 25 and the first conductive material layer 93 are etched under a condition where the etch rates of the adhesive layer 25 and the first conductive material layer 93 are nearly equal, whereby the base portion 93*e* is formed so as to be filled in the bottom portion of the opening portion 94 as shown in FIG. 37A. As a surface of the base portion 93*e*, a region (c) having a crystal boundary oriented nearly horizontally is exposed as shown in FIG. 37B. In this case, the adhesive layer 25 is also etched, so that the adhesive layer 25*e* remains only in portions between the base portion 93*e* and the opening portion 94 and between the base portion 93*e* and the cathode electrode 11.

[Step-1010]

Then, as shown in FIGS. 38A and 38B, an electrically conductive adhesive layer 105 of TiN and a second conductive material layer 106 of tungsten for forming a sharpened portion are consecutively formed on the entire surface including the residual portion of the opening portion 94. The second conductive material layer 106 grows above the base portion 93*e*, more accurately, on the surface of the adhesive layer 105 formed on the base portion 93*e* as a new bottom surface of the opening portion, so that a region of the second conductive material layer 106 formed above the base portion 93*e* is a region (D) having a crystal boundary oriented nearly perpendicularly. Then, [Step-920] in Example 9 is repeated to leave the mask material layer 107 in the recess 106A in the surface of the second conductive material layer 106.

[Step-1020]

Then, the second conductive material layer 106, the mask material layer 107 and the adhesive layer 105 are etched together, to form a conical sharpened portion 106*e* having the form of a circular cone depending upon the largeness or smallness of the resist selectivity ratio according to the foregoing mechanism, whereby the electron emitting portion 108 is completed. Then, the wall surface of the portion 94 formed in the insulating layer 12 is etched backward, whereby the field emission device shown in FIGS. 36A and 36B can be obtained. The display according to the third aspect of the present invention, more specifically the third-B aspect can be constituted of such field emission devices. The display according to the third-B aspect of the present invention can be constituted by the same process as that explained in Example 1.

EXAMPLE 11

Figure 40A:
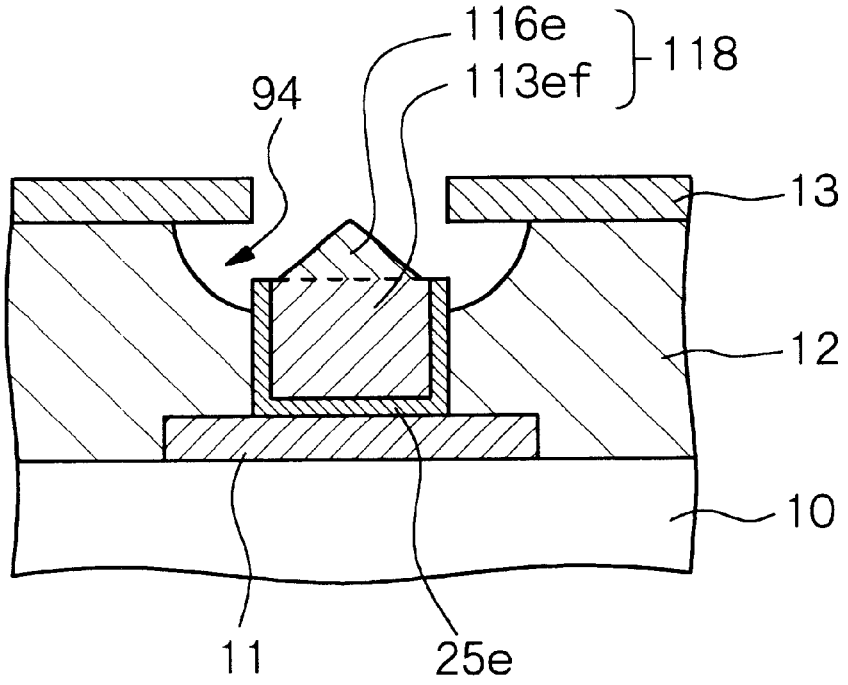
FIG. 40A is a schematic end view of a field emission device in Example 11.
Figure 40B:
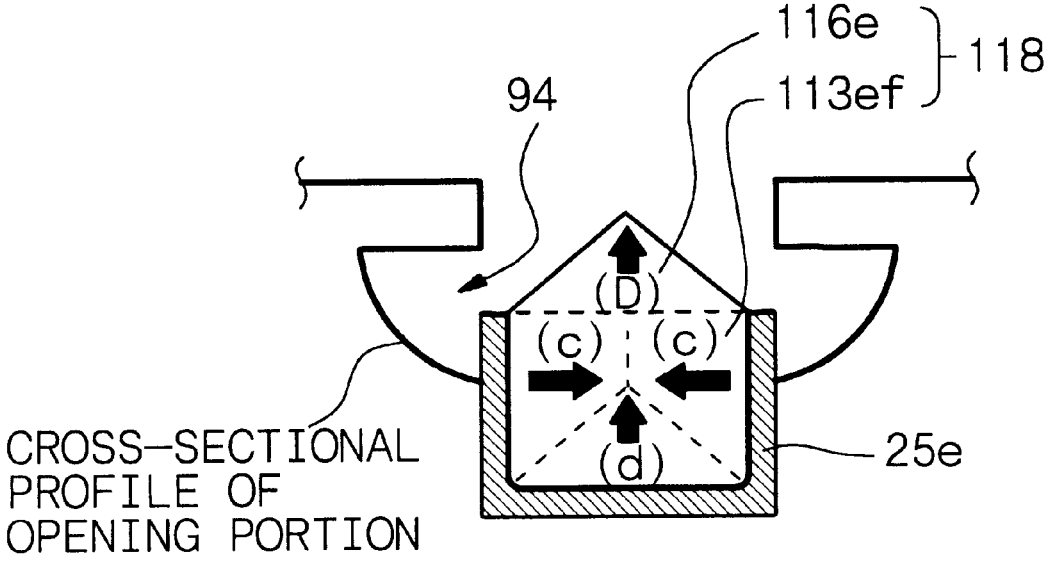
FIG. 40B is a schematic view for explaining the direction of crystal boundaries of an electron emitting portion.
Figure 41A:
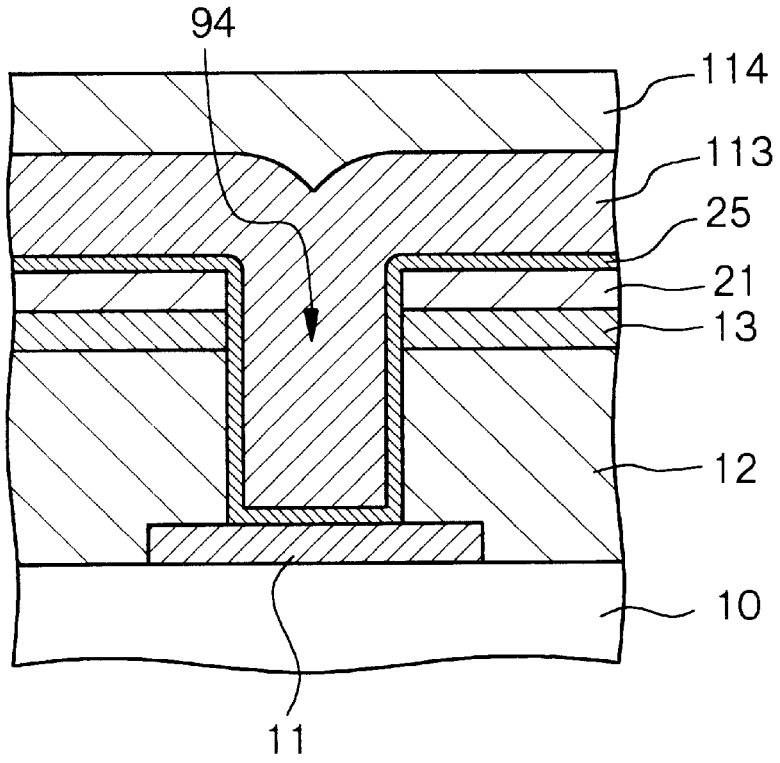
FIG. 41A is a schematic end view showing the step of forming a first conductive material layer for forming a base portion and a planarization layer.
Figure 41B:
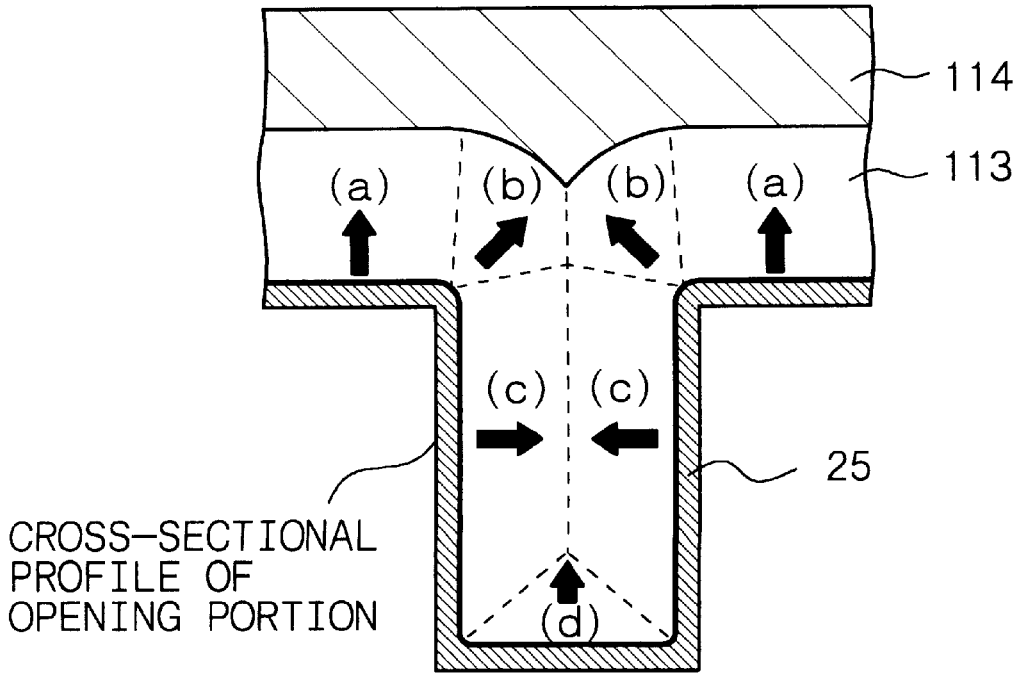
FIG. 41B is a schematic view for explaining the direction of crystal boundaries of the first conductive material layer, in the process for the production of the field emission device in Example 11.

Example 11 is another variant of Example 9. The field emission device of Example 11 differs from the counterpart of Example 9 in that the surface of the base portion is flattened by etching the surface. That is, as shown in FIGS. 40A and 40B, the electron emitting portion 118 of the field emission device includes a base portion 113*ef* having a flat upper surface and a circular-cone-shaped sharpened portion 116*e* formed on the base portion 113*ef*. Since the base portion 113*ef* has a flat upper surface, it is made easier to control the crystal boundary of the sharpened portion 116*e* so as to provide an orientation in the nearly perpendicular direction without separating the base portion 93*e* and he sharpened portion 106*e* by means of the adhesive layer 105*e* in Example 10. An electrically conductive adhesive layer 25*e* is formed between the base portion 113*ef* and the cathode electrode 11. An opening portion 94 is formed by removing a portion of the insulating layer 12 from immediately below the gate electrode 13 to the upper end portion of the base portion 113*ef*.

The process for the production of the field emission device of Example 11 will be explained with reference to FIGS. 41A, 41B, 42A, 42B, 43A, 43B, 44A and 44B hereinafter. FIGS. 41A, 42A, 43A and 44A are schematic end views of the field emission device, and FIGS. 41B, 42B, 43B and 44B are schematic views of the electron emitting portion for explaining the crystal boundaries of the electron emitting portion.

[Step-1100]

First, the same procedures as those in [Step-900] in Example 9 are carried out to form an electrically conductive adhesive layer 25 of TiN and a first conductive material layer 113 for forming the base portion on the entire surface including the inside of the opening portion 94. The first conductive material layer 113 is a tungsten layer formed by a CVD method. Then, a planarization layer 114 of a resist material is formed on the entire surface so as to form a flat surface (See FIG. 41).

[Step-1110]

Figure 42A:
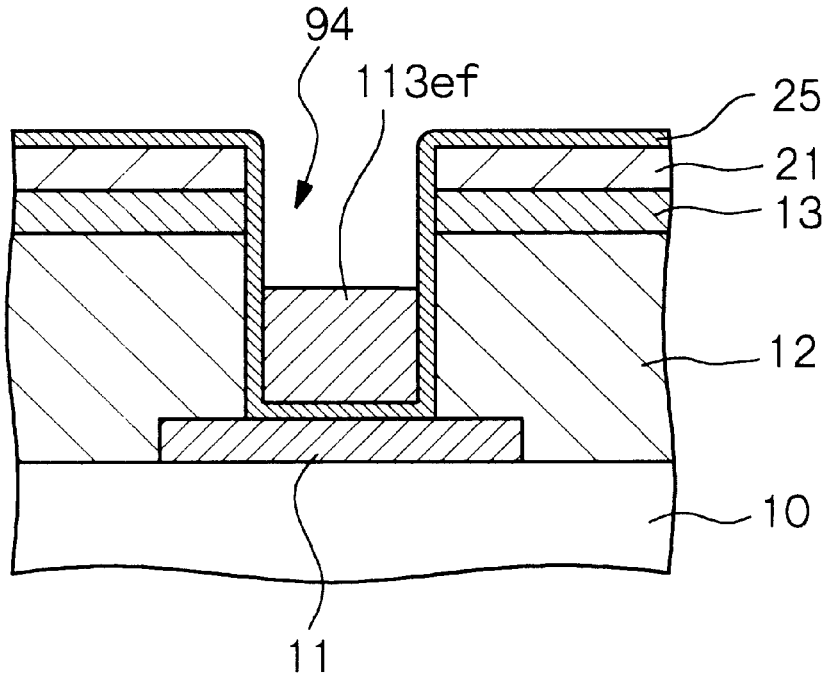
FIG. 42A following
Figure 42B:
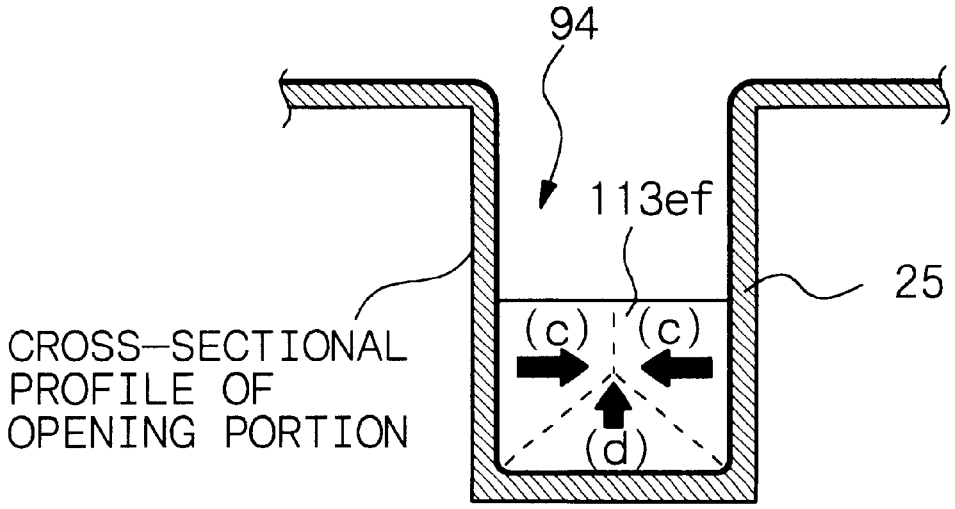

Then, the planarization layer 114 and the first conductive material layer 113 are etched under a condition where the etch rates of these two layers are equal to each other, whereby the bottom portion of the opening portion 94 is filled with the base portion 113*ef* having a flat upper surface as shown in FIGS. 42A and 42B. As a surface of the base portion 113*ef*, a region (c) having a crystal boundary oriented nearly horizontally is exposed. On this state, the adhesive layer 25 is retained for maintaining the adhesiveness of the second conductive material layer 116 to be formed in the subsequent step for forming a sharpened portion to an insulating layer 12 and an etching stop layer 21.

[Step-1120]

Figure 43A:
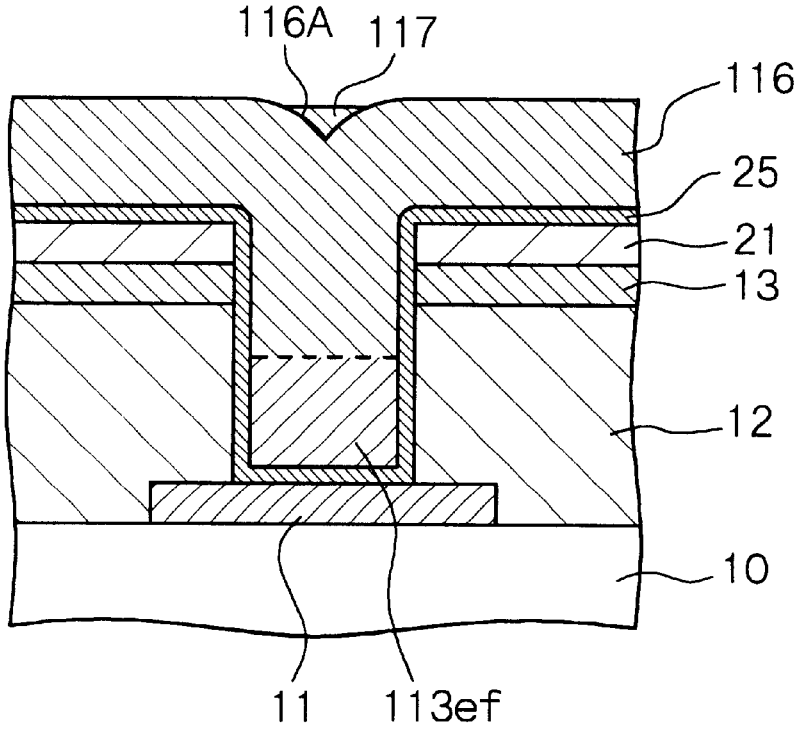
FIG. 43A following
Figure 43B:
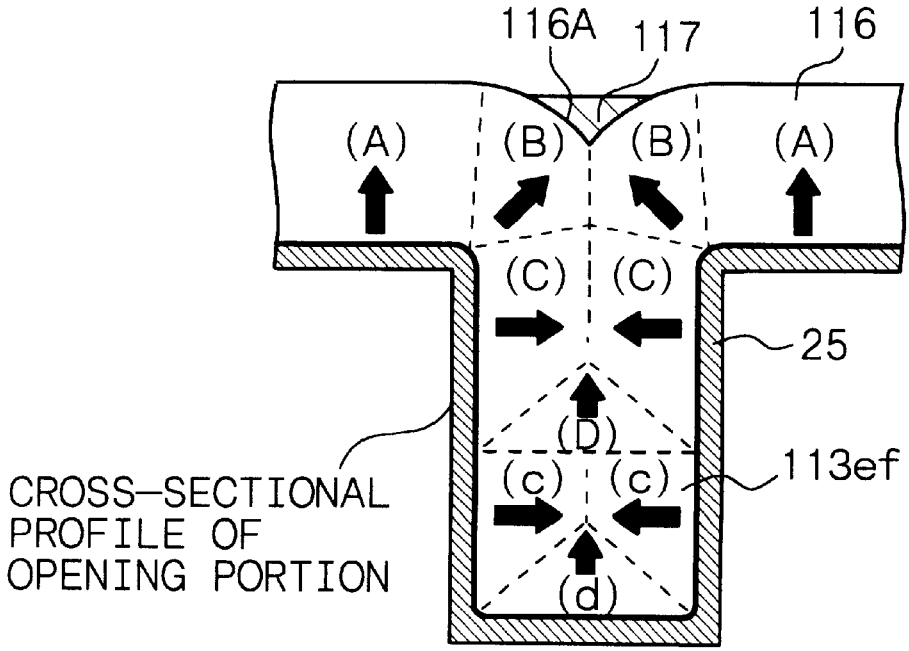
FIG. 43B is a schematic view for explaining the direction of crystal boundaries of the base portion and the second conductive material layer, in the production of the field emission device in Example 11.
Figure 44A:
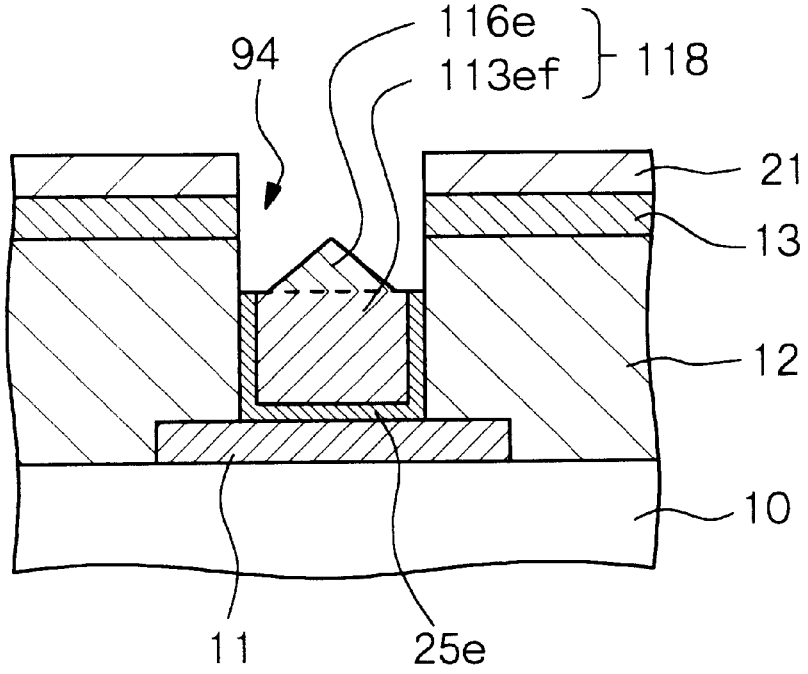
FIG. 44A following
Figure 44B:
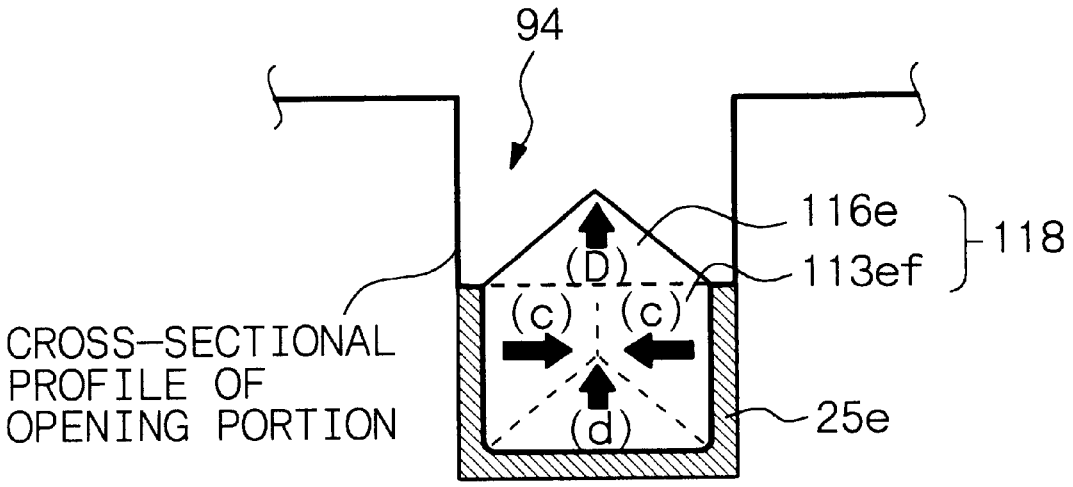
FIG. 44B is a schematic view for explaining the direction of crystal boundaries of the electron emitting portion, in the process for the production of the field emission device in Example 11.

Then, as shown in FIGS. 43A and 43B, a second conductive material layer 116 for forming the sharpened portion is formed on the entire surface including the residual portion of the opening portion 94. The second conductive material layer 116 is a tungsten layer formed by a CVD method, and it grows on the flat upper surface of the base portion 113*ef* as a new bottom surface of the opening portion 94, so that a region of the second conductive material layer 116 formed on the base portion 113*ef* is a region (D) having a crystal boundary oriented nearly perpendicularly. Then, a mask material layer 117 is left in a recess 116A in the surface of the second conductive material layer 116 in the same manner as in [Step-920] in Example 9.

[Step-1130]

Then, the second conductive material layer 116, the mask material layer 117 and the adhesive layer 25 are etched together to form the sharpened portion 116*e* having the form of a circular cone depending upon the largeness or smallness of the resist selectivity ratio according to the foregoing mechanism, whereby the electron emitting portion 108 is completed. Then, the wall surface of the opening portion 94 formed in the insulating layer 12 is etched backward, and the field emission device shown in FIGS. 40A and 40B is completed. The display according to the third aspect of the present invention, more specifically the third-B aspect can be constituted of such field emission devices. The display according to the third-B aspect of the present invention can be constituted by the same process as that explained in Example 1.

EXAMPLE 12

Figure 45:
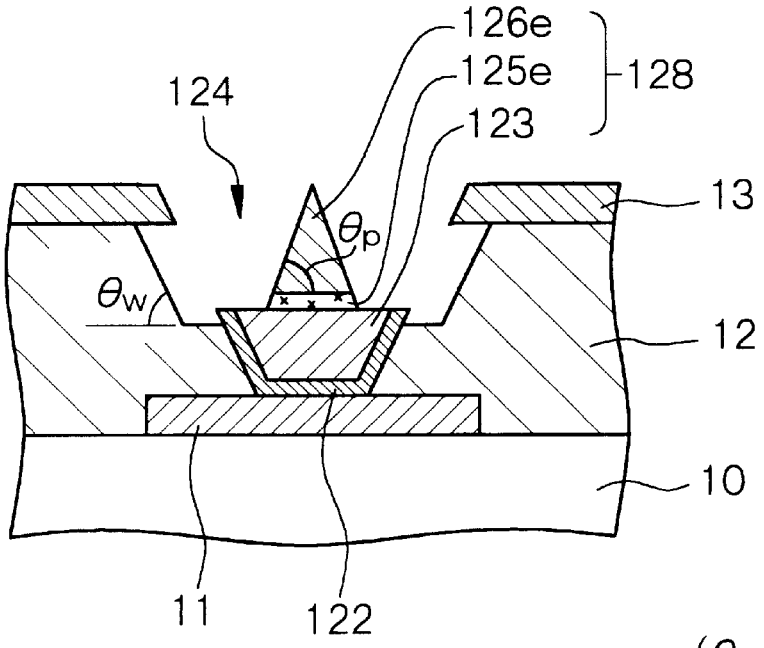
FIG. 45 is a schematic end view of a field emission device in Example 12.
Figure 46A:
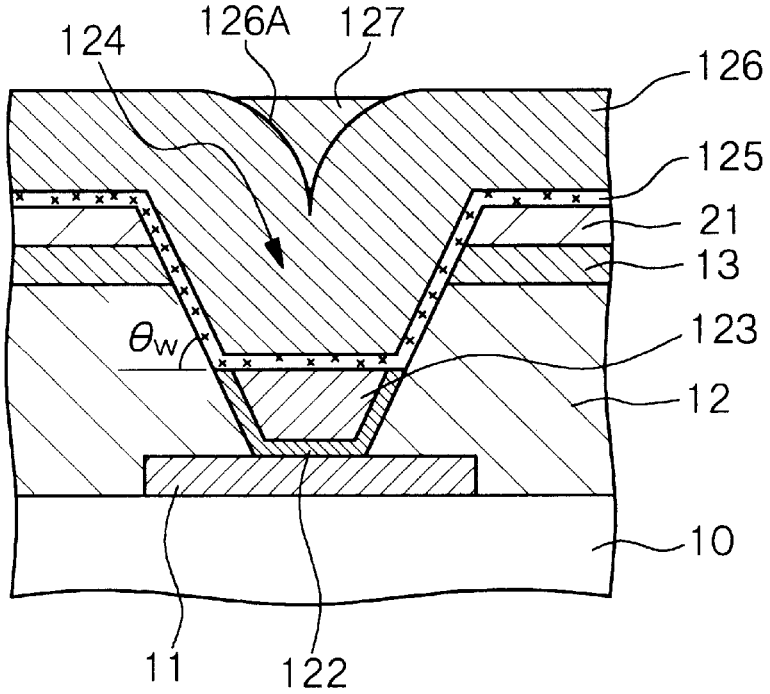
FIG. 46A is a schematic end view showing the step of leaving a mask material layer in a recess formed in a second conductive material layer for forming a sharpened portion.
Figure 46B:
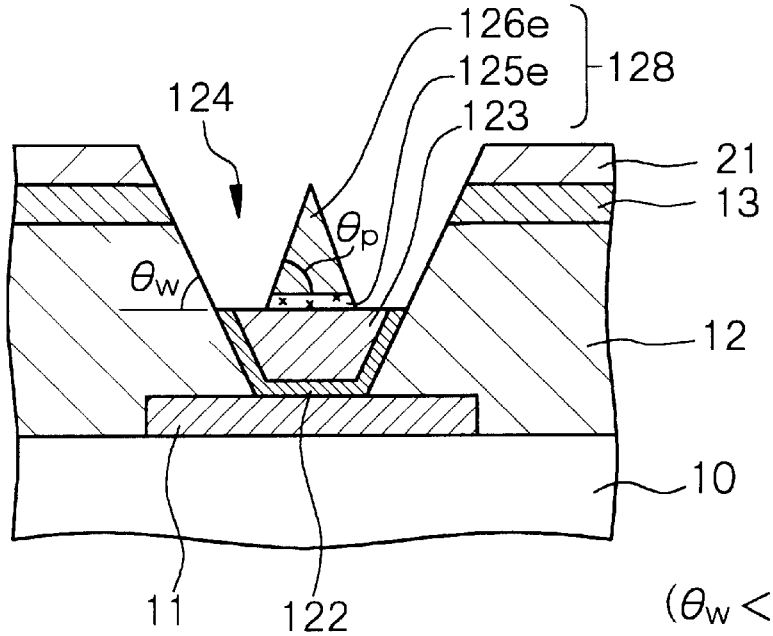
FIG. 46B is a schematic end view showing the step of forming an electron emitting portion, in the production of the field emission device in Example 12.

Example 12 is directed to the field emission device according to the third-C aspect of the present invention and the production process according to the second aspect of the present invention. FIG. 45 shows a schematic partial end view of the field emission device of Example 12, and FIGS. 46A and 46B show the production process thereof. In each of these Figures, those portions which are the same as those in FIGS. 1A and 1B are shown by the same reference numerals, and detailed explanations thereof are omitted.

As shown in FIG. 45, the field emission device of Example 12 has an electron emitting portion 128 comprising a base portion 123 and a conical sharpened portion 126*e* formed on the base portion 123. In Example 12, both the base portion 123 and the sharpened portion 126*e* are composed of tungsten, while these portions may be composed of different electrically conductive materials. An electrically conductive adhesive layer 122 of TiN is formed between the base portion 123 and the cathode electrode 11, and an electrically conductive adhesive layer 125*e* of TiN is formed between the base portion 123 and the sharpened portion 126*e*. The adhesive layer 125*e* is included in the electron emitting portion 128 for the convenience, while it is not a functionally essential component for the field emission device but is formed for a production-related reason. An inclination angle $\theta_w$ of a wall surface of the opening portion 124 measured from the surface of the cathode electrode 11 as a reference is smaller than an inclination angle $\theta_p$ of slant of the sharpened portion 126*e* of the electron emitting portion 128 measured from the surface of the cathode electrode 11 as a reference ($\theta_w<\theta_p<90°$). The opening portion 124 is formed by removing a portion of the insulating layer 12 from immediately below the gate electrode 13 to the upper end portion of the base portion 123.

The process for the production of the field emission device of Example 12 will be explained with reference to FIGS. 46A and 46B hereinafter.

[Step-1200]

Procedures up to the formation of an etching stop layer 21 are carried out in the same manner as in [Step-200] in Example 2. Then, the etching stop layer 21, the gate electrode 13 and the insulating layer 12 are consecutively etched to form the opening portion 124 having the slanted wall surface. In this case, the etching stop layer 21 and the insulating layer 12 can be etched under the condition shown in Table 16, and the gate electrode 13 can be etched under the condition shown in Table 12. The wall surface of the opening portion 124 has an inclination angle $\theta_w$ of approximately 75° when measured from the surface of the cathode electrode 11 as a reference. Then, an electrically conductive adhesive layer 122 and a first conductive material layer (not shown) for forming the base portion are formed on the entire surface including the inside of the opening portion 124, and these two layers are etched. Owing to the above etching, the base portion 123 is formed so as to be filled in the bottom portion of the opening portion 124. The shown base portion 123 has a flat upper surface, while the upper surface may be dented like that of the base portion 93*e* in Example 10. The base portion 123 having a flattened upper surface can be formed by the same process as that in [Step-1100] to [Step-1110] in Example 11. Further, an electrically conductive adhesive layer 125 and a second conductive material layer 126 for forming a sharpened portion are consecutively formed on the entire surface including the residual portion of the opening portion 124 in the same manner as in Example 11, and a mask material layer 127 is left in a recess 126A in the surface of the second conductive material layer 126. FIG. 46A shows a state where the procedures up to the above are finished.

[Step-1210]

Then, the second conductive material layer 126, the mask material layer 127 and the adhesive layer 125 are etched to form a sharpened portion 126*e* having the form of a circular cone depending upon the largeness or smallness of the resist selectivity ratio according to the foregoing mechanism, whereby the electron emitting portion 128 is completed. These layers can be etched in the same manner as in Example 4. The slant of the sharpened portion 126*e* has an inclination angle $\theta_p$ of approximately 80° when measured from the surface of the cathode electrode 11 as a reference, which inclination angle is greater than the inclination angle $\theta_w$ (approximately 75°) of the wall surface of the opening portion 124 measured from the surface of the cathode electrode 11 as a reference. These inclination angles satisfy the relationship of $\theta_w<\theta_p<90°$, so that there is formed an electron emitting portion 128 having a sufficient height without leaving an etching residue on the wall surface of the opening portion 124 during the above etching.

Then, the wall surface of the opening portion 124 formed in the insulating layer 12 is etched backward under an isotropic etching condition, to complete the field emission device shown in FIG. 45. The isotropic etching can be carried out in the same manner as in Example 1. The display according to the third aspect of the present invention, more specifically the third-C aspect can be constituted of such field emission devices. The display according to the third-C aspect of the present invention can be constituted by the same process as that explained in Example 1.

EXAMPLE 13

Example 13 is directed to the production process according to the second-B aspect of the present invention. The production process will be explained with reference to FIGS. 47A, 47B, 48A and 48B.

[Step-1300]

Figure 47A:
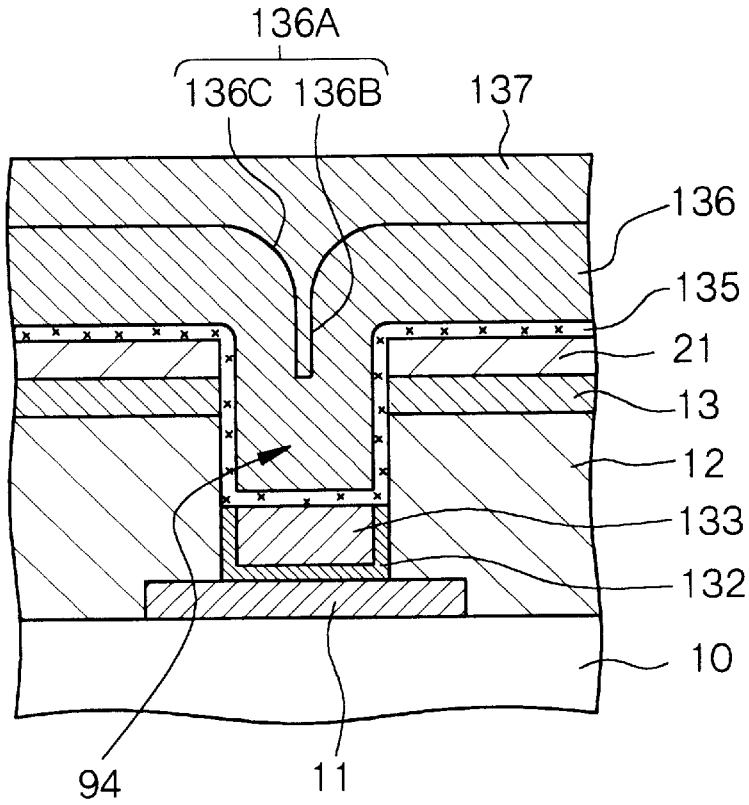
FIG. 47A is a schematic end view showing the step of forming a mask material layer.

First, procedures up to the formation of an opening portion 94 are carried out in the same manner as in [Step-900] in Example 9. Then, an electrically conductive adhesive layer 132 and a first conductive material layer (not shown) for forming a base portion are formed on the entire surface including the inside of the opening portion 94, and these two layers are etched. Owing to the above etching, a base portion 133 is formed to be filled in the bottom portion of the opening portion 94. The adhesive layer 132 remains between the base portion 133 and the cathode electrode 11. The shown base portion 133 has a flattened upper surface, while the upper surface may be dented like the surface of the base portion 93*e* in Example 10. The base portion 133 having a flattened upper surface can be formed by the same process as that in [Step-1100] to [Step-1110] in Example 11. Further, an electrically conductive adhesive layer 135 and a second conductive material layer 136 for forming a sharpened portion are consecutively formed on the entire surface including the residual portion of the opening portion 94. In this case, the thickness of the second conductive material layer 136 is determined such that a nearly funnel-like recess 136A having a columnar portion 136B reflecting a step between the upper end portion and the bottom portion of the residual portion of the opening portion 94 and a widened portion 136C communicating with the upper end portion of the above columnar portion 136B is formed in the surface of the second conductive material layer 136. Then, a mask material layer 137 is formed on the second conductive material layer 136. The above mask material layer 137 is composed, for example, of copper. FIG. 47A shows a state where the process up to the above is finished.

[Step-1310]

Figure 47B:
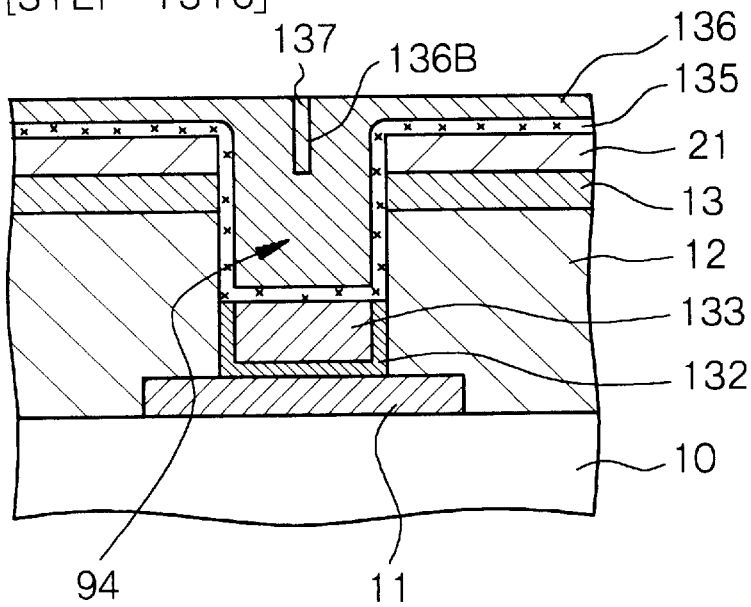
FIG. 47B is a schematic end view showing the step of leaving the mask material layer in a columnar portion, in the process for the production of the field emission device in Example 13.

Then, as shown in FIG. 47B, the mask material layer 137 and the second conductive material layer 136 are removed in a plane in parallel with the surface of the support 10, to leave the mask material layer 137 in the columnar portion 136B. The above removal can be carried out by a chemical/mechanical polishing (CMP) method in the same manner as in [Step-230] in Example 2.

[Step-1320]

Figure 48A:
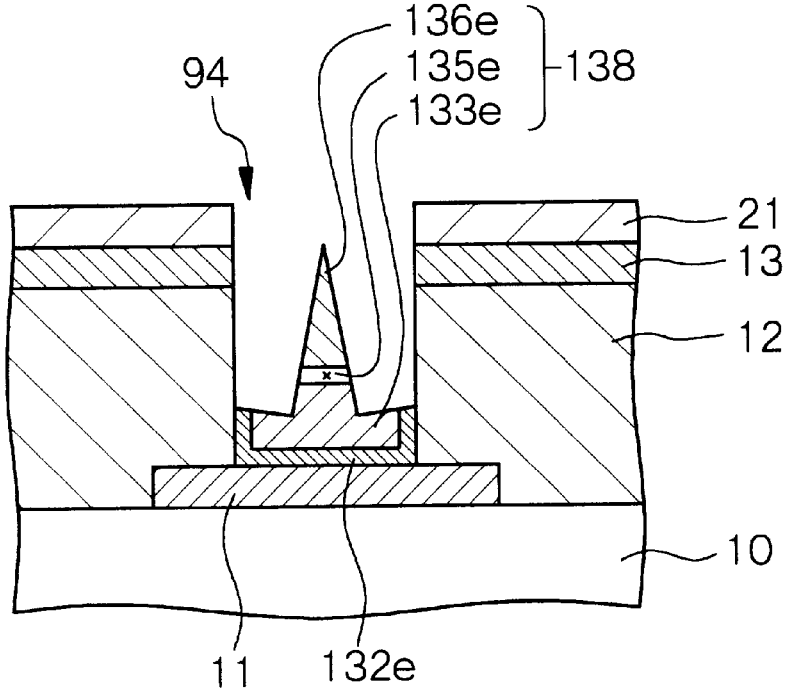
FIG. 48A following

Then, the second conductive material layer 136, the mask material layer 137 and the adhesive layer 135 are etched to form a sharpened portion 136*e* having the form of a circular cone depending upon the largeness of smallness of the resist selectivity ratio according to the already described mechanism. The above layers can be etched in the same manner as in [Step-240] in Example 2. The electron emitting portion 138 comprises the above sharpened portion 136*e*, the base portion 133*e* and the adhesive layer 135*e* remaining between the above sharpened portion 136*e* and the base portion 133*e*. The electron emitting portion 138 as a whole may have a conical form, while FIG. 48A shows a state wherein part of the base portion 133*e* remains being filled in the bottom portion of the opening portion 94. The above form (shape) is given when the mask material layer 137 filled in the columnar portion 136B has a small height or when the etch rate of the mask material layer 137 is relatively high, while it causes no problem on the function of the electron emitting portion 138.

[Step-1330]

Figure 48B:
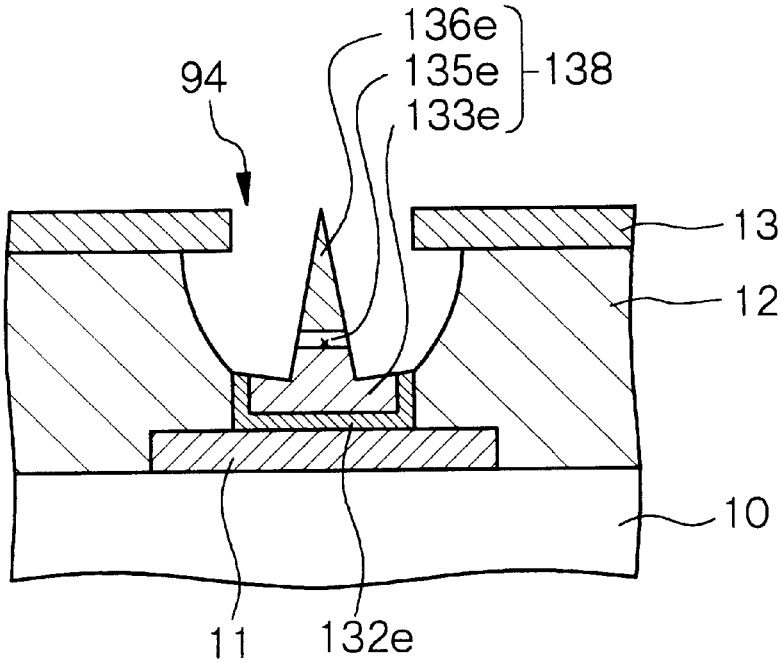
FIG. 48B is a schematic end view showing the step of etching a wall surface of an opening portion backward, in the process for the production of the field emission device in Example 13.

Then, the wall surface of the opening portion 94 formed in the insulating layer 12 is etched backward under an isotropic etching condition, to complete the field emission device shown in FIG. 48B. The isotropic etching is as described in Example 1. The display according to the third aspect of the present invention, more specifically the third-B aspect can be constituted of such field emission devices. The display according to the third-B aspect of the present invention can be constituted by the same process as that explained in Example 1.

EXAMPLE 14

Example 14 is directed to the production process according to the second-C aspect of the present invention. The production process will be explained with reference to FIG. 49.

[Step-1400]

Figure 49:
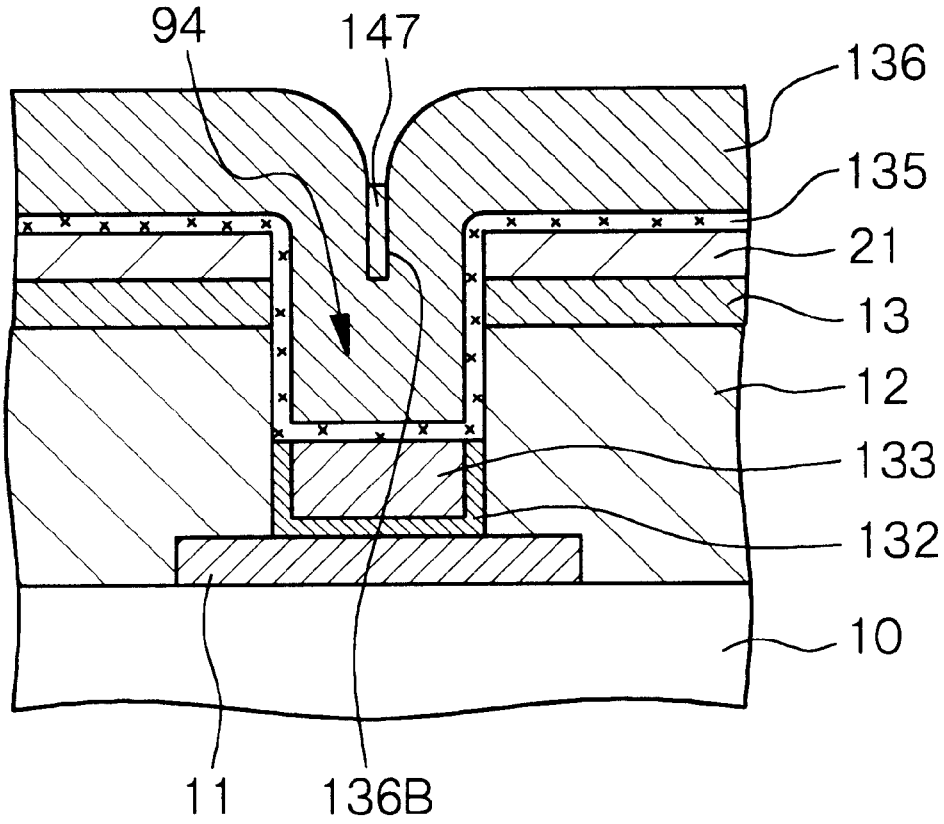
FIG. 49 is a schematic end view showing the step of leaving a mask material layer in a columnar portion, in the process for the production of a field emission device in Example 14.

Procedures up to the formation of the second conductive material layer 136 are carried out in the same manner as in [Step-1300] in Example 13. Then, a mask material layer 147 is formed on the second conductive material layer 136. Then, the mask material layer 147 only on the second conductive material layer 136 and in a widened portion is removed, to leave the mask material layer 147 in the columnar portion 136B as shown in FIG. 49. In this case, the mask material layer 147 composed of copper can be selectively removed without removing the second conductive material layer 136 composed of tungsten by wet etching, for example, using a diluted hydrofluoric acid aqueous solution. Thereafter, all the process including the etching of the second conductive material layer 136 and the mask material layer 147 and the isotropic etching of the insulating layer 12 can be carried out in the same manner as in Example 13.

EXAMPLE 15

Example 15 is directed to the production process according to the second-D aspect of the present invention. The production process will be explained with reference to FIGS. 50A and 50B.

[Step-1500]

Figure 50A:
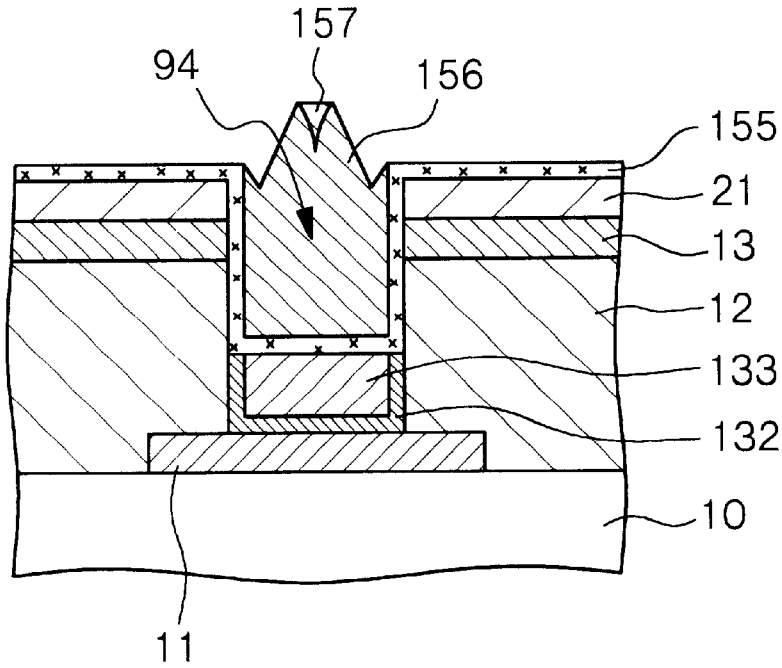
FIG. 50A is a schematic end view showing a state where the etching of a second conductive material layer is under way.

Procedures up to the formation of the base portion 133 are carried out in the same manner as in [Step-1300] in Example 13. Then, an approximately 0.07 $\mu$m thick electrically conductive adhesive layer 155 of tungsten is formed on the entire surface including the inside of the opening portion 94 in the same manner as in [Step-600] in Example 6 by a DC sputtering method. Then, a second conductive material layer 156 of tungsten is formed in the same manner as in Example 13, a mask material layer 157 is left in a recess in the surface of the second conductive material layer 156, and further, the second conductive material layer 156 and the mask material layer 157 are etched. FIG. 50A shows a point of time when the adhesive layer 155 is exposed. In Example 15, the material which covers most part of area of layers being etched at this point of time is still tungsten, so that the etching still proceeds readily since an etching reaction product having a low vapor pressure, explained with reference to FIGS. 21A and 21B, is not formed.

[Step-1510]

Figure 50B:
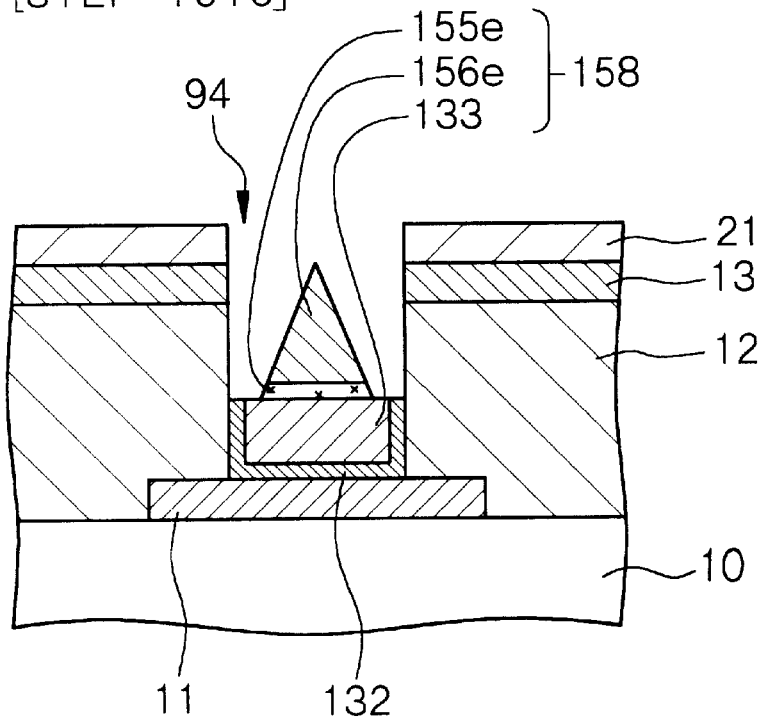
FIG. 50B is a schematic end view showing the step of forming an electron emitting portion, in the process for the production of a field emission device in Example 15.
Figure 51:
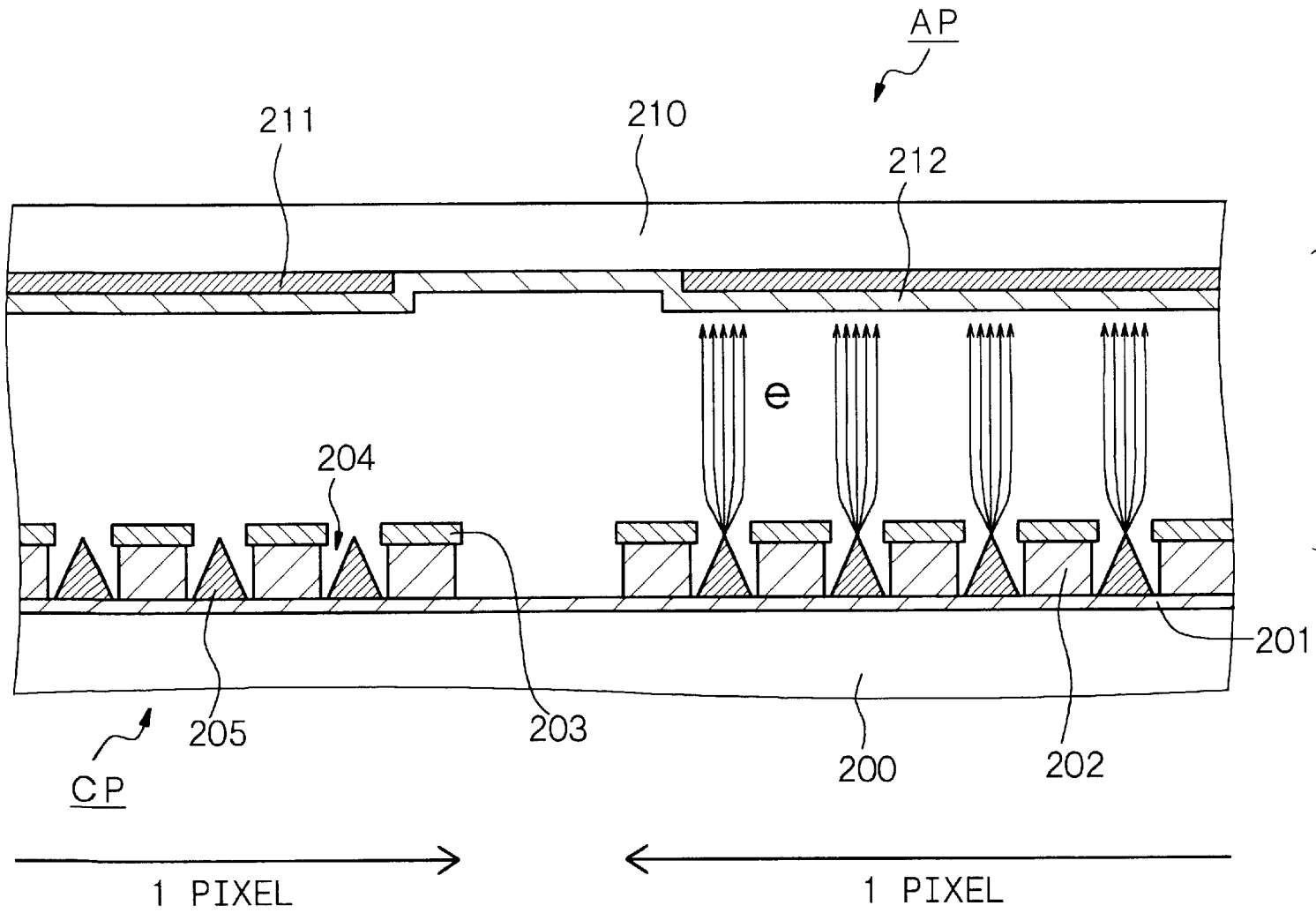
Fig. 51 (PRIOR ART)
FIG. 51 is a partial schematic end view showing a constitution of a conventional display.
Figure 52A:
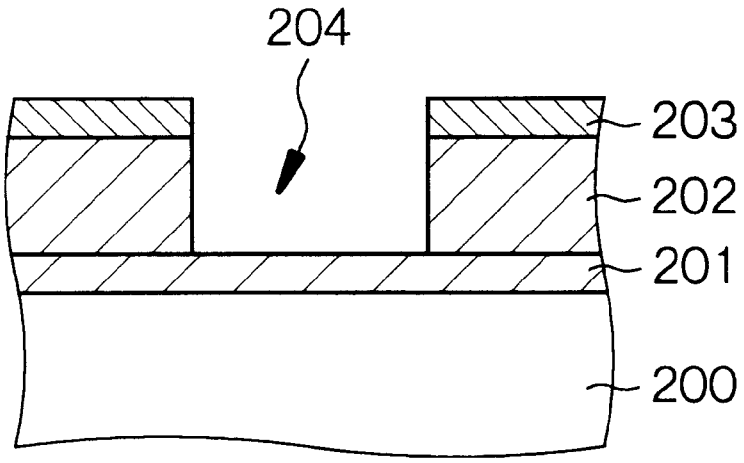
(PRIOR ART) Fig. 52A
FIG. 52A is a schematic end view showing a state where an opening portion is formed.
Figure 52B:
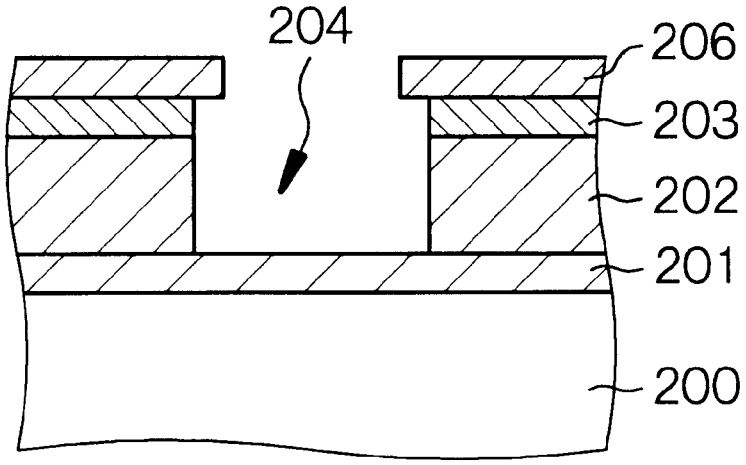
FIG. 52B is a schematic end view showing a state where a peeling-off layer is formed on a gate electrode and an insulating layer, in the process for the production of a conventional Spindt type field emission device.
Figure 53A:
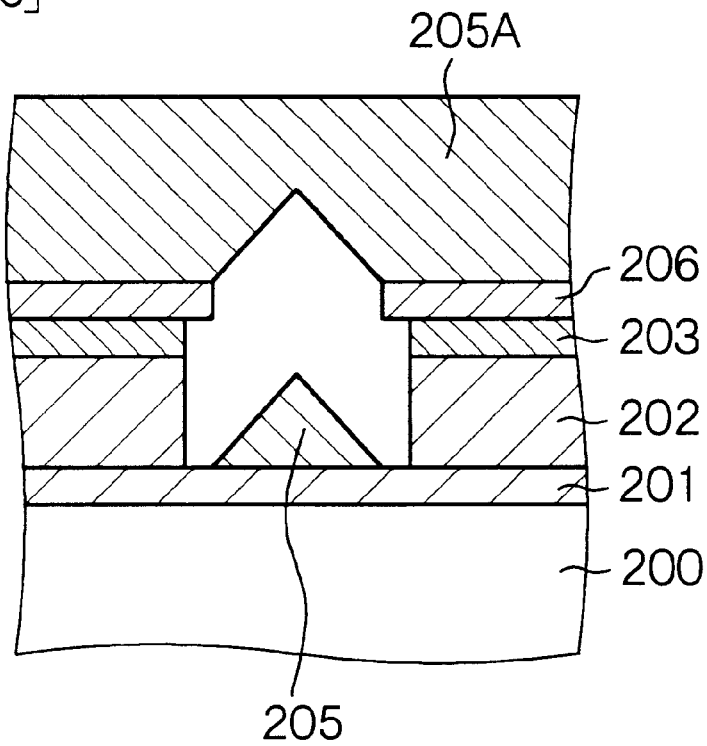
(PRIOR ART) Fig. 53A
FIG. 53A following
Figure 53B:
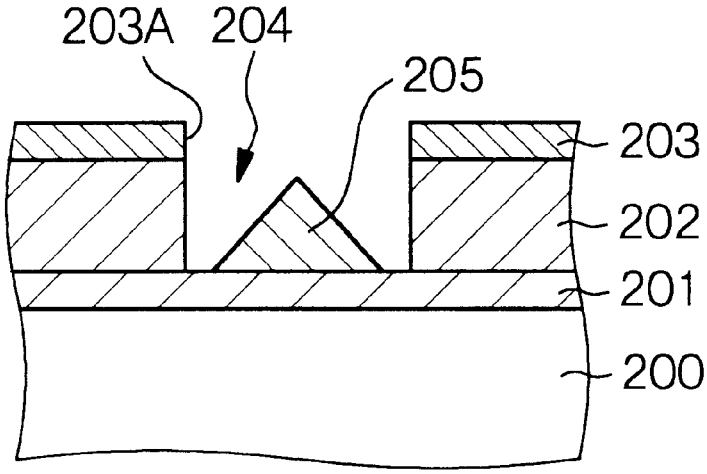
FIG. 53B is a schematic end view showing a state where unnecessary conductive material layer is removed together with the peeling-off layer, in the process for the production of the conventional Spindt type field emission device.

Further, as the etching of the layers being etched, including the etching of the adhesive layer 155, proceeds, a sharpened portion 156*e* having an excellent conical form is finally formed as shown in FIG. 50B. The electron emitting portion 158 comprises the above sharpened portion 156*e*, the base portion 133 and the adhesive layer 155*e* remaining between the sharpened portion 156*e* and the base portion 133. The display according to the third aspect of the present invention, more specifically the third-B aspect can be constituted of such field emission devices. The display according to the third-B aspect of the present invention can be constituted by the same process as that explained in Example 1.

The present invention has been explained with reference to Examples, while the present invention shall not be limited thereto. Particulars of structures of the field emission device, particulars of processing conditions and materials in the process for the production of the field emission device and particulars of structures of the display to which the field emission devices are applied are examples and can be altered, selected and combined. For example, the field emission devices explained in Examples 1 to 3 and 6 may be provided with the focus electrode explained in Example 5. Further, the field emission devices explained in Examples 9 to 13 and 15 may be provided with the focus electrode explained in Example 8. The field emission devices explained in Examples 2 to 5 may be provided with the adhesive layer explained in Example 6. Further, the field emission devices explained in Examples 7 to 13 may be provided with the adhesive layer explained in Example 15. Examples 4 and 5 show the production process according to the first-A aspect of the present invention, while the production process according to any one of the first-B to first-D aspects of the present invention may be applied thereto. Examples 7 to 12 show the production process according to the second-A aspect of the present invention, while the production process according to any one of the second-B to second-D aspects of the present invention may be applied thereto.

As is clear from the above explanations, in the field emission device according to the first aspect of the present invention, since the electron emitting portion is composed of a crystalline conductive material and the tip portion of the electron emitting portion has a crystal boundary oriented nearly perpendicularly, the electron emitting portion which repeats electrons under a high electric field can be improved in durability, and as a result, the display to which the field emission devices are applied can have a longer lifetime. In the field emission device according to the second aspect of the present invention, the relationship of $\theta_w<\theta_e<90°$ is satisfied, whereby there is employed a constitution in which almost no residue remains in the opening portion, a short circuit between the gate electrode and the cathode electrode is prevented while attaining a high electron emission efficiency, and as a consequence, the display according to the second aspect of the present invention to which the above field emission devices are applied can attain a low power consumption and high reliability. Further, in the field emission device according to the third aspect of the present invention, since the electron emitting portion comprises the base portion and the sharpened portion formed thereon, the distance between the sharpened portion of the electron emitting portion and the gate electrode can be finely adjusted by selecting a proper height of the base portion, and the field emission device and the display according to the third aspect of the present invention to which the above field emission devices are applied can enjoy an increased freedom in designing.

In the production process according to the second aspect of the present invention, the electron emitting portion comprises two separated portions such as the base portion and the sharpened portion thereon, and particularly when the sharpened portion is constituted of the crystalline conductive material layer formed by a CVD method, the sharpened portion can be constituted of a conductive material layer region having a crystal boundary oriented nearly perpendicularly immediately on the base portion, so that the distance between the sharpened portion of the electron emitting portion and the gate electrode can be accurately controlled and that the electron emitting portion can be also improved in durability.

In the production process according to each of the first and second aspects of the present invention, the tip portion or the sharpened portion for constituting the electron emitting portion can be formed by a series of self-aligned processes. Therefore, the process can be naturally a less complicated process, and further, when a cathode panel having a large area is designed, the electron emitting portions having uniform dimensions and forms (shapes) can be formed on the entire surface of the cathode panel, so that it is possible to easily cope with a larger screen of the display. Since the self-aligned process can be applied, the number of photolithography steps can be decreased. Further, the investment for production facilities can be reduced, the length of process time can be decreased, and the production cost of the field emission devices and displays can be decreased.

What is claimed is:

1. A cold cathode field emission device comprising;

(A) a cathode electrode formed on a support, (B) an insulating layer formed on the support and the cathode electrode, (C) a gate electrode formed on the insulating layer, (D) an opening portion which penetrates through the gate electrode and the insulating layer, and (E) an electron emitting portion which is positioned at a bottom portion of the opening portion and has a tip portion having a conical form and being composed of a crystalline conductive material, the tip portion of the electron emitting portion having a crystal boundary direction nearly perpendicular to the cathode electrode, an electrically conductive adhesive layer being formed between the electron emitting portion and the cathode electrode, the electron emitting portion and the adhesive layer including the same electrically conductive material.

2. The cold cathode field emission device according to claim 1, in which a second insulating layer is further formed on the gate electrode and the insulating layer, and a focus electrode is formed on the second insulating layer.

3. The cold cathode field emission device according to claim 1, in which the tip portion of the electron emitting portion is formed of a tungsten layer formed by a CVD method.

4. The cold cathode field emission device according to claim 1, further comprising:

a plurality of pixels, each pixel of said plurality of pixels having a plurality of cold cathode field emission devices and of an anode electrode and a fluorescence layer formed on a substrate so as to face a plurality of the cold cathode field emission devices, each cold cathode field emission device of said plurality of cold cathode field emission devices having said cathode electrode, said insulating layer, said gate electrode, said opening portion, and said electron emitting portion.

5. The cold cathode field emission device according to claim 1, in which the adhesive layer is composed of an electrically conductive material which satisfies a relationship of $R_2 \leqq R_1 \leqq 5R_2$ where $R_1$ is an etch rate of a conductive material layer for forming the electron emitting portion in the direction perpendicular to the support and $R_2$ is an etch rate of the adhesive layer in the direction perpendicular to the support.

6. A cold cathode field emission device comprising;

(A) a cathode electrode formed on a support, (B) an insulating layer formed on the support and the cathode electrode, (C) a gate electrode formed on the insulating layer, (D) an opening portion which penetrates through the gate electrode and the insulating layer, and (E) an electron emitting portion which is positioned at a bottom portion of the opening portion and has a tip portion having a conical form and being composed of a crystalline conductive material, the tip portion of the electron emitting portion having a crystal boundary direction nearly perpendicular to the cathode electrode, in which an electrically conductive adhesive layer is formed between the electron emitting portion and the cathode electrode, and in which the adhesive layer is composed of an electrically conductive material which satisfies a relationship of $R_2 \leqq R_1 \leqq 5R_2$ where $R_1$ is an etch of a conductive material layer for forming the electron emitting portion in the direction perpendicular to the support and $R_2$ is an etch rate of the adhesive layer in the direction perpendicular to the support.

7. The cold cathode field emission device according to claim 6, in which the electron emitting portion and the adhesive layer include the same electrically conductive material.

8. A cold cathode field emission device comprising;

(A) a cathode electrode formed on a support, (B) an insulating layer formed on the support and the cathode electrode, (C) a gate electrode formed on the insulating layer, (D) an opening portion which penetrates through the gate electrode and the insulating layer, and (E) an electron emitting portion which is positioned at a bottom portion of the opening portion and has a tip portion having a conical form, wherein a relationship of $\theta_w<\theta<90°$ is satisfied where $\theta$ is an inclination angle of a wall surface of the opening portion measured from the surface of the cathode electrode as a reference and $\theta_e$ is an inclination angle of slant of the tip portion measured from the surface of an adhesive layer as a reference.

9. A cold cathode fiedl emission device comprising:

(A) a cathode electrode formed on a support, (B) an insulating layer formed on the support and the cathode electrode, (C) a gate electrode formed on the insulating layer, (D) an opening portion which penetrates through the gate electrode and the insulating layer, and (E) an electon emitting portion which is positioned at a bottom portion of the opening portion, the electron emitting portion comprising a base portion and a conical sharpened portion formed on the base portion, said electron emitting portion being on an electrically conductive adhesive layer, said electrically conductive adhesive layer isolating said base portion from said insulating layer.

10. The cold cathode field emission device according to claim 9, in which the base portion and the sharpened portion are composed of different electrically conductive materials.

11. The cold cathode field emission device according to claim 9, in which the sharpened portion is composed of a crystalline conductive material and has a crystal boundary direction nearly perpendicular to the cathode electrode.

12. The cold catode field emission device according to claim 9, in which an electrically conductive adhesive layer is formed between the base portion and the sharpened portion.

13. The cold cathode field emission device according to claim 12, in which the adhesive layer is composed of an electrically conductive material which satisfies a relationship of $R_2 \leqq R_1 \leqq 5R_2$ where $R_1$ is an etch rate of a conductive material layer for forming the sharpened portion in the direction perpendicular to the support and $R_2$ is an etch rate of the adhesive layer in the direction perpendicular to the support.

14. The cold cathode field emission device according to claim 13, in which the sharpened portion and the adhesive layer are composed of the same electrically conductive material.

15. The cold cathode field emission device according to claim 8, in which a second insulating layer is further formed on the gate electrode and the insulating layer, and a focus electrode is formed on the second insulating layer.

16. The cold cathode field emission device according to claim 8, further comprising:

a plurality of pixels, each pixel of said plurality of pixels including a plurality of cold cathode field emission devices and of an anode electrode and a fluorescence layer formed on a substrate so as to face a plurality of the cold cathode field emission devices, each cold cathode field emission device of said plurality of the cold cathode field emission devices including said cathode electrode, said insulating layer, said gate electrode, said opening portion, and said electron emitting portion.

17. The cold cathode field emission device according to claim 9, wherein said base portion and said conical sharpened portion are formed from a conductive material layer, a portion of said conductive material layer being removed to form said base portion and said conical sharpened portion, said base being wider that said conical sharpened portion.

18. The cold cathode field emission device according to claim 17, further comprising:

an under-etch formed within said insulating layer under said gate electrode, said electrically conductive adhesive layer being usable as an etch mask to form said under-etch.

19. The cold cathode field emission device according to claim 9, wherein a second adhesive layer is between said conical sharpened portion and said base portion.

20. The cold cathode field emission device according to claim 9, further comprising:

an under-etch formed within said insulating layer under said gate electrode, said electrically conductive adhesive layer being usable as an etch mask to form said under-etch.

21. The cold cathode field emission device according to claim 9, in which the base portion and the sharpened portion are composed of the same electrically conductive material.

22. The cold cathode field emission device according to claim 21, in which the electrically conductive material is tungsten.

23. A cold cathode field emission device comprising;

(A) a cathode electrode formed on a support, (B) an insulating layer formed on the support and the cathode electrode, (C) a gate electrode formed on the insulating layer, (D) an opening portion which penetrates through the gate electrode and the insulating layer, and (E) an electron emitting portion which is positioned at a bottom portion of the opening portion, the electron emitting portion comprising a base portion and a conical sharpened portion formed on the base portion, in which the base portion and the sharpened portion are composed of the same electrically conductive material.

24. The cold cathode field emission device according to claim 23, in which the electrically conductive material is tungsten.

25. A cold cathode field emission device comprising;

(A) a cathode electrode formed on a support, (B) an insulating layer formed on the support and the cathode electrode, (C) a gate electrode formed on the insulating layer, (D) an opening portion which penetrates through the gate electrode and the insulating layer, and (E) an electron emitting portion which is positioned at a bottom portion of the opening portion, the electron emitting portion comprising a base portion and a conical sharpened portion formed on the base portion, in which an electrically conductive adhesive layer is formed between the base portion and the sharpened portion, and in which the adhesive layer is composed of an electrically conductive material which satisfies a relationship of $R_2 \leqq R_1 \leqq 5R_2$ where $R_1$ is an etch rate of a conductive material layer for forming the sharpened portion in the direction perpendicular to the support and $R_2$ is an etch rate of the adhesive layer in the direction perpendicular to the support.

26. The cold cathode field emission device according to claim 14, in which the sharpened portion and the adhesive layer are composed of the same electrically conductive material.

27. A cold cathode field emission device comprising;

(A) a cathode electrode formed on a support, (B) an insulating layer formed on the support and the cathode electrode, (C) a gate electrode formed on the insulating layer, (D) an opening portion which penetrates through the gate electrode and the insulating layer, and (E) an electron emitting portion which is positioned at a bottom portion of the opening portion, the electron emitting portion comprising a base portion and a conical sharpened portion formed on the base portion, in which a relationship of $\theta_w \theta_p < 90°$ is satisfied where $\theta_w$ is an inclination angle of a wall surface of the opening portion measured from the surface of the cathode electrode as a reference and $\theta_p$ is an inclination angle of slant of the sharpened portion measured from the surface of an adhesive layer as a reference.

28. A cold cathode field emission display comprising a plurality of pixels, each pixel being constituted of a plurality of cold cathode field emission devices and of an anode electrode and a fluorescence layer formed on a substrate so as to face a plurality of the cold cathode field emission devices, each cold cathode field emission device comprising;

(A) a cathode electrode formed on a support, (B) an insulating layer formed on the support and the cathode electrode, (C) a gate electrode formed on the insulating layer, (D) an opening portion which penetrates through the gate electrode and the insulating layer, and (E) an electron emitting portion which is positioned at a bottom portion of the opening portion and has a tip portion having a conical form, wherein a relationship of $\theta_w < \theta_e < 90°$ is satisfied where $\theta_w$ is an inclination angle of a wall surface of the opening portion measured from the surface of the cathode electrode as a reference and $\theta_e$ is an inclination angle of slant of the tip portion measured from the surface of an adhesive layer as a reference.

29. A cold cathode field emission device comprising;

(A) a cathode electrode formed on a support, (B) an insulating layer formed on the support and the cathode electrode, (C) a gate electrode formed on the insulating layer, (D) an opening portion which penetrates through the gate electrode and the insulating layer, and (E) an electron emitting portion which is positioned at a bottom portion of the opening portion, the electron emitting portion comprising a base portion and a conical sharpened portion formed on the base portion, wherein an under-etch formed within said insulating layer under said gate electrode, said base portion being used as an etch mask to form said under-etch.

30. The cold cathode field emission device according to claim 29 wherein said wherein a second adhesive layer is between said conical sharpened portion and said base portion, said second adhesive layer and said base portion being used as an etch mask to form said under-etch.

* * * * *

UNITED STATES PATENT AND TRADEMARK OFFICE

CERTIFICATE OF CORRECTION

PATENT NO. : 6,465,941 B1
DATED : October 15, 2002
INVENTOR(S) : Shinji Kubota et al.

It is certified that error appears in the above-identified patent and that said Letters Patent is hereby corrected as shown below:

Column 52,
Line 65, replace "etch or" with -- etch rate of --.

Column 53,
Line 18, replace "$\theta_w<\theta<90^o$ is satisfied where $\theta$ is" with -- $\theta_w<\theta_e<90^o$ is satisfied where $\theta_w$ is --.

Column 54,
Line 18, replace "wider that said" with -- wider than said --.

Signed and Sealed this

Second Day of March, 2004

JON W. DUDAS
*Acting Director of the United States Patent and Trademark Office*